US008186290B2

(12) United States Patent
Makino et al.

(10) Patent No.: US 8,186,290 B2
(45) Date of Patent: May 29, 2012

(54) SEWING MACHINE AND COMPUTER-READABLE RECORDING MEDIUM WITH RECORDED SEWING MACHINE CONTROL PROGRAM

(75) Inventors: Satoru Makino, Nagoya (JP); Hirokazu Hirose, Chiryu (JP); Yoshio Nishimura, Nagoya (JP); Masaki Shimizu, Toyoake (JP); Akie Ukai, Nagoya (JP); Yoshinori Nakamura, Toyohashi (JP); Kazumi Sai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1107 days.

(21) Appl. No.: 12/076,414

(22) Filed: Mar. 18, 2008

(65) Prior Publication Data

US 2008/0229991 A1 Sep. 25, 2008

(30) Foreign Application Priority Data

Mar. 20, 2007 (JP) ..... 2007-072347

(51) Int. Cl.
*D05B 19/00* (2006.01)

(52) U.S. Cl. ..... 112/470.13

(58) Field of Classification Search ..... 112/470.03, 112/470.01, 470.02, 470.05, 470.09, 272, 112/475.02, 475.19, 102.5; 700/136, 137, 700/138

See application file for complete search history.

(56) References Cited

U.S. PATENT DOCUMENTS

| | | | | |
|---|---|---|---|---|
| 4,037,546 | A * | 7/1977 | Kleinschmidt | 112/470.28 |
| 4,658,741 | A * | 4/1987 | Jehle et al. | 112/470.02 |
| 5,074,232 | A | 12/1991 | Matsubara et al. | |
| 5,153,840 | A | 10/1992 | Shigeta et al. | |
| 6,871,606 | B2 | 3/2005 | Schweizer | |
| 6,947,808 | B2 * | 9/2005 | Goldman | 700/138 |
| 6,959,657 | B1 | 11/2005 | Duval | |
| 7,218,986 | B2 * | 5/2007 | Yoshimura et al. | 700/132 |
| 7,325,502 | B2 | 2/2008 | Konig et al. | |
| 7,587,256 | B2 * | 9/2009 | Goldman | 700/138 |
| 7,848,842 | B2 * | 12/2010 | Suzuki et al. | 700/136 |
| 2006/0213415 | A1 | 9/2006 | Konig et al. | |

FOREIGN PATENT DOCUMENTS

| | | |
|---|---|---|
| JP | A-46-1137 | 1/1971 |
| JP | A-54-163154 | 12/1979 |
| JP | A-57-173088 | 10/1982 |
| JP | A-58-112583 | 7/1983 |
| JP | B2 61-24033 | 6/1986 |
| JP | B2 63-61034 | 11/1988 |
| JP | A 03-57480 | 3/1991 |

(Continued)

*Primary Examiner* — Tejash Patel
(74) *Attorney, Agent, or Firm* — Oliff & Berridge, PLC

(57) ABSTRACT

A sewing machine for a user to perform sewing while moving a work cloth includes: a detecting device that detects the work cloth; a movement calculating device that calculates, by two-dimensional coordinate data, a movement direction and a movement quantity of the work cloth between previous detection and current detection of the work cloth when the work cloth is detected; a movement data storage device that stores movement data serving as two-dimensional coordinate data indicative of the movement direction and the movement quantity; a movement data creating device that detects the work cloth on a one by one needle basis of sewing, calculates the movement data, and stores the calculated data in the movement data storage device; a cloth feed mechanism that moves the work cloth; and a reproduction sewing control device that performs sewing while moving the work cloth based on the movement data stored in the movement data storage device.

22 Claims, 47 Drawing Sheets

FOREIGN PATENT DOCUMENTS

| | | | |
|---|---|---|---|
| JP | A 03-97489 | | 4/1991 |
| JP | A-5-5262 | | 1/1993 |
| JP | A 06-343778 | | 12/1994 |
| JP | A 07-185165 | | 7/1995 |
| JP | A 07-300764 | | 11/1995 |
| JP | B2 2590257 | | 3/1997 |
| JP | A 10-295964 | | 11/1998 |
| JP | B2 2852967 | | 2/1999 |
| JP | A-11-85472 | | 3/1999 |
| JP | B2 3002568 | | 1/2000 |
| JP | A 2002-292175 | | 10/2002 |
| JP | A 2006-517449 | | 7/2006 |
| JP | A 2007-513656 | | 5/2007 |
| WO | WO 00/60156 | | 10/2000 |
| WO | WO 2004-072349 | A2 | 8/2004 |
| WO | WO 2005/056903 | A1 | 6/2005 |

* cited by examiner

FIG. 6

632

| STITCH HISTORY TABLE ST | | |
|---|---|---|
| n | X | Y |
| 0 | 7 | -15 |
| 1 | -10 | -5 |
| 2 | 0 | 8 |
| ⋮ | | |
| n | 8 | 10 |
| ⋮ | | |
| N-2 | | |
| N-1 | | |

SEWING MACHINE AND COMPUTER-READABLE RECORDING MEDIUM WITH RECORDED SEWING MACHINE CONTROL PROGRAM

CROSS-REFERENCE TO RELATED APPLICATION

The present disclosure claims priority to Japanese Patent Application No. 2007-072347, which was filed on Mar. 20, 2007, the disclosure of which is incorporated herein by reference in its entirety.

BACKGROUND

The present disclosure relates to a sewing machine and a computer-readable recording medium with a recorded sewing machine control program. More particularly, the present disclosure relates to a sewing machine that enables a user to perform sewing while moving a work cloth, and a computer-readable recording medium with a recorded sewing machine control program.

Conventionally, in quilting sewing, by the interposing of cotton between a front fabric and a back fabric with the sewing in a stitch pattern such as a straight line or a curve line, and free motion sewing is performed to form a stitch while these work cloths are moved manually by a user.

Whereas, in free motion sewing, if the pitches of stitch are non-uniform, the appearance will be impaired. And thus, it is desirable to perform sewing so that their respective stitch pitches become as uniform as possible. However, it is difficult for a beginner to perform sewing so that the respective stitch pitches are substantially uniform while the work cloth is moved in a desired direction.

Therefore, a technique has been proposed for recording information on a sewing work carried by a skillful person having high level ability, and reproducing the recorded information to perform the sewing. For example, a teaching embroidery sewing machine described in Japanese Patent Application Laid-open No. HEI 5-5262 is provided with a tablet and a cursor for detecting positional information of a movable frame (equivalent to an embroidery frame). In the teaching embroidery sewing machine, the cursor is securely fixed to a movable frame at which a cloth is tensioned. Positional information of the movable frame that may be moved by a skillful person is detected through the tablet, and then, the detected information is stored. A drive mechanism of the movable frame is driven based on the stored information, and the embroidery sewing performed by the skillful person is repeatedly reproduced.

In addition, three modes, i.e., a normal mode, a learning mode, and a playback mode, are provided in a playback sewing machine according to Japanese Patent Application Laid-open No. SHO 58-112583. A pedal stepping quantity in sewing performed in the learning mode is recorded, and then, a sewing machine is operated based on the recorded stepping quantity in the playback mode. Namely, there has been proposed a sewing machine for recording information concerning operation associated with sewing.

In addition, in a back-sewing apparatus of a sewing machine according to Japanese Patent Application Laid-open No. SHO 57-173088, embroidery sewing is performed based on a stitch control signal of an embroidery pattern stored in advance. When a return switch is operated, the stitch control signal of the embroidery pattern that is stored in advance is traced back from a current needle position, and then, back-sewing (sewing in a direction opposite to a normal direction) is performed so as to return to a previous stitch.

SUMMARY

However, in the apparatus disclosed in Japanese Patent Application Laid-open No. HEI 5-5262, there is a problem in that the apparatus cannot be used in free motion sewing for a user to perform sewing while moving a work cloth without the movable frame because positional information of the movable frame is recorded.

In addition, in the playback sewing machine described in Japanese Patent Application Laid-open No. SHO 58-112583, the playback sewing machine merely records the pedal stepping quantity by the user in order to reduce the inconvenience of the user having to continuously step on the pedal, but the recording is not performed for obtaining a beautiful sewing result. Therefore, it is impossible to obtain a beautiful sewing result by means of only the playback sewing machine technique. Further, in the back sewing apparatus of the sewing machine described in Japanese Patent Application Laid-open No. SHO 57-173088, the back sewing with a beautiful stitch can be performed. This is because a reinforcement stitch is performed so as not to loose a thread at the time of terminating a stitch pattern based on a stitch signal stored in advance. Therefore, there is a problem that this technique cannot be used in free motion sewing such that a user can perform sewing while moving a work cloth instead of sewing a pattern stored in advance.

The present disclosure has been made in order to solve the problems described above. It is one object of the present disclosure to provide a sewing machine and a sewing machine control program, for performing regular sewing after practice sewing has been performed.

According to a first aspect of this disclosure, a sewing machine is provided for a user to perform sewing while moving a work cloth. The sewing machine includes: a detecting device that detects the work cloth, a movement calculating device that calculates, by two-dimensional coordinate data, a movement direction and a movement quantity of the work cloth between previous detection and current detection of the work cloth by the detecting device when the work cloth is detected by the detecting device, a movement data storage device that stores movement data serving as two-dimensional coordinate data indicative of the movement direction and the movement quantity calculated by means of the movement calculating device, a movement data creating device that detects the work cloth by the detecting device on a one by one needle basis of sewing relative to the work cloth, calculates the movement data by the movement calculating device, and stores the calculated data in the movement data storage device, a cloth feed mechanism that moves the work cloth, and a reproduction sewing control device that performs the sewing while moving the work cloth by driving the cloth feed mechanism based on the movement data stored in the movement data storage device.

In addition, according to a second aspect of the present disclosure, a computer-readable recording medium is provided for storing a computer-executable sewing machine control program of a sewing machine for a user to perform sewing while moving a work cloth. The program includes: a detecting instruction for detecting the work cloth, a movement calculating instruction for calculating, by two-dimensional coordinate data, a movement direction and a movement quantity of the work cloth between previous detection and current detection of the work cloth by means of the detecting instruction when the work cloth is detected by means of the detecting instruction, a movement data storing instruction for storing movement data serving as two-dimensional coordinate data indicative of the movement direction and the movement quantity calculated by means of the movement calculating instruction, a movement data creating instruction for detecting the work cloth by means of the detecting instruction on a one by one needle basis of sewing relative to the work cloth, calculating and storing the movement data by means of the movement calculating instruction, and a reproduction sewing controlling instruction for performing sewing while moving the work cloth, based on the movement data stored by the movement data storing instruction.

BRIEF DESCRIPTION OF THE DRAWINGS

Exemplary examples of the disclosure will be described below in detail with reference to the accompanying drawings in which:

FIG. 6 is a schematic view showing a configuration of a stitch history table storage area;

DETAILED DESCRIPTION

Hereinafter, six examples according to the present disclosure will be described with reference to the accompanying drawings. In a sewing machine according to each of the first to sixth examples, when sewing is performed, coordinate information indicating a position of a stitch of the sewing can be recorded. Then, the recorded stitch is reproduced, and sewing can be performed. Practicing of free motion sewing is performed on a practice cloth that is different from the cloth that is intended for regular use, and when sewing has been successfully performed, the sewing that has been successfully performed can be reproduced on a cloth that is intended for regular sewing.

A first example will be described with reference to FIGS. 1 to 11. In the sewing machine according to the first example, there is provided a "normal mode," which performs normal sewing and a "practice mode," which records and reproduces sewing. When an instruction for starting sewing is performed in the "practice mode" (when a sewing start switch 21 is depressed), if a stitch is not stored in a stitch history table ST, a sewing needle is operated, a stitch is formed, and the history is stored in the stitch history table ST. In addition, if a stitch is stored in the stitch history table ST, a work cloth is fed by a cloth feeding mechanism 500 (refer to FIG. 2), a sewing needle is driven, and a stitch is formed so as to reproduce a stored stitch.

Figure 1:
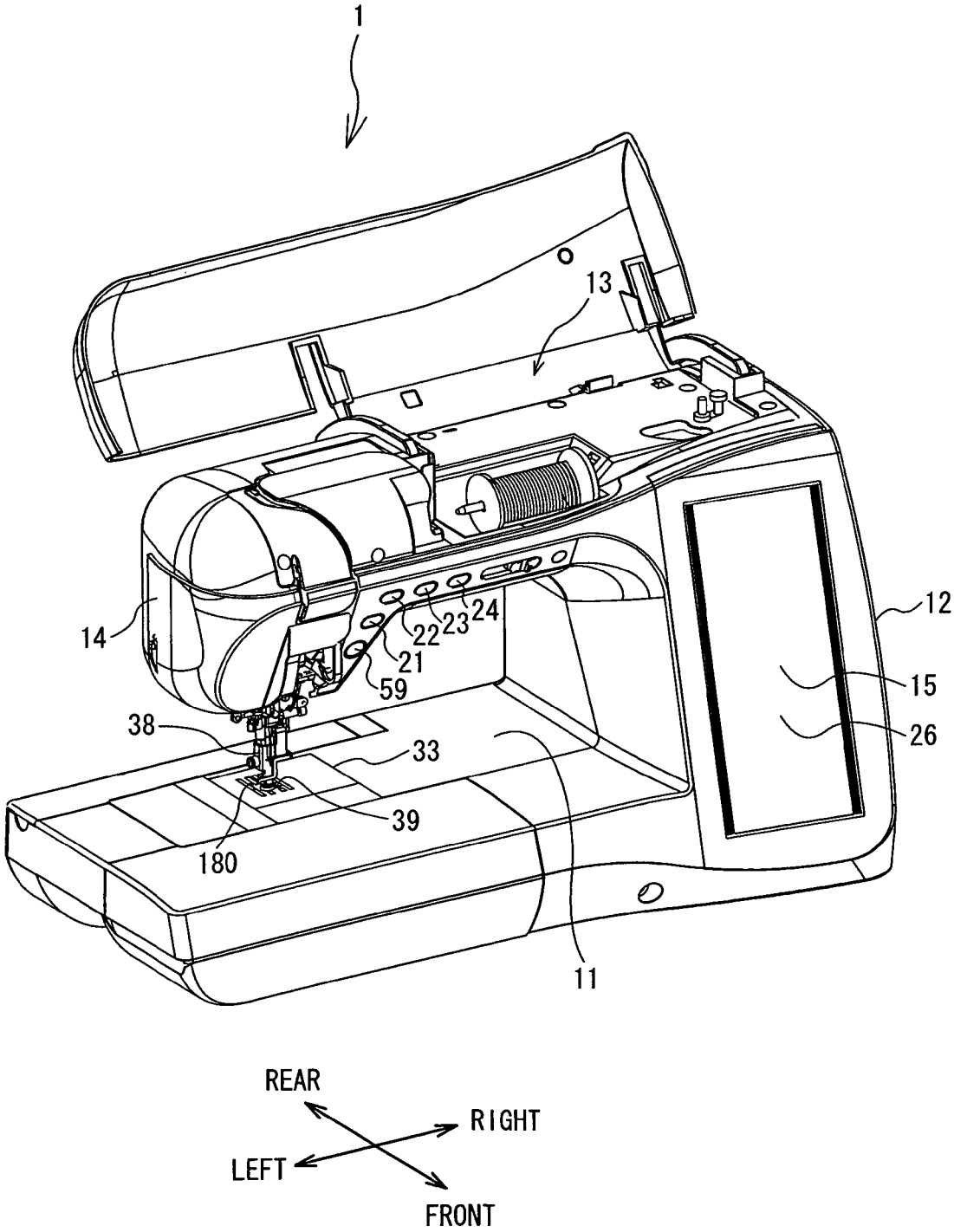
FIG. 1 is a perspective top view of a sewing machine in a state in which an opening/closing cover is opened.

Here, a physical configuration of a sewing machine 1 will be described with reference to FIG. 1 and FIG. 2. In FIG. 1, a front side is referred to as a forward direction of the sewing machine 1, a depth side is referred to as a rearward direction of the sewing machine 1, and a transverse direction is referred to as a transverse direction of the sewing machine 1.

As shown in FIG. 1, the sewing machine 1 may have a sewing machine bed 11 that is elongated in a transverse direction, a pillar 12, an arm portion 13, and a head portion 14. The pillar 12 may be erected upwardly of a right end of the sewing machine bed 11. The arm portion 13 may extend leftward from a top end of the pillar 12. The head portion 14 may be provided at a left end of the arm portion 13. A liquid crystal display 15 having a touch panel 26 on a surface may be provided at a front surface of the pillar 12. Sewing pattern and sewing condition input keys or the like are displayed on the liquid crystal display 15. With the touch panel 26, a user can select a sewing pattern and a sewing condition or the like by touching positions corresponding to these input keys or the like. Inside of the sewing machine 1, there is a sewing machine motor 91 (refer to FIG. 4), a main shaft (not shown), a needle bar 6 (refer to FIG. 3), a needle bar vertical movement mechanism (not shown), a needle swing mechanism (not shown), a presser bar 38 and a presser elevation mechanism (not shown) or the like. The needle bar 6 may mount a sewing needle 7 at a lower end. The needle bar vertical movement mechanism may vertically move the needle bar 6. The needle swing mechanism may swing the needle bar 6 in a transverse direction. The presser bar 38 may mount a presser foot 39 for pressing the work cloth. The presser elevation mechanism may vertically move the presser bar 38.

In addition, a needle plate 33 is provided on the sewing machine bed 11. Inside of the sewing machine bed 11, a longitudinal drive mechanism 200 for driving a feed dog 180 (refer to FIG. 2), a vertical drive mechanism 300 (refer to FIG. 2), a transverse feed mechanism 400 (refer to FIG. 2) and a shuttle 186 having a lower thread stored therein (refer to FIG. 2) or the like may be provided. A rectangular hole is provided on the needle plate 33 for rising and setting the feed dog 180. The feed dog 180 protrudes from a top face of the needle plate 33 through the rectangular hole. The work cloth is moved longitudinally and horizontally with the feed dog 180 driven by the longitudinal drive mechanism 200 and the transverse feed mechanism 400.

In addition, the sewing start switch 21, a sewing stop switch 22, and a mode changeover switch 59 may be provided on a front face of the head portion 14. The sewing start switch 21 may start driving of the sewing machine motor 91 so as to start sewing. The sewing stop switch 22 may stop driving of the sewing machine motor 91 so as to stop sewing. The mode changeover switch 59 may switch between a practice mode and a normal mode. An inversion switch 23 for feeding the work cloth in a backward direction, which is a direction opposite to a normal direction, is shown to the right side of the sewing stop switch 22. It is to be noted that the inversion switch 23 may also used in a second example and a sixth example, and is described with respect to FIG. 1 for the sake of convenience. Further, a reproduction sewing start switch 24 is shown to the right side of the inversion switch 23. It is to be noted that the reproduction sewing start switch 24 may also be used in the sixth example, and is described with respect to FIG. 1 for the sake of convenience. A pulley (not shown) for manually rotating the main shaft and vertically moving the needle bar 6 is provided on the right face of the sewing machine 1.

Next, with reference to FIG. 2, a description will be given with respect to the cloth feed mechanism 500 for feeding the work cloth in the longitudinal or transverse direction by the feed dog 180 of the sewing machine 1. The cloth feed mechanism 500 of a sewing machine 1 may be provided with the longitudinal drive mechanism 200, the vertical drive mechanism 300, and the transverse feed mechanism 400, as shown in the perspective view of FIG. 2. The longitudinal drive mechanism 200 may move a feed base 181 in the longitudinal direction. The vertical dive mechanism 300 may move the feed base 181 in the vertical direction. The transverse feed mechanism 400 may move the feed base 181 in the transverse direction. The feed dog 180 is fixed to the feed base 181. In FIG. 2, the shuttle 186 is illustrated with a chain double-dashed line for the sake of convenience and for the understanding of the disposition of these constituent elements.

Figure 2:
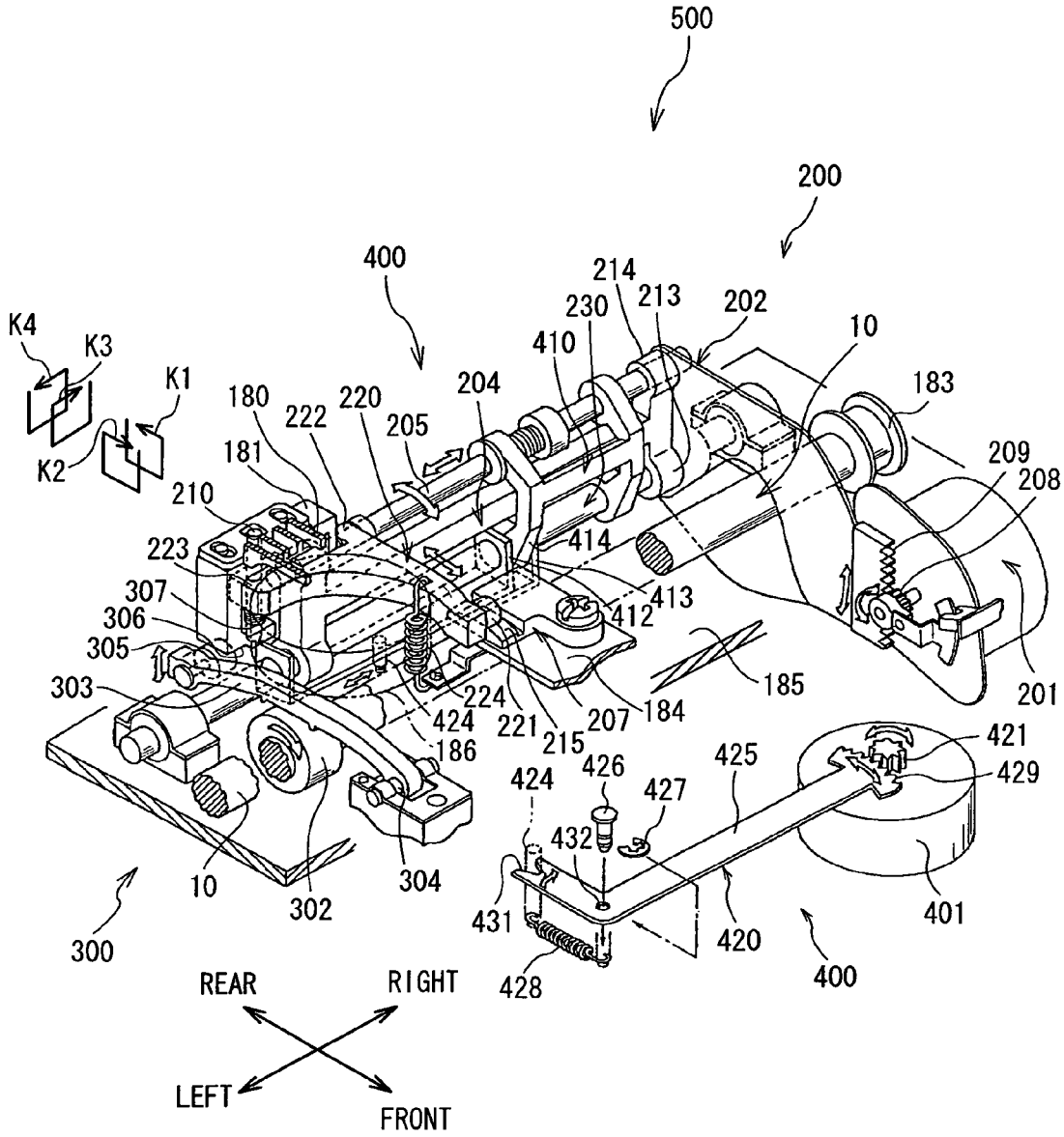
FIG. 2 is a perspective view showing essential portions of a cloth feed mechanism.

The longitudinal drive mechanism 200, as shown in FIG. 2, includes a longitudinal movement pulse motor 201, a swing lever 202, a support shaft 230, a swing arm 204, a coupling shaft 205, a horizontal feed arm 220, and a feed arm support portion 207 or the like. The longitudinal movement pulse motor 201 is independent of a drive system of the main shaft, interlocks with vertical movement of a sewing machine needle, and is controlled to be driven in synchronism with the main shaft by a drive circuit 73 (refer to FIG. 4). A drive gear 208 is fixed to an output shaft of the longitudinal movement pulse motor 201. The swing lever 202 serves as a plate member having two levers bent in a substantially "L" shape. The support shaft 230 is inserted through the bent section, and the swing lever 202 is thereby swingably supported on the support shaft 230. At end of a lever extending frontally (obliquely rightward frontal side of the drawing), a follower gear 209 mating with the drive gear 208 is mounted on. A center of pitch circle of the follower gear 209 is coincident with a shaft center of the support shaft 230. On the other hand, for a lever extending upwardly from a bent section, a side face of the swing arm 204 is fixed to it. The swing arm 204 serves as a substantially "H" shaped member in a front view. Bearing portions 213 are each formed at the lower part of both sides of a longitudinal shaft of the swing arm 204, and the support shaft 230 is inserted there. The swing arm 204 is thus supported swingably on the support shaft 230 integrally with the swing lever 202.

In addition, a bearing portion 214 is formed at the upper part of both sides of a longitudinal shaft at the swing arm 204. Each of the bearing portions 214 cross-links the coupling shaft 205 slidably in the transverse direction. The horizontal feed arm 220 supported on the coupling shaft 205 serves as a thick plate member formed in a substantially triangular shape in a planer view. A roller 221 is provided on a side face of a front end equivalent to a top of a triangle, and bearing portions 222, 223 are provided on both sides of a rear end equivalent to a bottom edge of a triangle. The coupling shaft 205 is inserted into the bearing portion 222 partway. In this way, the horizontal feed arm 220 is turnably supported on the coupling shaft 205. Further, a tensile spring 224 is tensioned between a lower frame 184 and a side face of the horizontal feed arm 220. A tensile spring 224 causes the roller 221 to come into contact with a surface 215 of the feed arm support portion 207 described later because the horizontal feed arm 220 is biased downwardly.

In addition, a guide rod 210 is fixed to the rear bearing portion 223 in a penetrating state. An axle line of the guide rod 210 crosses with a plate face of the horizontal feed arm 220 perpendicularly. A portion protruding at an upper part of the guide rod 210 penetrates a main body of the feed base 181. In addition, a portion protruding at a lower part of the guide rod 210 penetrates a guide portion (not shown) extending downwardly of the feed base 181. In other words, the feed base 181 is supported movably in the vertical direction on a plate face of the horizontal feed arm 220 by means of the guide rod 210. In addition, the feed arm support portion 207 is mounted on the frame 184 with screws. As described above, the horizontal feed arm 220 is slidably supported on the surface 215 on which the roller 221 slides, and moves longitudinally while it is maintained substantially horizontal along with movement of the coupling shaft 205.

The longitudinal drive mechanism 200 and the feed dog 180 operate as follows. When the longitudinal movement pulse motor 201 rotates forwardly or backwardly, and the drive gear 208 feeds the follower gear 209 in the vertical direction, the swing lever 202 swings around the support shaft 230 due to the feeding. Then, the swing arm 204 fixed integrally with the swing lever 202 swings around the support shaft 230 in a similar fashion. Due to swinging of the swing arm 204, the coupling shaft 205 moves reciprocally in the longitudinal direction. Along with reciprocal movement of the coupling shaft 205, the horizontal feed arm 220, which is cross-linked between the coupling shaft 205 and the feed arm support portion 207, reciprocally moves in the longitudinal direction while it is maintained substantially horizontal. Then, the feed base 181 to which the feed dog 180 is securely fixed is moved in the longitudinal direction by means of the rear guide rod 210.

Next, the vertical drive mechanism 300 will be described. The vertical drive mechanism 300 includes of a lower shaft 10, an eccentric cam 302, a vertical movement lever 303, etc. A timing belt (not shown) is applied between a pulley 183 fixed at a right end of the lower shaft 10 and a pulley (not shown) fixed to the main shaft, and the lower shaft 10 rotates in synchronism with the main shaft. The eccentric cam 302 serves as a cam provided at the lower shaft 10, and rotates integrally with the lower shaft 10. The vertical movement lever 303 is swingably supported on a rod 304 at a front end thereof, and a bottom face thereof makes contact with the eccentric cam 302. A roller 305 is turnably supported on a side face of a rear end of the vertical movement lever 303. A support face 306 provided on a lower face of the feed base 181 comes into slidable contact with the roller 305. On the other hand, a compression spring 307 is disposed between a guide portion 182 of the feed base 181 and the horizontal feed arm 220, and the feed base 181 is biased downwardly. With the configuration described above, the support face 306 comes into intimate contact with the roller 305 and the vertical movement lever 303 comes into contact with the eccentric cam 302. Therefore, along with rotation of the eccentric cam 302, the roller 305 moves vertically, and further, the feed base 181 moves vertically, following the vertical roller movement.

Next, the transverse feed mechanism 400 will be described. The transverse feed mechanism 400 is provided with a transverse sliding arm 410 fixed to the coupling shaft 205, a transverse movement pulse motor 401, and a transverse movement imparting mechanism 420. The transverse sliding arm 410 serves as a member formed in a substantially "H" shape in front view. The transverse sliding arm 410 is slidably supported on the support shaft 230, and is guided in the transverse direction. The transverse movement pulse motor 401 serving as a drive source of the transverse sliding arm 410 is mounted on a bottom face of a frame 185 included in the longitudinal drive mechanism 200 previously described, and is controlled to be driven in synchronism with the main shaft. A drive gear 421 is fixed to an output shaft.

The transverse movement imparting mechanism 420 includes pinch plates 412, 413 operable to pinch a lower part of the transverse sliding arm 410 described above, an actuation pin 424, a horizontal swing lever 425, a support pin 426, a stop ring 427, and a tensile spring 428 and so on. The pinch plates 412, 413 pinch a bearing portion 414 of the transverse sliding arm 410. On pinch plate 412, the actuation pin 424 is protruded downwardly on a lower face. Both ends of the pinch plate 412 are erected at a right angle, and the support shaft 230 is inserted through both ends that have been erected. As a result, a right end of the pinch plate 412 contacts with a left end face that is orthogonal to the axial direction of the support shaft 230, whereby the pinch plate 412 is disposed in parallel to the axial direction of the support shaft 230, and is smoothly guided to the support shaft 230. The other pinch plate 413 serves as a plate member formed in a substantially "L" shape, is mounted on the pinch plate 412 with screws, and pinches the bearing portion 414 between the pinch plates 413 and 412.

The horizontal swing lever 425 serves as a plate member having two levers bent in a substantially "L" shape, and is disposed at the bottom face side of the frame 185. Between the two levers, at an end of an elongated lever extending toward the transverse movement pulse motor 401, a follower gear 429 is disposed. The follower gear 429 is mated with the drive gear 421 of the transverse movement pulse motor 401. On the other hand, at an end of a short lever, a cutout portion 431 is disposed. And the actuation pin 424 on a lower face of a pinch plate 412 is engaged in a cutout of the cutout portion 431. The support pin 426 is inserted from a top position into a hole 432 provided at a bent portion of the horizontal swing lever 425. The support pin 426 is inserted into the frame 185 from a top face of the frame 185, and then, is inserted through the hole 432. At an upside groove of the support pin 426, the stop ring 427 is attached to a back face of the horizontal swing lever 425. In this way, the horizontal swing lever 425 is swingably supported on a bottom face of the frame 185 by means of the support pin 426.

The transverse feed mechanism 400 operates as follows. When the transverse movement pulse motor 401 drives forwardly or backwardly, and the drive gear 421 feeds the follower gear 429 horizontally in the longitudinal direction, the horizontal swing lever 425 is swung around the support pin 426 due to the feeding. Then, the short lever having the cutout portion 431 moves reciprocally in the substantially transverse direction. The movement of the short lever is transmitted to the actuation pin 424 engaged with the cutout portion 431. As a result, the pinch plate 412 on which the actuation pin 424 is mounted and the pinch plate 413 mounted on the pinch plate 412 with screws are guided by the support shaft 230, linearly move reciprocally in the transverse direction, and cause the transverse slide arm 410 to move reciprocally in the transverse direction. Therefore, the coupling shaft 205 fixed to a transverse slide arm 410, while being supported on the swing arm 204 of the longitudinal drive mechanism 200, slides and moves reciprocally in the transverse direction, and then, causes the horizontal feed arm 220 to similarly move reciprocally in the transverse direction. As a result of movement of the above sections, the feed base 181 to which the feed dog 180 is securely fixed is moved in the transverse direction by means of the guide rod 210.

As has been described above, the cloth feed mechanism 500, of the sewing machine 1, described above, operates as follows. When forward feeding or backward feeding, the drive gear 208 of the longitudinal movement pulse motor 201 drives forwardly or backwardly, and feeds the follower gear 209 upwardly or downwardly, whereby the feed dog 180 is moved reciprocally in the longitudinal direction via the coupling shaft 205, the horizontal feed arm 220 or the like. The reciprocal movement in the longitudinal direction of the feed dog 180 is performed along with a timing of rotation of the lower shaft 10 (with a timing of operation of the vertical drive mechanism 300), whereby the feed dog 180 moves along the trajectory of forward feeding, indicated by an arrow K1, or alternately, moves along the trajectory of backward feeding, indicated by an arrow K2.

On the other hand, when transverse feeding, the drive gear 421 of the transverse movement pulse motor 401 drives forwardly or backwardly, and causes the follower gear 429 to move reciprocally horizontally in the longitudinal direction. As described previously, the transverse slide arm 410 moves reciprocally in the transverse direction via the horizontal swing lever 425, or the pinch plates 412, 413 or the like. As a result, the coupling shaft 205 moves reciprocally in the transverse direction, and then, the feed dog 180 moves reciprocally in the transverse direction. The reciprocal movement in the transverse direction of the feed dog 180 is performed along with a timing of rotation of the lower shaft 10, whereby the feed dog 180 moves along the trajectory for transverse feeding in the right direction, indicated by an arrow K3, or alternatively, moves along the trajectory for transverse feeding in the left direction, indicated by an arrow K4.

Figure 3:
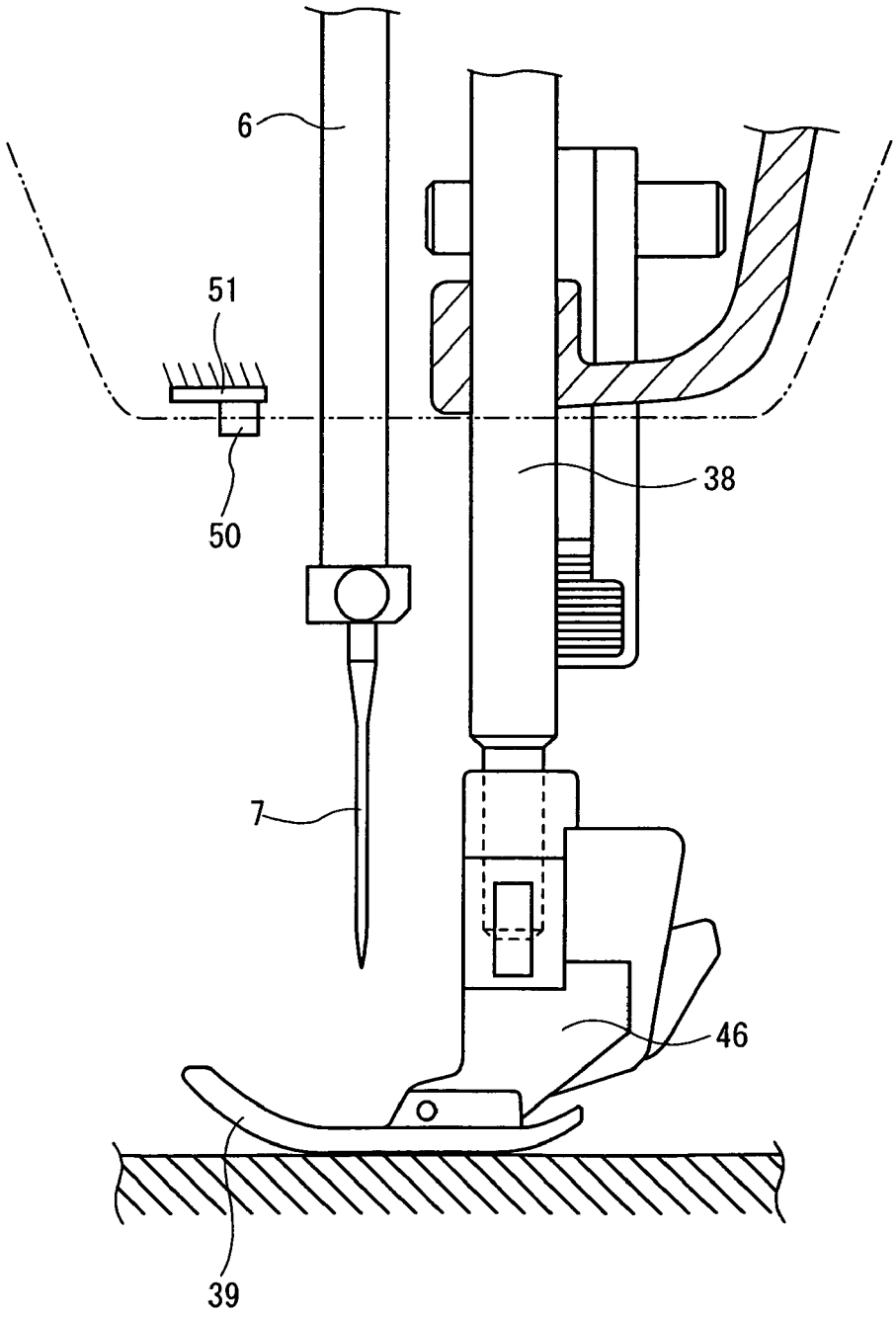
FIG. 3 is a schematic view showing an image sensor.

Next, an image sensor 50 will be described with reference to FIG. 3. The image sensor 50 is provided with a CCD camera and a control circuit, and acquires an image by the CCD camera at predetermined time intervals. Then, the same portion between an image acquired immediately before and the current acquired image is compared with each other, and a numeric value (XY coordinate value) is outputted, indicating a range of the same portion and in which direction and how far a target has moved from an intra-image position. In the present example, as shown in FIG. 3, a support frame 51 is mounted on a frame, which is not shown, of the sewing machine 1. The image sensor 50 is mounted on the support frame 51 so as to acquire a position in the vicinity, including a needle drop point of the sewing needle 7. The needle drop point indicates a point at which the sewing needle 7 is moved downwardly by a needle bar transverse movement mechanism 82, and then, is pierced on the work cloth. The presser foot 39 for pressing the work cloth is attached to a presser holder 46 fixed to a lower end of the presser bar 38. The presser foot 39 and the presser holder 46 are formed of a transparent resin so as to enable acquisition of a position of the vicinity including a needle drop point.

Figure 4:
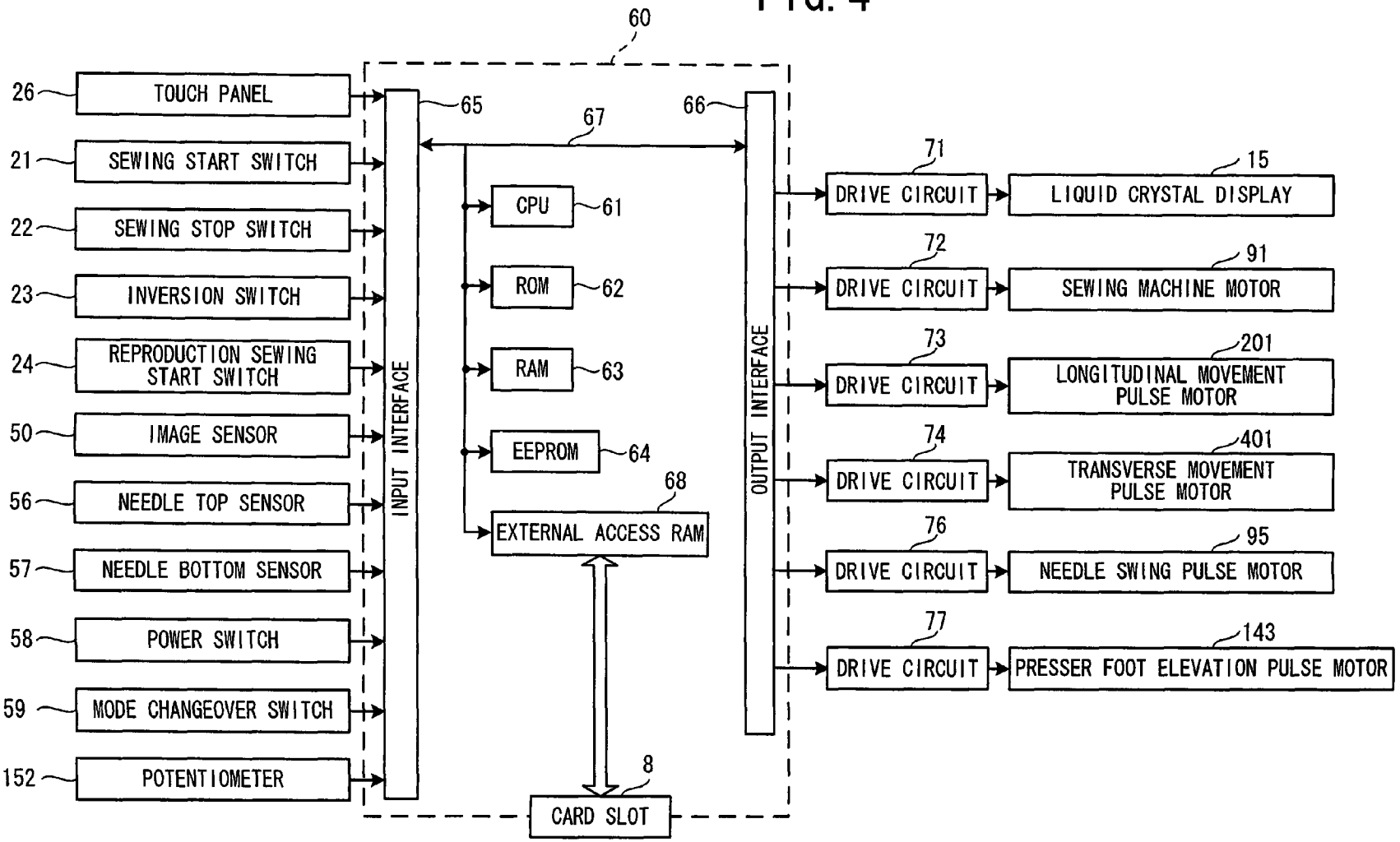
FIG. 4 is a block diagram depicting an electrical configuration of a sewing machine.

Next, an electrical configuration of the sewing machine 1 will be described with reference to FIG. 4. As shown in FIG. 4, an equipment main body 60 of the sewing machine 1 is comprised of constituent elements such as a CPU 61, a ROM 62, a RAM 63, an EEPROM 64, a card slot 8, an external access RAM 68, an input interface 65, and an output interface 66. These constituent elements are interconnected by a bus 67. The input interface 65 is connected to the constituent elements such as the touch panel 26, the sewing start switch 21, the sewing stop switch 22, the image sensor 50, the needle top sensor 56, the needle bottom sensor 57, a power switch 58, the mode changeover switch 59, and a potentiometer 152. The image sensor 50 may detect a movement quantity and a movement direction of the work cloth. The needle top sensor 56 may detect that a position of the sewing needle 7 is on the top position. The needle bottom sensor 57 may detect that a position of the sewing needle 7 is at the lower position. The potentiometer 152 may detect an elevation position of the presser bar 38. While the inversion switch 23 is connected to the input interface 65, the inversion switch 23 may also be used in the second and sixth example, and is described in FIG. 4 for the sake of convenience. Further, while the reproduction sewing start switch 24 is connected to the input interface 65, the reproduction sewing start switch 24 may also be used in the sixth example, and is described in FIG. 4 for the sake of convenience.

On the other hand, drive circuits 71-77 are electrically connected to the output interface 66. The drive circuit 71 may drive the liquid crystal display 15. The drive circuit 72 may drive the sewing machine motor 91 for rotationally driving the main shaft. The drive circuit 73 may drive the longitudinal movement pulse motor 201 for moving the feed dog 180 in the longitudinal direction. The drive circuit 74 may drive the transverse movement pulse motor 401 for moving the feed dog 180 in the transverse direction. The drive circuit 76 may drive a needle swing pulse motor 95 for swinging the needle bar 6. The drive circuit 77 may drive a presser dog elevation pulse motor 143 for elevating the presser bar 38.

A control program for controlling the sewing machine 1 may be stored in the ROM 62, serving as a storage element exclusively used for readout. The CPU 61 is responsible for the main control of the sewing machine 1, and executes a variety of computations and processing operations in accordance with the control program stored in the ROM 62. The RAM 63 serves as a storage element that can be arbitrarily read and written, and a variety of storage areas for storing a computation result that the CPU 61 has computed.

Figure 5:
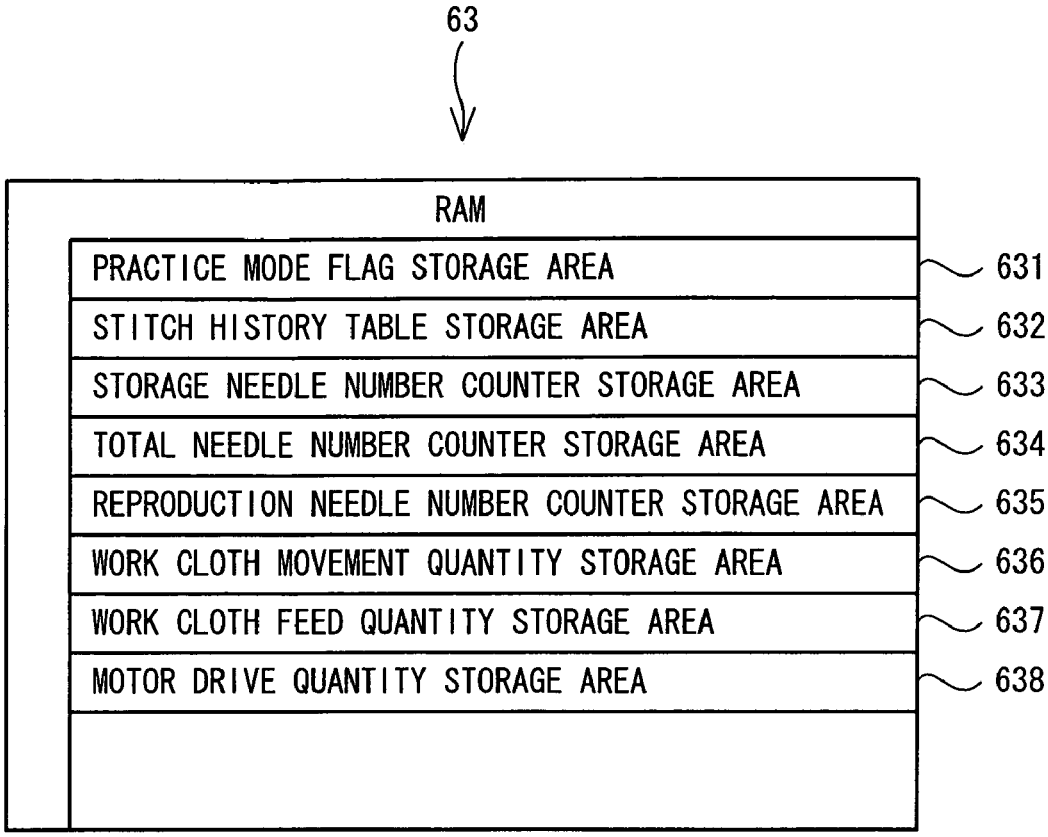
FIG. 5 is a schematic view showing a configuration of a storage area of a RAM.

Next, a storage area provided in a RAM 63 will be described with reference to FIG. 5 and FIG. 6. As shown in FIG. 5, in the RAM 63, there is provided a practice mode flag storage area 631, a stitch history table storage area 632, a storage needle number counter storage area 633, a total needle number storage area 634, a reproduction needle number counter storage area 635, the work cloth movement quantity storage area 636, the work cloth feed quantity storage area 637, and a motor drive quantity storage area 638 or the like. A variety of storage areas, which are not shown, are also provided in the RAM 63.

A value indicating whether a practice mode is set, is stored in the practice mode flag storage area 631. Specifically, when "1" is stored in the practice mode flag storage area 631, a practice mode flag is set to "ON," indicating that a practice mode is set. In addition, when "0" is stored, a practice mode flag is set to "OFF," indicating that a normal mode is set instead of the practice mode. The practice mode flag is switched by operating (depressing) the mode changeover switch 59. Then, the stitch history table ST having recorded therein coordinate information indicating a movement quantity (X-coordinate and Y-coordinate) between a start point and an end point of a stitch formed in the practice mode is stored in the stitch history table storage area 632 (refer to FIG. 6). The stitch history table storage area 632, as shown in FIG. 6, serves as N, a one-dimensional arrangement from "0" to "N−1," having an "X-coordinate" and a "Y-coordinate" as arrangement elements. Namely, coordinate information on a stitch from 0 to N can be stored in the stitch history table ST. At the "0"-th stitch, coordinate information on a first stitch, namely, a movement quantity of the work cloth from a start point to an end point of a first stitch is stored. A stitch history table is described as ST, and the n-th arrangement of the stitch history table ST is described as STn (Xn, Yn). Namely, a movement of the X-coordinate serving as an element of STn is Xn, and a movement quantity of the Y-coordinate is Yn.

Then, a storage needle number counter "n" is stored in the storage needle number counter storage area 633. The storage needle number counter "n" is used to specify arrangement of the stitch history table ST. Then, a total needle number "S" is stored in the total needle number storage area 634. The total needle number "S" is a total number of stitches formed in a practice mode and stored in the stitch history table ST. Then, a reproduction needle number counter "i" for specifying arrangement indicating a next stitch at the time of reproducing a stitch stored in the stitch history table ST in a practice mode is stored in the reproduction needle number counter storage area 635.

Then, a cloth movement quantity A (Xa, Ya) is stored in the work cloth movement quantity storage area 636. The cloth movement quantity A (Xa, Ya) is coordinate information (movement quantity in the X-axis direction and movement quantity in the Y-axis direction) indicating a movement quantity of the work cloth acquired from the image sensor 50. Then, a work cloth feed quantity M (Xm, Ym) is stored in the work cloth feed quantity storage area 637. The work cloth feed quantity M (Xm, Ym) is coordinate information indicating a quantity of moving the work cloth by means of the feed dog 180 at the time of reproducing a stitch stored in the stitch history table ST in the practice mode. Then, a motor drive quantity (X', Y') for driving the longitudinal movement pulse motor 201 and the transverse movement pulse motor 401 is stored in order to move the feed dog 180 in the motor drive quantity storage area 638.

Next, an operation of the sewing machine 1 will be described with reference to FIGS. 7 to 11. A control program stored in the ROM 62 is executed by means of the CPU 61 when power is supplied to the sewing machine 1, whereby a main routine is started.

Figure 7:
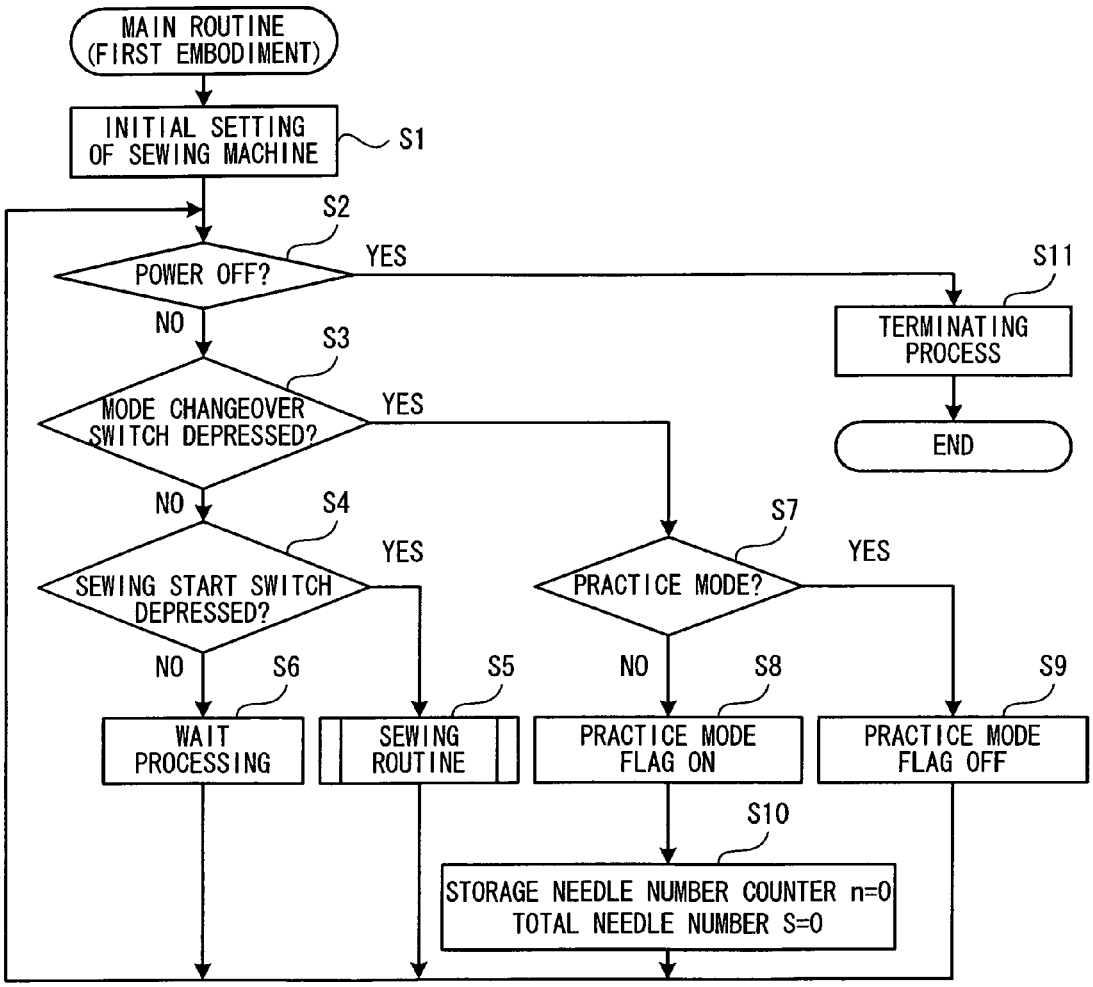
FIG. 7 is a flowchart of a main routine of a sewing machine according to the present example.

As shown in FIG. 7, in a main routine, first, initial setting of a sewing machine is performed in step 1 (S1). In this initial setting, initialization of a variety of storage areas or the like is performed. Then, the power switch 58 is operated, and a determination is made as to whether an instruction for turning power OFF has been supplied in step 2 (S2). When the instruction for turning power OFF is not provided (S2: NO), the mode changeover switch 59 is operated, and a determination is made as to whether an instruction for switching a practice mode and a normal mode has been performed in step 3 (S3). When the mode changeover switch 59 is operated (S3: YES), a determination is made as to whether a "practice mode" is currently set in step 7 (S7). When the practice mode flag storage area 631 is referenced, "1" is stored, a practice mode flag is set to ON, and the "practice mode" is set (S7: YES), then "0" is set and the practice mode flag is set to OFF in order to set the "normal mode" in step 9 (S9). Then, the processing may return to S2. On the other hand, when "0" is stored in the practice mode flag storage area 631, the practice mode flag is set to OFF, and the "normal mode" is set (S7: NO), the practice mode flag is set to ON in order to set the "practice mode" in step 8 (S8). Further, the storage needle number counter "n" and a total needle number "S" are set to an initial value "0" in step 10 (S10). Then, the processing may return to S2.

In addition, when the mode changeover switch 59 is not operated (S3: NO), a determination is made as to whether the sewing start switch 21 has been operated in step 4 (S4). If the sewing start switch 21 is not operated (S4: NO), one waits for a predetermined time in step 6 (S6), and the processing may return to S2. In addition, when the sewing start switch 21 is operated, and then, an instruction for starting sewing is performed (S4: YES), a sewing routine is performed in step 5 (S5) (refer to FIG. 8). When the sewing routine is terminated, the processing may return to S2. At S2, when the power switch 58 is operated, and then, an instruction for turning power OFF is performed (S2: YES), a terminating process is performed in step 11 (S11), the main routine is terminated, and then, the sewing machine 1 is powered OFF.

Figure 8:
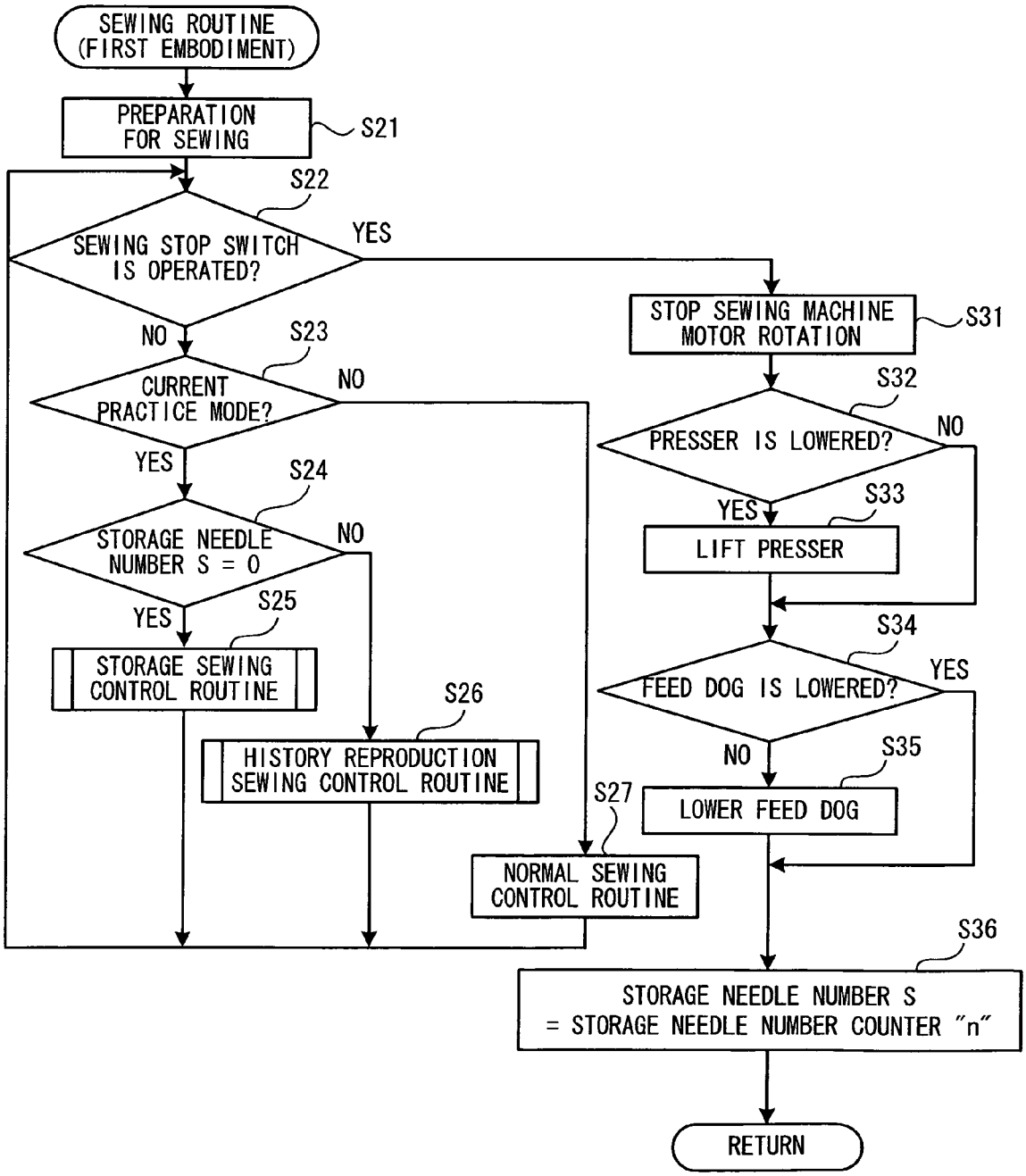
FIG. 8 is a flowchart of a sewing routine performed in a main routine.

Now, the sewing routine will be described in detail with reference to the flowcharts of FIGS. 8 to 11. As shown in FIG. 8, first, preparation for sewing is performed in the sewing routine in step 21 (S21). In the preparation for sewing, initialization of a variety of variables for the sewing control of the reproduction needle number counter "i" or the like, initialization of a motor or the like, and initialization of a variety of sensors such as the image sensor 50 or a needle position sensor are performed. An initial value "0" is stored in the reproduction needle number counter "i". In the image sensor 50, acquisition is performed by the CCD camera in order to define a reference position of the work cloth as a current position.

Then, a determination is made as to whether the sewing stop switch 22 has been operated in step 22 (S22). If the sewing stop switch 22 is not operated (S22: NO), a determination is made as to whether a "practice mode" is currently set in step 23 (S23). When the practice mode flag is set to OFF, and a "normal mode" is set (S23: NO), the sewing machine motor 91 is driven, and then, normal sewing operation is performed in step 27 (S27). Then, the processing may return to S21, and then, processing operations of S22, S23, and S27 are repeatedly performed until the sewing stop switch 22 has been operated (S22: YES).

When a practice mode flag is set to ON, and then, a "practice mode" is set (S23: YES), "practice mode" processing is performed. Then, history of a stitch is stored in the stitch history table ST depending on whether a total needle number S is set to "0," and a determination is made as to whether recording is performed. In step 24 (S24), if the total needle number is set to "0," a stitch is not recorded yet (S24: YES), and thus, in step 25 (S25) a storage sewing control routine is executed in order to record a stitch (refer to FIG. 9). Then, the processing may return to S22. In addition, if the total needle number is not set to "0", stitch recording is performed (S24: NO), and thus, in step 26 (S26) a history reproduction sewing control routine is executed (refer to FIG. 10). Then, the processing may return to S22. The storage sewing control routine will be described later with reference to FIG. 9. The history reproduction sewing control routine will be described later with reference to FIG. 10.

In S22, when the sewing stop switch 22 is pressed, and then, an instruction for stopping sewing is performed (S22: YES), driving of the sewing machine motor 91 is stopped in step 31 (S31). In step 32 (S32), in when the presser foot 39 is lowered (S32: YES), the presser foot elevation pulse motor 143 is driven, and then, the presser foot 39 is lifted in step 33 (S33). When the feed dog 180 is not lowered (S34: NO), the feed dog 180 is lowered in step 35 (S35). Then, a value of the storage needle number counter "n" is stored in a total needle number "S" in step 36 (S36), and then, the processing may return to the main routine.

Figure 9:
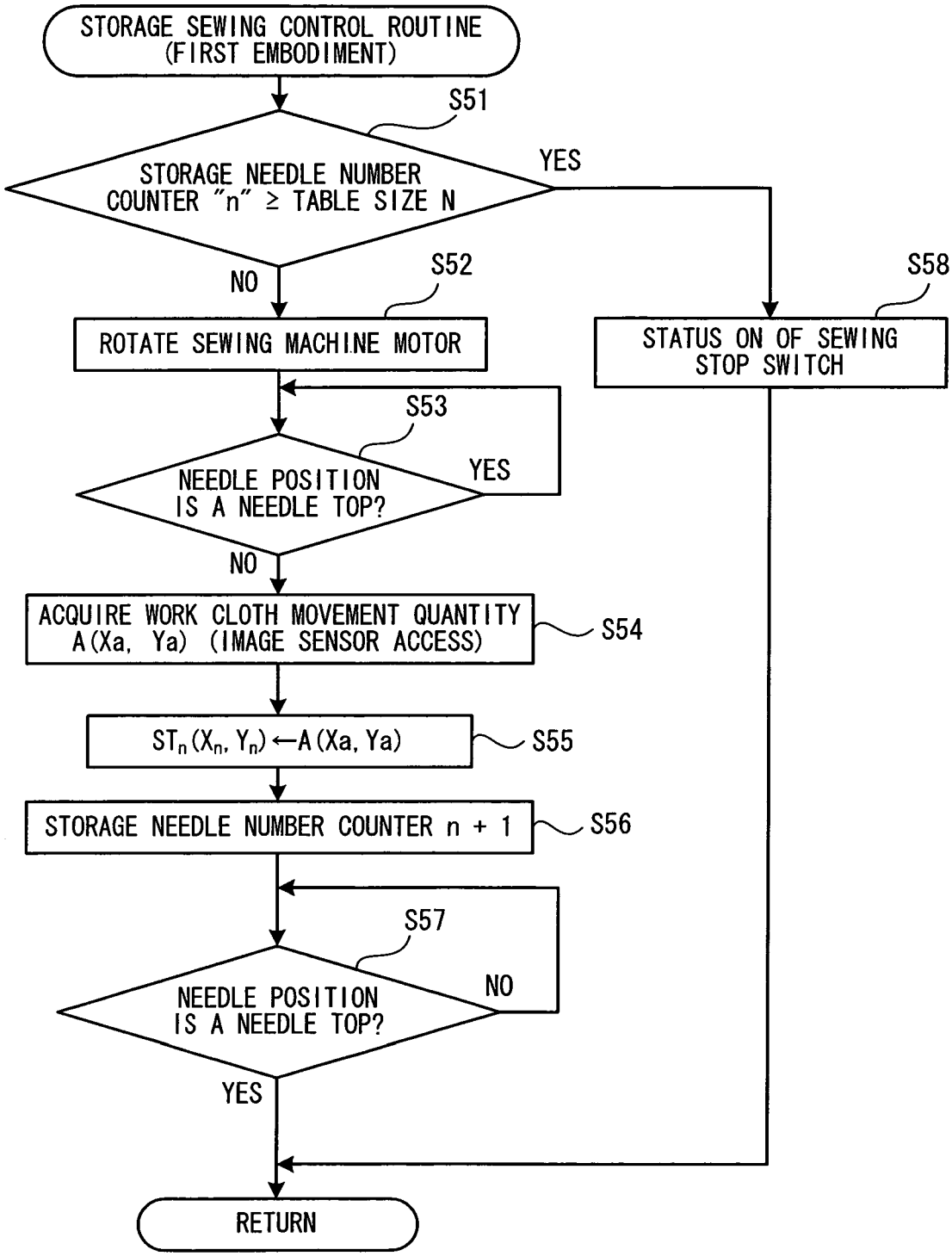
FIG. 9 is a flowchart of a recording sewing control routine performed in a sewing routine.

Now, the storage sewing control routine will be described with reference to the flowchart of FIG. 9. First, a determination is made as to whether a value of the storage needle number counter "n" is equal to or greater than a table size N of the stitch history table ST in step 51 (S51). If the value of the storage needle number counter "n" is not equal to or not greater than the table size N (S51: NO), stitch coordinate information can be stored. An instruction for driving the sewing machine motor 91 is given to a drive circuit 72 in step 52 (S52). Then, a determination is made as to whether a needle position is the top position in step 53 (S53). If it is determined that the sewing needle 7 is set to the top position by the needle top sensor 56 (S53: YES), and then, position check of the sewing needle 7 is made until the sewing needle 7 has not been set to the top position (S53: YES, S53). If the sewing needle 7 is not set to the top position (S53: NO), the sewing needle 7 pierces the work cloth, and thus, an access is provided to the image sensor 50, a movement quantity A (Xa, Ya) of the work cloth from the previous access is acquired, and then, the acquired movement quantity is stored in the work cloth movement quantity storage area 636 in step 54 (S54). Then, the acquired work cloth movement quantity A (Xa, Ya) is stored in STn of the stitch history table ST (S55). Namely, Xn=Xa, Yn=Ya is established. Then, "1" is increased to the storage needle number counter "n" in step 56 (S56).

Then, a determination is made as to whether a needle position is set to the top position in step 57 (S57). If it is determined that the sewing needle 7 is not set to the top position by the needle top sensor 56 (S57: NO), position check of the sewing needle 7 is repeatedly made until the sewing needle has been set to the top position (S57: NO, S57). Then, when the sewing needle 7 is set to the top position (S57: YES), the processing may return to the sewing routine. Then, as shown in FIG. 8, in the sewing routine, the processing may return to S22, and then, the processing operations of S22 to S25 are repeatedly performed. The processing operations of S22 to S25 are repeatedly performed, and then, stitch recording is performed. At S51 of the storage sewing control routine, when it is determined that the storage needle number counter "n" is equal to or greater than a table size N (S51: YES), stitch coordinate information cannot be stored in the stitch history table ST any more. Then, a status of the sewing stop switch 22 is set to ON in step 58 (S58). Namely, in order to forcibly stop sewing, a state is established such that the sewing stop switch 22 has been operated. Then, the processing may return to the sewing routine. In the sewing routine, the status of the sewing stop switch 22 is set to ON at S22. Therefore, it is determined that the sewing stop switch 22 has been operated (S22: YES), and then, a series of processing operations for stopping sewing are performed (S31 to S36).

Figure 10:
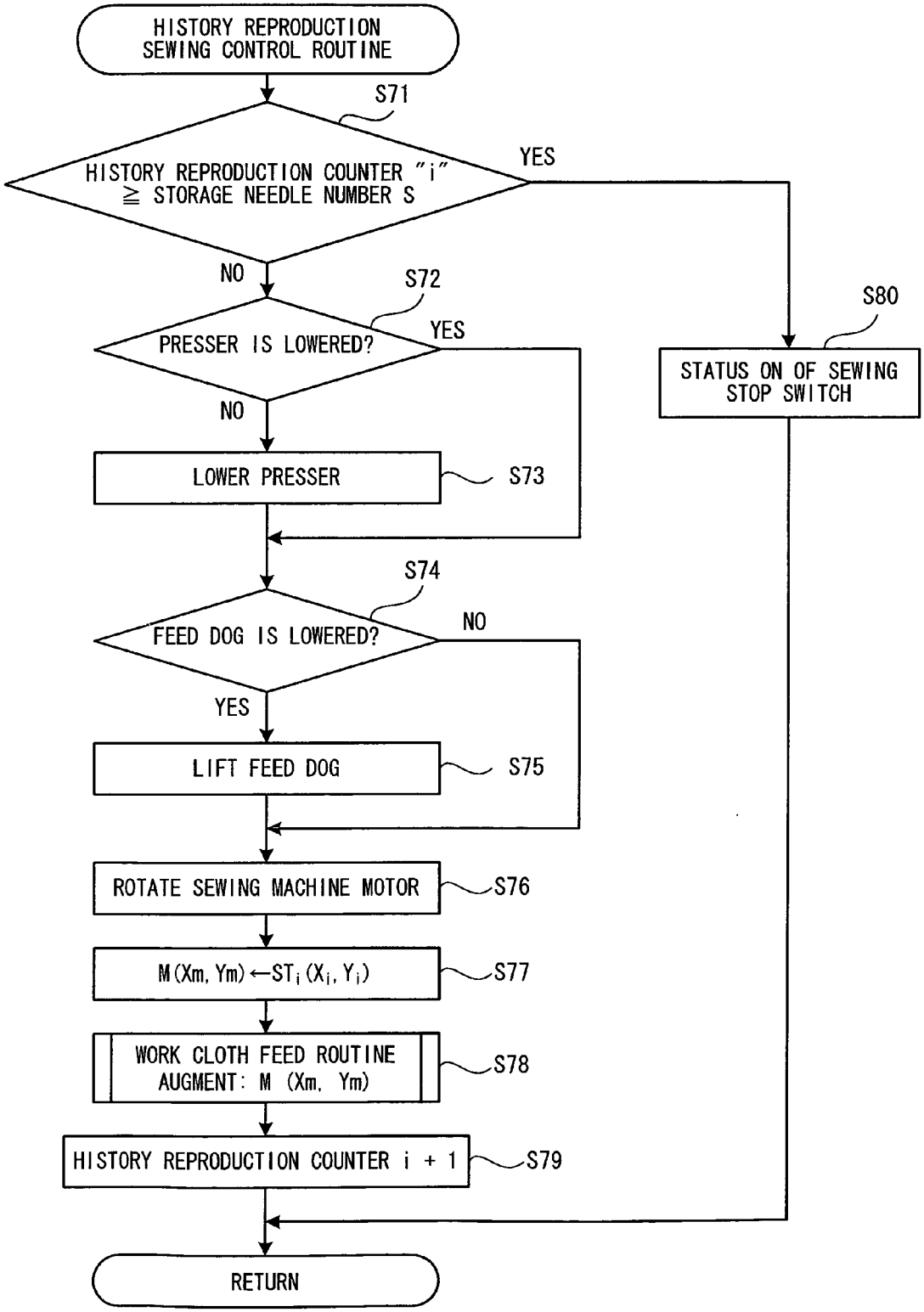
FIG. 10 is a flowchart of a history reproduction sewing control routine performed in a sewing routine.

Next, the history reproduction sewing control routine will be described with reference to the flowchart of FIG. 10. First, a determination is made as to whether a value of a reproduction needle number counter "i" is equal to or greater than a total needle number "S" in step 71 (S71). If the value of the reproduction needle number counter "i" is not equal to or greater than the total needle number "S" (S71: NO), a stitch to be reproduced still exists, and thus, preparation for sewing is performed. In step 72 (S72), when the presser foot 39 is lifted as a preparation for sewing (S72: NO), the presser foot elevation pulse motor 143 is driven, and then, the presser foot 39 is lowered in step 73 (S73). Then, in step 74 (S74), when the feed dog 180 is lowered (S74: YES), the feed dog 180 is lifted in step 75 (S75). Then, the sewing machine motor 91 is driven in step 76 (S76).

Then, a stitch history table STi (Xi, Yi) is read out, and then, the work cloth feed quantity M (Xm, Ym) is stored in the work cloth feed quantity storage area 637. Then, while the work cloth feed quantity M (Xm, Ym) is defined as an augment, in step 78 (S78) a work cloth feed routine is executed (refer to FIG. 11). In the work cloth feed routine, the feed dog 180 is moved based on a value in the stitch history table STi, whereby the work cloth is moved, and one stitch is formed. The work cloth feed routine will be described later. When the work cloth feed routine is executed, and then, a stitch is formed (S78), "1" is added to a reproduction needle number counter "i" in step 79 (S79). Then, the processing may return to the sewing routine.

As shown in FIG. 8, in the sewing routine, when the history reproduction sewing control routine terminates in step 26 (S26), the processing may return to S22, and then, the processing performs repeatedly S22, S23, S24 and S26. Then, the stitch stored in the stitch history table ST is reproduced and sewn. Then, in the history reproduction sewing control routine, when the reproduction needle number counter "i" is equal to or greater than a total needle number "S" (S71: YES), the status of the sewing stop switch 22 is set to ON in step 80 (S80). As a result, it is determined as "YES" at S22 of the sewing routine, and then, a process for stopping sewing is performed (S31 to S36). Then, the processing may return to the main routine.

Figure 11:
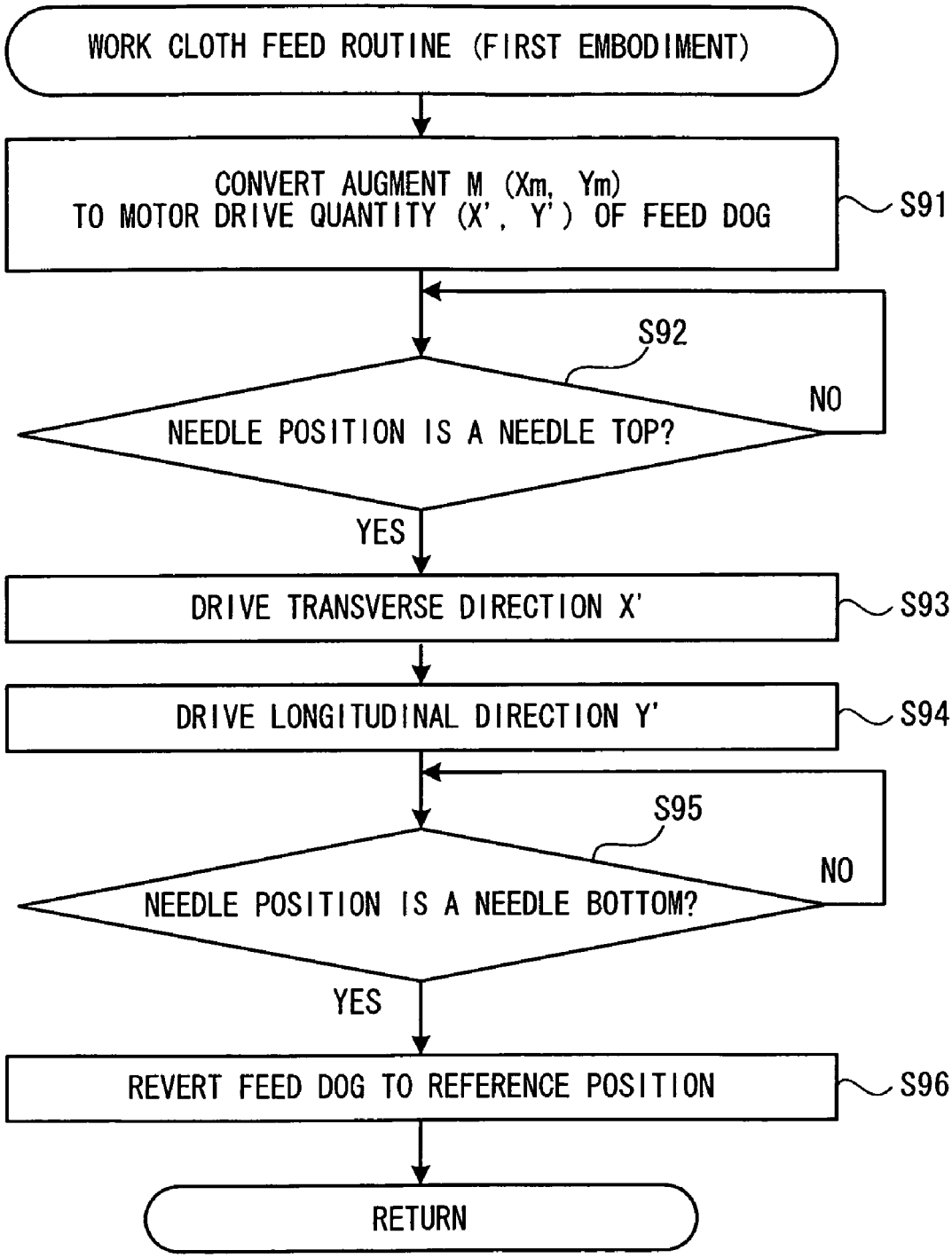
FIG. 11 is a flowchart of a work cloth feeding routine performed in a history reproduction sewing control routine.

Now, the work cloth feed routine will be described with reference to the flowchart of FIG. 11. First, an augment M (Xm, Ym) is converted into a motor drive quantity (X', Y') for moving the feed dog 180 in step 91 (S91). Specifically, Xm is converted to a drive quantity X' of the transverse movement pulse motor 401, and Ym is converted to a drive quantity Y' of the longitudinal movement pulse motor 201. Then, a determination is made as to whether a needle position of the sewing needle 7 is set to the top position, based on an output value from the needle top sensor 56 in step 92 (S92). While the needle position is not set to the top position, a determination of the needle position is repeatedly made (S92: NO, S92). Namely, one waits until the needle position is set to the top position.

When the needle position is set to the top position (S92: YES), an instruction is performed to the drive circuit 74 so that the transverse movement pulse motor 401 is driven by a drive quantity calculated at S91, and then, the feed dog 180 is moved in step 93 (S93). Then, an instruction is performed to the drive circuit 73, and then, the feed dog 180 is moved so that the longitudinal movement pulse motor 201 is driven by the drive quantity calculated at S91 in step 94 (S94). A determination is made as to whether the sewing needle 7 is set to the bottom position, based on an output value from the needle bottom sensor 57 in step 95 (S95). While the needle position is not set to the bottom position, determination of the needle position is repeatedly made (S95: NO, S95). Namely, one waits until the needle position has been set to the bottom position.

When the needle position is set to the bottom position (S95: YES), the feed dog 180 is lower than a top face of the needle plate 33. At this time, the feed dog 180 is reverted to a reference position in step 96 (S96), and the work cloth feed routine terminates. The reference position serves as an operating initial position of the feed dog 180, and is equivalent to a position at which a needle drop point of the work cloth is set to (0, 0). The feed dog 180 is reverted for drive quantity X' and drive quantity Y'. Namely, the transverse movement pulse motor 401 is driven for a drive quantity responsive to −Xm, and then, the longitudinal movement pulse motor 201 is driven for a drive quantity responsive to −Ym.

As described above, in the work cloth feed routine, one waits until the needle position is set to the top position (S92). When the position is set to the top position, and the work cloth is movable, the work cloth is moved by the feed dog 180 (S93, S94), and one waits until the needle position has been set to the bottom position (S95). By means of such an operation, a stitch with a length and a direction instructed by means of an augment M is formed.

As described above, in the first example, the image sensor 50 detects the work cloth, and a movement of direction and a movement of quantity between previous detection and current detection of the work cloth are calculated in two-dimensional coordinate data. The RAM 63 stores movement data serving as two-dimensional coordinate data that indicates the calculated movement of direction and movement quantity. The CPU 61 detects the work cloth by the image sensor 50 on a one by one needle basis of sewing relative to the work cloth, calculates movement data, and stores the calculated data in the RAM 63. The cloth feed mechanism 500 moves the work cloth, and the CPU 61 can perform sewing while driving the cloth feed mechanism 500 and moving the work cloth based on the movement data stored in the RAM 63. In addition, both a "normal mode" and a "practice mode" can be switched. In this manner, when the user requires practice, sufficient practice is made in a practice mode, and after practice, regular sewing of the work cloth can be performed. Further, an instruction for starting sewing is performed by the sewing start switch 21 in the "practice mode," and then, sewing is performed, and the coordinate information that is capable of specifying a stitch position is stored in the stitch history table ST. In this manner, movement data can be stored only when an attempt is made to record practice sewing, thus making it easy for a user to manage recording. In addition, when an instruction for starting sewing is performed by the sewing start switch 21 in a state in which stitch coordinate information is stored in the stitch history table ST, a stitch stored in the stitch history table ST is reproduced and sewn. In this manner, reproduction and sewing are performed only when a practice mode is set and a recording of practice sewing is made. Therefore, reproduction of sewing is never performed in an undesired state. When the practice mode is set, sewing is performed using a practice cloth, and then, sewing has been successfully performed, reproduction of sewing can be performed with respect to a cloth that may be intended for regular sewing. In this manner, preferred sewing can be reproduced for a cloth that may be intended for regular sewing.

Of course, the sewing machine and the sewing machine control program of the present disclosure are not limited to the first example described above, and can be changed in a variety of manners without departing from the spirit and scope of this disclosure. In the example described above, the storage needle number counter "n" for specifying arrangement of the stitch history table ST is cleared when a current mode is switched to a practice mode at S10 of a main routine. Namely, stitch recording of sewing that has been first performed after the current mode has been switched to the practice mode is stored in the stitch history table ST. Therefore, when a result obtained by sewing with a cloth for practice sewing is not preferable, the practice mode is switched to a normal mode once, whereby a practice mode may be set again. The storage needle number counter "n" may be cleared based on a user's instruction by providing a clear switch for clearing information on the stitch history table ST or providing a clear button on the liquid crystal display 15.

Next, a second example will be described with reference to FIGS. 12 to 14. A sewing machine according to the second example is provided with a function of inversion sewing in addition to a function of the sewing machine according to the first example. When an inversion switch is operated, and an instruction for inversion sewing is performed, and inversion sewing is performed while tracing a stitch stored in the stitch history table ST. The stitch formed by means of this inversion sewing is also stored in the stitch history table ST.

A physical configuration and an electrical configuration of a sewing machine 1 according to the second example are substantially identical to those of the sewing machine according to the first example. A description is given by way of reference and is omitted. In the sewing machine of the second example, an inversion switch 23 is provided in the right side of the sewing stop switch 22 (refer to FIG. 1). The inversion switch 23 serves as a switch for feeding the work cloth in a backward direction, which is opposite to a normal direction, and is connected to the input interface 65 (refer to FIG. 4). Next, a configuration of a storage area of the RAM 63 that is different from that of the first example will be described.

Figure 12:
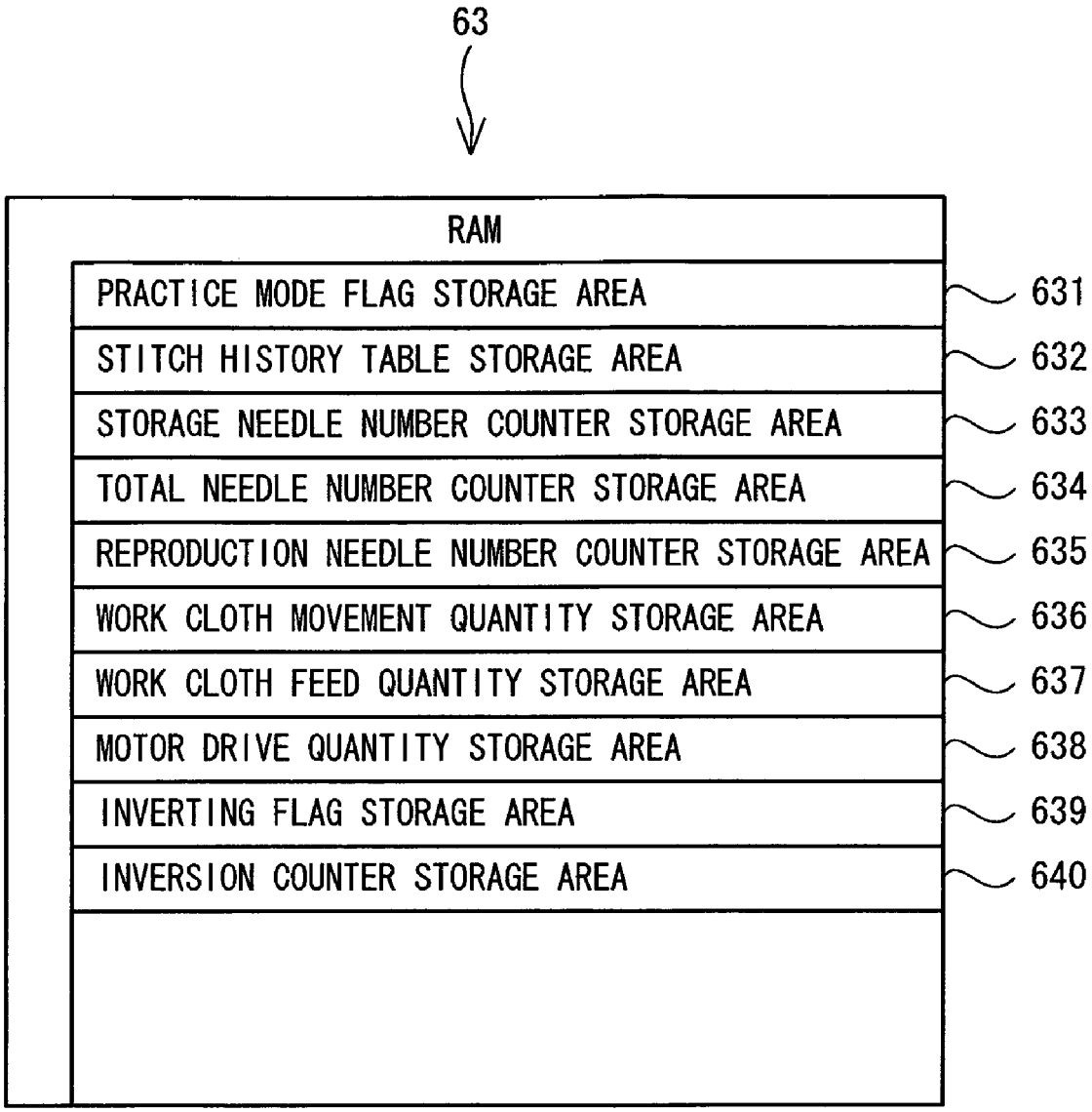
FIG. 12 is a schematic view showing a configuration of a RAM.

As shown in FIG. 12, in the RAM 63, there is provided the practice mode flag storage area 631, the stitch history table storage area 632, the storage needle number counter storage area 633, the total needle number storage area 634, the reproduction needle number counter storage area 635, the work cloth movement quantity storage area 636, the work cloth feed quantity storage area 637, the motor drive quantity storage area 638, an inverting flag storage area 639, and an inversion counter storage area 640 or the like. In the RAM 63, a variety of storage areas, which are not shown, are also provided. In the inverting flag storage area 639, when the inversion switch 23 is depressed, "1" is stored indicating that the inversion is in progress, and then, an inversion flag is set to "ON". When the inversion switch 23 is not depressed, "0" is stored indicating that inversion is not in progress, and then, the inversion flag is set to "OFF." Then, an inversion counter for subtracting an invertible needle number is stored in the inversion counter storage area 640. A description is given by way of reference and is omitted with respect to storage areas 631 to 638, which are similar to those of the first example.

Next, an operation of the sewing machine 1 according to the second example will be described with reference to the flowcharts of FIG. 13 and FIG. 14. The main routine is similar to that of the first example (refer to FIG. 7), and part of the sewing routine (refer to FIG. 8) performed in the main routine may be different from that of the first example. Therefore, the second example describes only the sewing routine. The parts that may be different from the sewing routine of the main routine are S116, S117, and S119 to S122 of FIG. 13.

Figure 13:
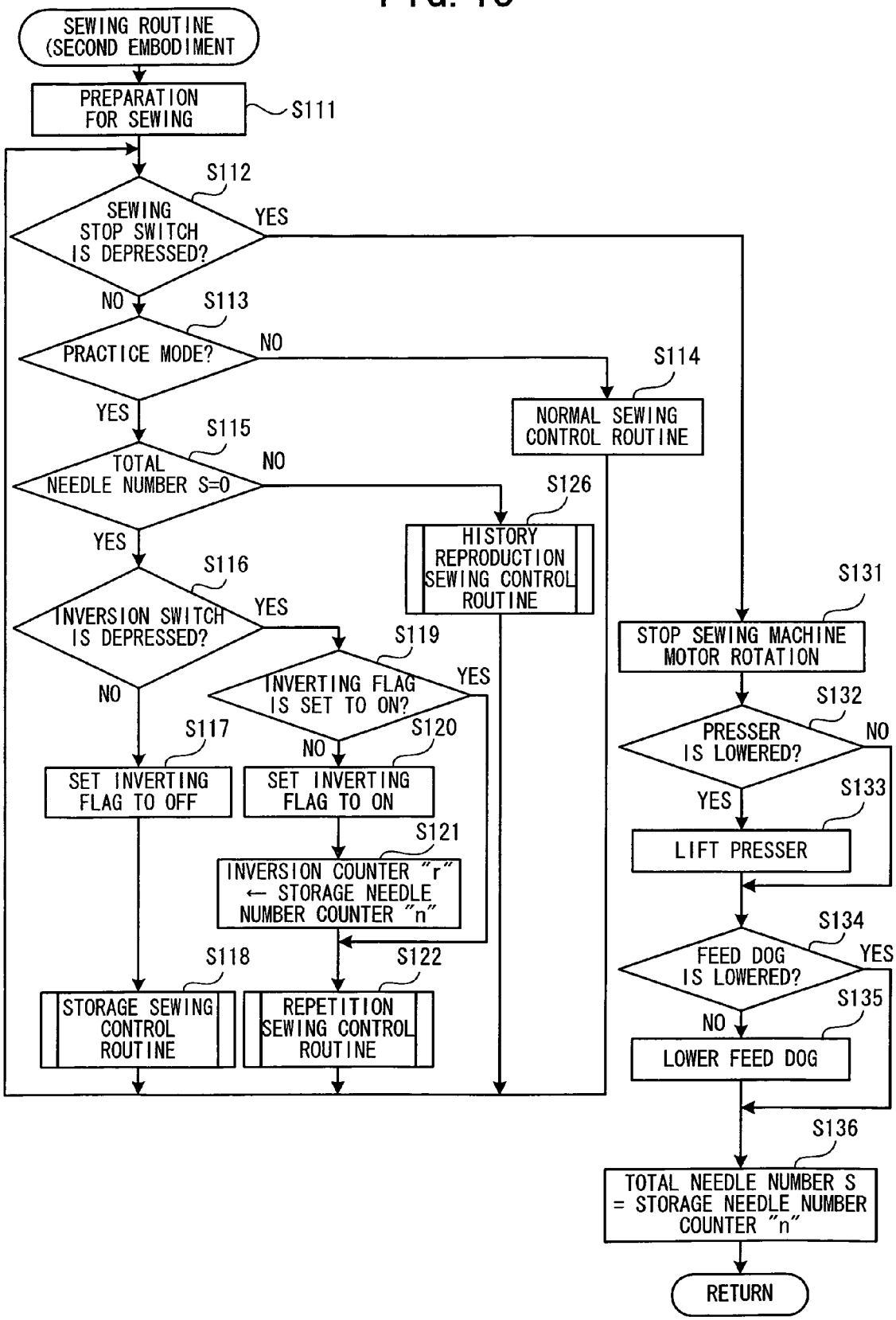
FIG. 13 is a flowchart of a sewing routine performed in a main routine.
Figure 14:
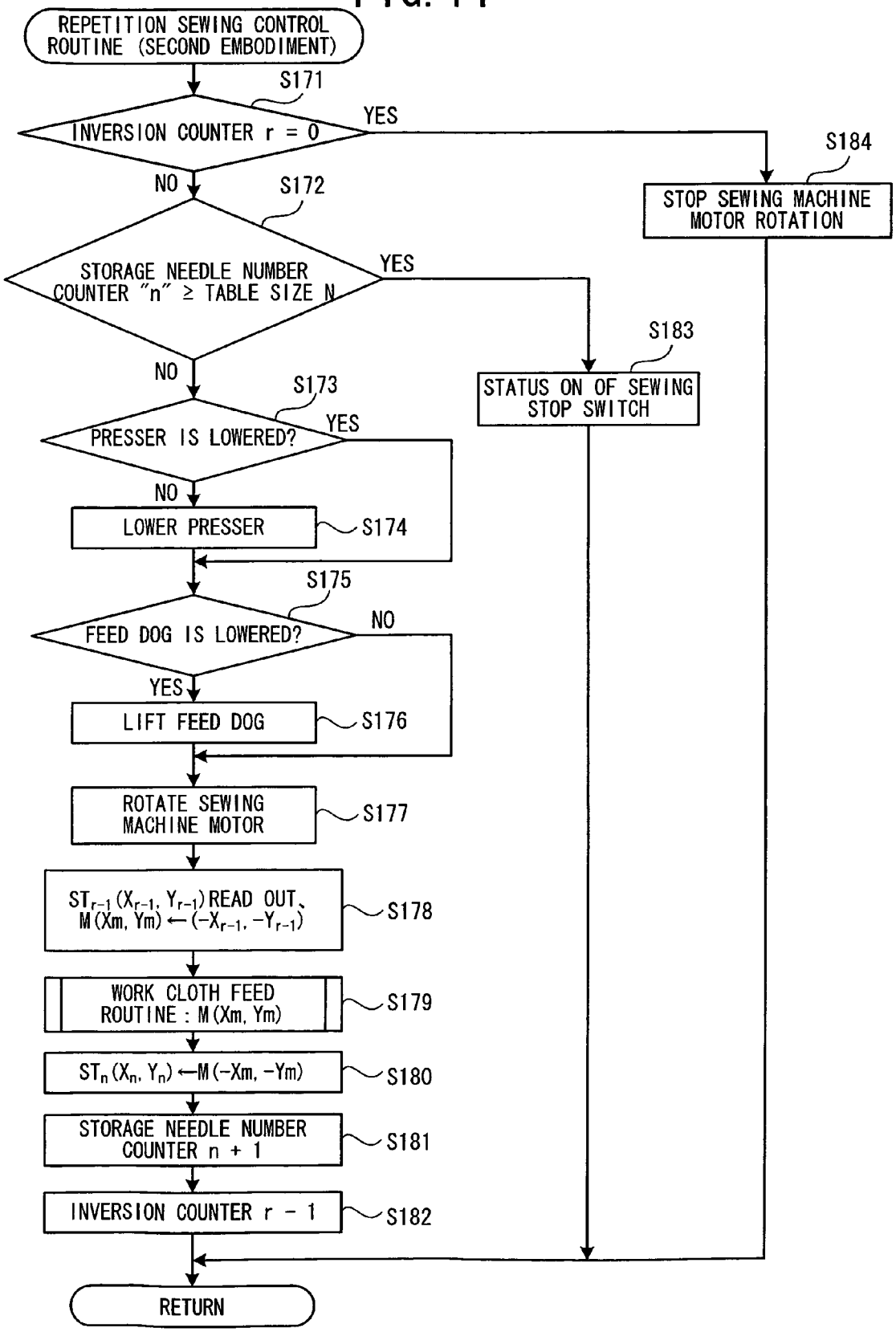
FIG. 14 is a flowchart of an inversion sewing control routine performed in a sewing routine.

As shown in FIG. 13, in the sewing routine, a preparation for sewing is performed first such as in the first example in step 111 (S111), and a determination is made as to whether the sewing stop switch 22 has been operated in step 112 (S112). If the sewing stop switch 22 has not been operated (S112: NO), a determination is made as to whether a "practice mode" is currently set in step 113 (S113). When a normal mode is set (S113: NO), the sewing machine motor 91 is driven, and normal sewing operation is performed in step 114 (S114). Then, the processing may return to S112, and the processing operations of S112, S113, and S114 are repeatedly performed until the sewing stop switch 22 is operated (S112: YES).

On the other hand, when the practice mode is set (S113: YES), a stitch history is stored in the stitch history table ST in accordance with whether a total needle number S is set to "0," and a determination is made as to whether recording is performed in step 115 (S115). If the total needle number S is set to "0," a stitch is not recorded yet (S115: YES), and a process for recording a stitch is performed. Then, the inversion switch 23 is depressed, and a determination is made as to whether an instruction for inversion sewing is performed in step 116 (S116). If the inversion switch 23 is not depressed (S116: NO), sewing is performed in normal direction, and thus, an inverting flag is set to OFF in step 117 (S17), and then, the storage sewing control routine is executed in step 118 (S118, refer to FIG. 9). Then, the processing may return to S111.

In addition, when the inversion switch 23 is depressed (S116: YES), the inversion sewing is performed while tracing a stitch stored in the stitch history table ST. First, a determination is made as to whether an inverting flag is set to ON (S119). When the inverting flag is set to OFF instead of being set to ON (S119: NO), the inverting flag is set to ON (S120). Then, a value of the storage needle number counter "n" is stored in an inversion counter "r" (S121). Namely, a value indicating arrangement of the stitch history table ST stored last, is stored in the inversion counter "r." Then, in step 122 (S122) the inversion sewing control routine is executed (refer to FIG. 14).

Now, the inversion sewing control routine will be described with reference to the flowchart of FIG. 14. First, a determination is made as to whether the inversion counter "r" is set to "0" in step 171 (S171). If the inversion counter "r" is not set to "0" (S171: NO), a stitch is still remaining to be traced. Therefore, a determination is made as to whether a value of the storage needle number counter "n" is equal to or greater than a table size N of the stitch history table ST in step 172 (S172). If a value of the storage needle number counter "n" is not equal to or greater than a table size N (S172: NO), stitch coordinate information can be stored. Therefore, a preparation for sewing is performed. In step 173 (S173), when the presser foot 39 is not lowered as preparation for sewing (S173: NO), the presser foot elevation pulse motor 143 is driven, and then, the presser foot 39 is lowered in step 174 (S174). In the step 175 (S175), when the feed dog 180 is lowered (S175: YES), the feed dog 180 is lifted in step 176 (S176). Then, an instruction for rotating the sewing machine motor 91 is performed to the drive circuit 72 in step (S177).

Next, the stitch history table $ST_{r-1}$ is read out, and an inverted number serving as a number with changed signs of $X_{r-1}$ and $Y_{r-1}$ is defined as the work cloth feed quantity M (Xm, Ym), and then, is stored in the work cloth movement quantity storage area 636 in step 178 (S178). Namely, $Xm=-X_{r-1}$, $Ym=-Y_{r-1}$, are established. Then, in step 179 (S179), while the work cloth feed quantity M is defined as an augment, the work cloth feed routine is executed (refer to FIG. 11). When the work cloth feed routine is executed, and then, a stitch is formed, information on the stitch is stored in the stitch history table ST in step 180 (S180). Namely, Xm (Xm, Ym)=($-X_{r-1}$, $-Y_{r-1}$) is stored in STn (Xn, Yn). Then, "1" is increased in the storage needle number counter "n" in step 181 (S181), and then, "1" is decreased from the inversion counter "r" in step 182 (S182). Then, the processing may return to the sewing routine.

Then, when depressing of the inversion switch 23 is continued, the sewing stop switch 22 is not depressed in the sewing routine (S112: NO), practice mode is in progress (S113: YES), a total needle number S is not set to "0" (S115: NO), and it is determined that the inversion switch 23 is depressed (S116). Then, the inversion flag has been already set to ON (S119: YES), and thus, the inversion sewing control routine is executed as it is (S122, refer to FIG. 14). Then, if the processing operations of S112, S113, S115, S116, S119, and S122 are repeatedly performed, and then, the inversion counter "r" is set to "0" in the inversion sewing control routine (S171: YES), all the stitches are traced, and no more stitching is provided, and thus, rotation of the sewing machine motor 91 is stopped in step 184 (S184), and the processing may return to the sewing routine. In addition, if the processing operations of S112, S113, S115, S116, S119, and S112 are repeatedly performed, and then, the storage needle number counter "n" is equal to or greater than a table size N in the inversion sewing control routine (S172: YES), the stitch coordinate information cannot be stored in the stitch history table ST any more. Then, the status of the sewing stop switch 22 is set to ON in step 183 (S183), and the processing may return to the sewing routine.

As described above, in the second example and in the first example, if a practice mode is set, sewing is performed using a practice cloth, and then, sewing has been successfully performed, reproduction of sewing can be performed with respect to a cloth for regular sewing. In this manner, preferred sewing can be reproduced on a cloth for regular sewing. Further, in the second example, when the inversion switch 23 has been operated, a reverse stitch can be formed on a stitch that has already been formed while tracing a stitch stored in the stitch history table ST. Although it is difficult to perform sewing while shifting a top of stitch that has been already sewn by means of inversion sewing, and a high level skill is required, even if reverse sewing is thereby performed, a top of a stitch may be automatically sewn based on movement data. Thus, a beautiful sewing result can be obtained without causing an inversion stitch to depart from a stitch that has been already formed.

Next, a third example will be described with reference to FIGS. 15 to 27. A sewing machine according to the third example may be provided with a stitch editing function of editing a stitch stored in the stitch history table ST in addition to a function of the sewing machine according to the first example. A physical configuration of the sewing machine 1 according to the third example may be similar to that of the first example, and an electrical configuration thereof may be substantially similar to that of the sewing machine 1 according to the first example. A description is given by way of reference and is omitted here. Here, a description will be given with respect to only a storage area provided in the RAM 63 that may be different from that of the first example.

Figure 15:
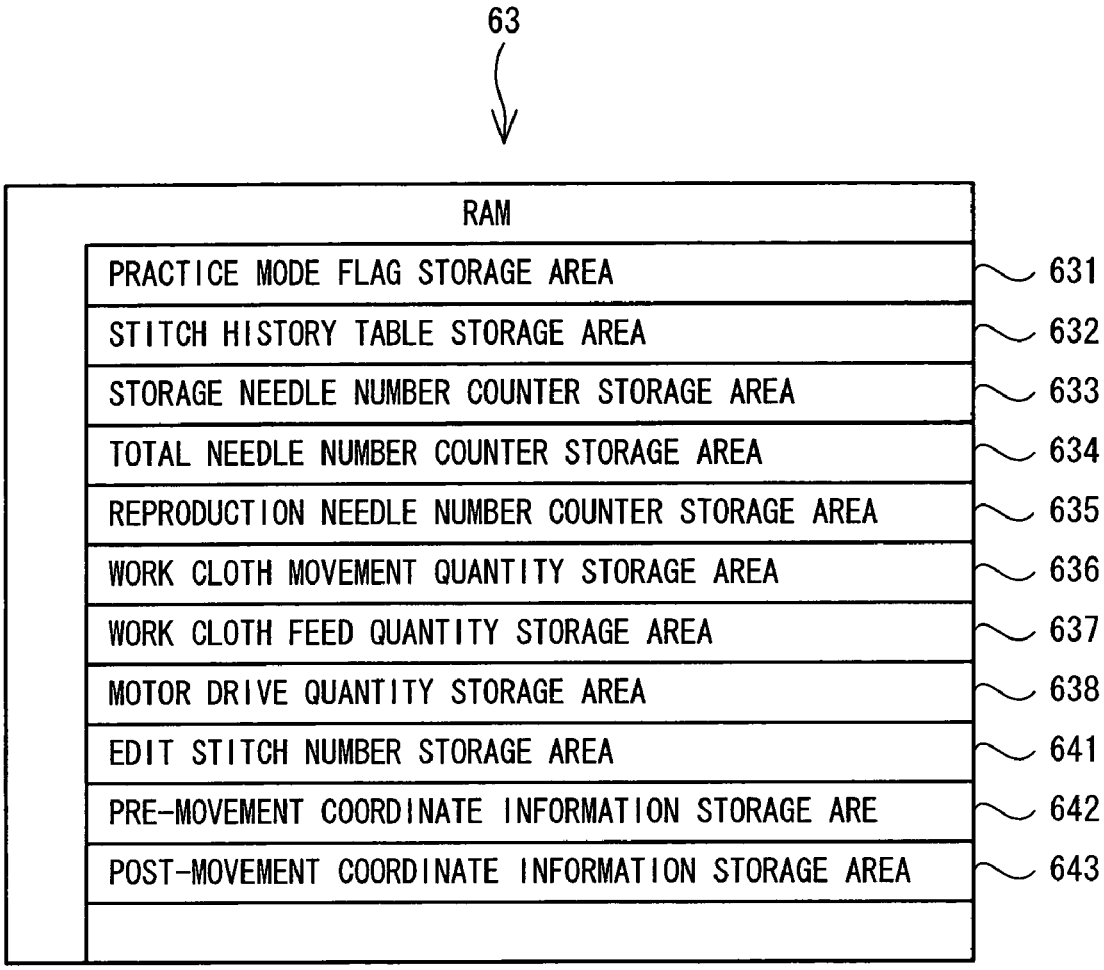
FIG. 15 is a schematic view showing a configuration of a RAM.

As shown in FIG. 15, in the RAM 63, there is provided: the practice mode flag storage area 631, the stitch history table storage area 632, the storage needle number counter storage area 633, the total needle number storage area 634, the reproduction needle number counter storage area 635, the work cloth movement quantity storage area 636, the work cloth feed quantity storage area 637, the motor drive quantity storage area 638, an editing stitch number storage area 641, a pre-movement coordinate information storage area 642, and a post-movement coordinate information storage area 643, or the like. A variety of storage areas, which is not shown, are also provided in the RAM 63. A number of arrangements storing a stitch to be edited in the stitch history table ST are stored in the editing stitch number storage area 641. Coordinate information of a stitch that was moved before moving a stitch is stored in the pre-movement coordinate information storage area 642. Coordinate information of a stitch that is moved after moving a stitch is stored in the post-movement coordinate information storage area 643. A description is given by way of reference and is omitted with respect to storage areas 631 to 638 as in the first example.

Next, an operation of editing a stitch will be described with reference to FIGS. 16 to 22.

First, an editing screen 100 will be described with reference to FIG. 16. The editing screen 100 is displayed in the place of a menu screen (not shown) when an "edit" button is selected in the menu screen that is generally displayed on the liquid crystal display 15. As described above, the touch panel 26 is provided on the liquid crystal display 15, and an input to the sewing machine 1 is performed by means of a user's touch relative to the touch panel 26.

Figure 16:
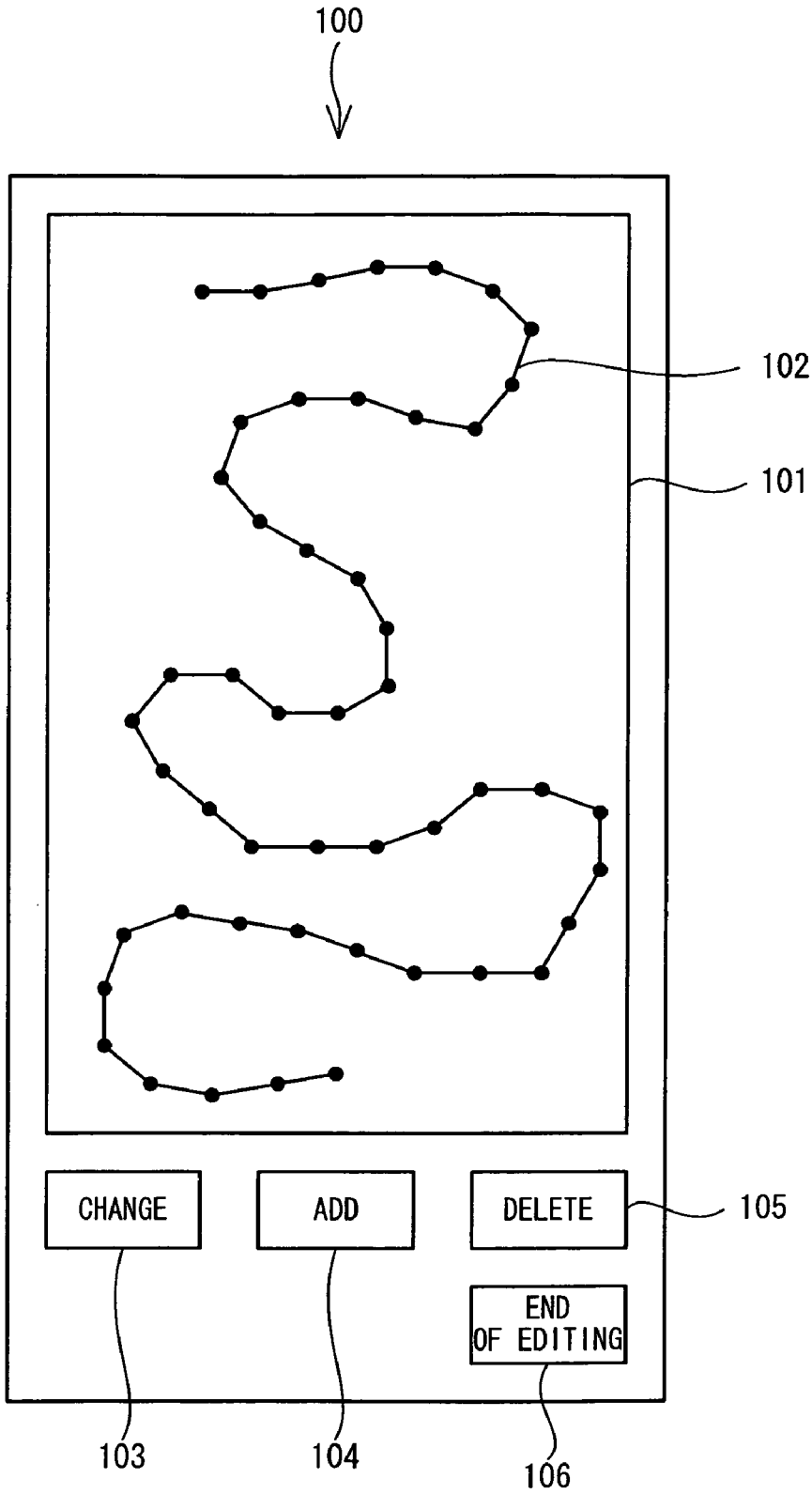
FIG. 16 is a schematic view showing an editing screen displayed on a liquid crystal display when an editing instruction is performed.

As shown in FIG. 16, a change button 103, an add button 104, a delete button 105, and an editing end button 106 are provided at the lower part of the editing screen 100. In addition, a stitch display area 101 is provided at the upper part of the buttons of the editing screen 100. In addition, a stitch image 102 indicating a stitch recorded in the stitch history table ST is displayed in the stitch display area 101. In the third example, as shown in FIG. 16, it is assumed that a stitch may be represented as a line in the stitch image 102 and that a needle drop point serving as an end point of a stitch may be represented by a dot (circular sign). In the stitch images shown in FIGS. 17 to 21, an arrow is imparted to a line of a stitch so as to identify a sewing advancing direction. A start point of the arrow serves as a start point of a stitch, and an end point serves as an end point of a stitch.

Figure 17:
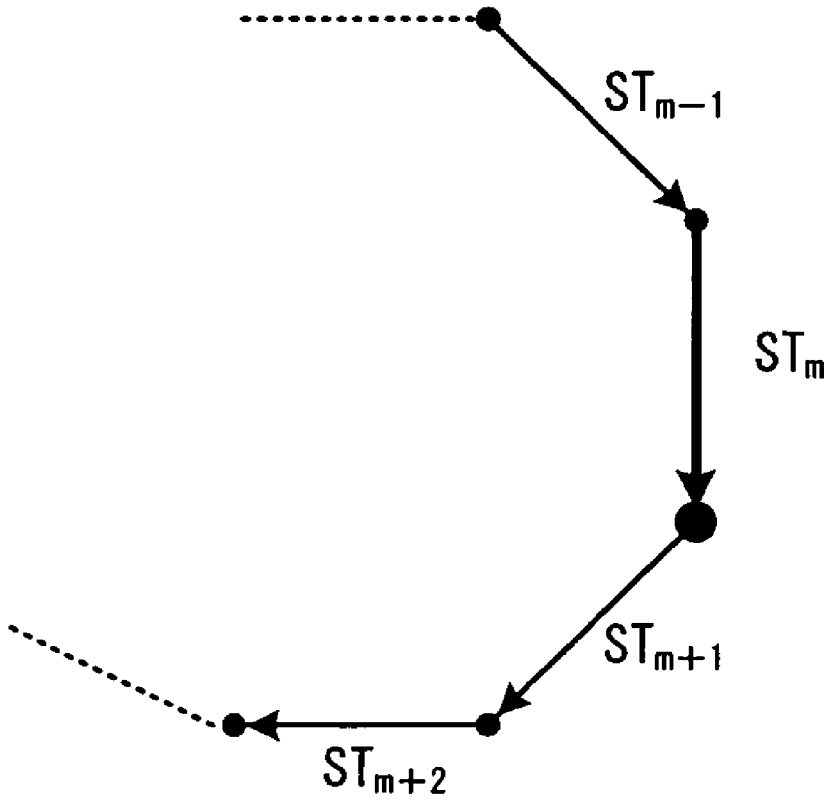
FIG. 17 is a schematic view showing a stitch image showing part of a stitch passage before edited.
Figure 18:
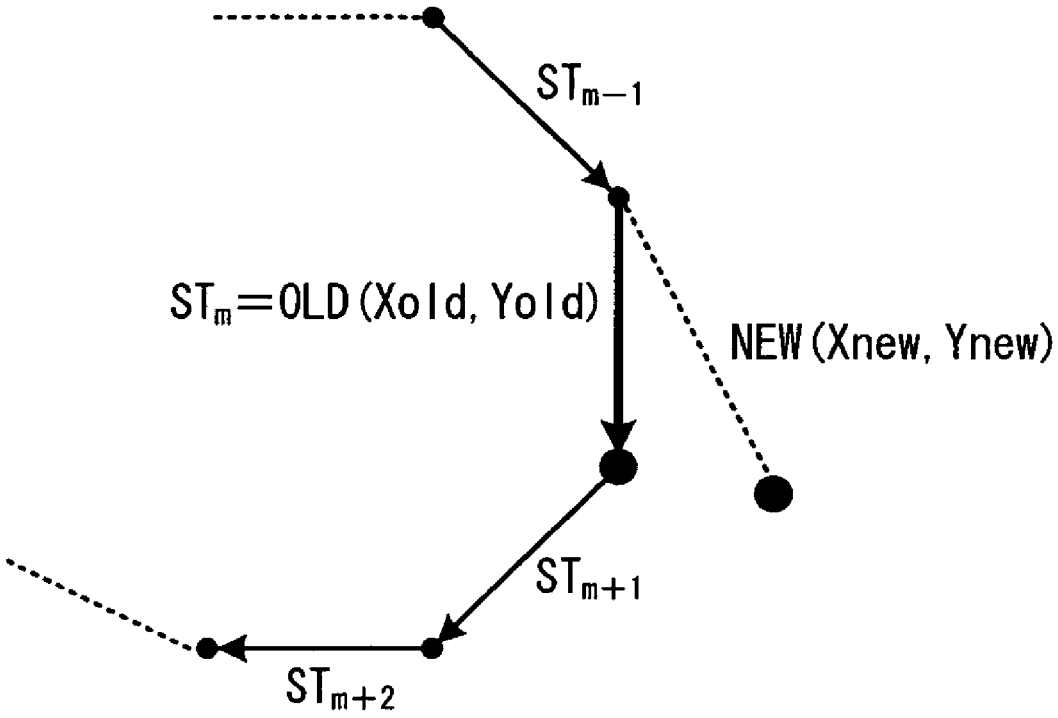
FIG. 18 is a schematic view showing a stitch image showing part of a stitch passage in a state in which an end point of a stitch is specified.
Figure 19:
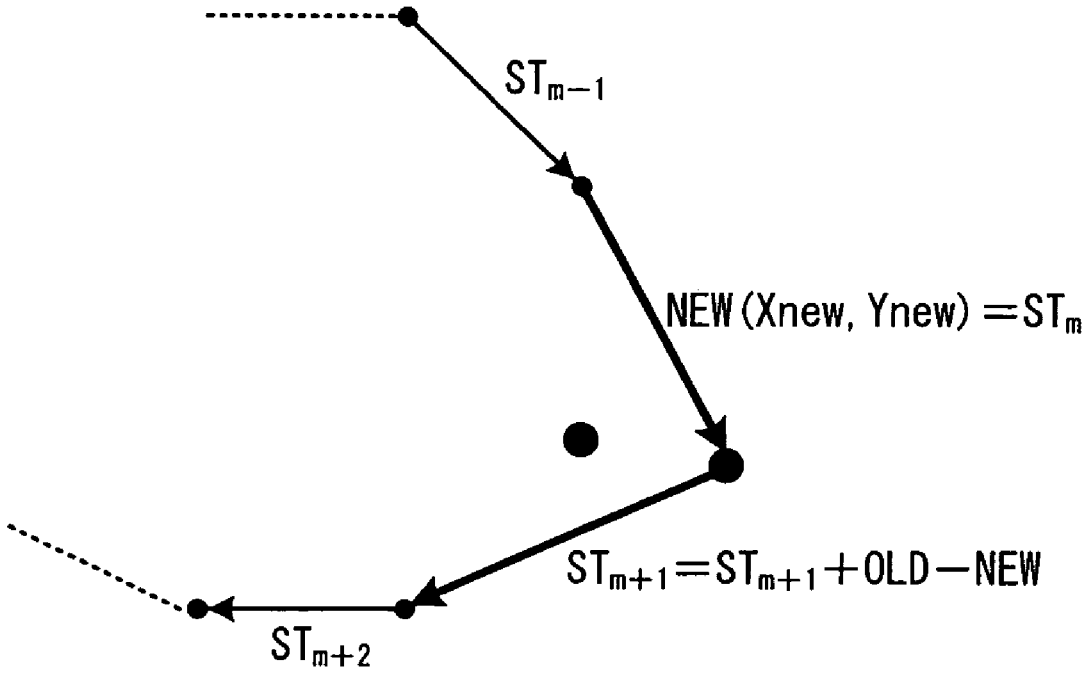
FIG. 19 is a schematic view showing a stitch image showing part of a stitch passage in which a needle drop point is moved.

Next, a change of a stitch will be described with reference to FIGS. 17 to 19. First, a user selects a stitch to be changed. This stitch selection is made by the user touching a position corresponding to the stitch display area 101 of the touch panel 26 disposed on a top face of the liquid crystal display 15. Then, a line indicating a selected stitch is thickened, and a circular sign indicating an end point of the stitch is greater than that indicating another needle drop point. In the example shown in FIG. 17, four stitches are displayed, each of which is stored in a stitch history tables STm−1 to STm+2. Among the four stitches, a second stitch (STm) is selected as a stitch to be changed. Then, the user selects the change button 103. Then, the user specifies a position to be a move destination of an end point of a stitch by touching the touch panel 26 in an area corresponding to the stitch display area 101 (refer to FIG. 18). Then, the selected needle drop point is moved to the specified move destination position.

Figure 20:
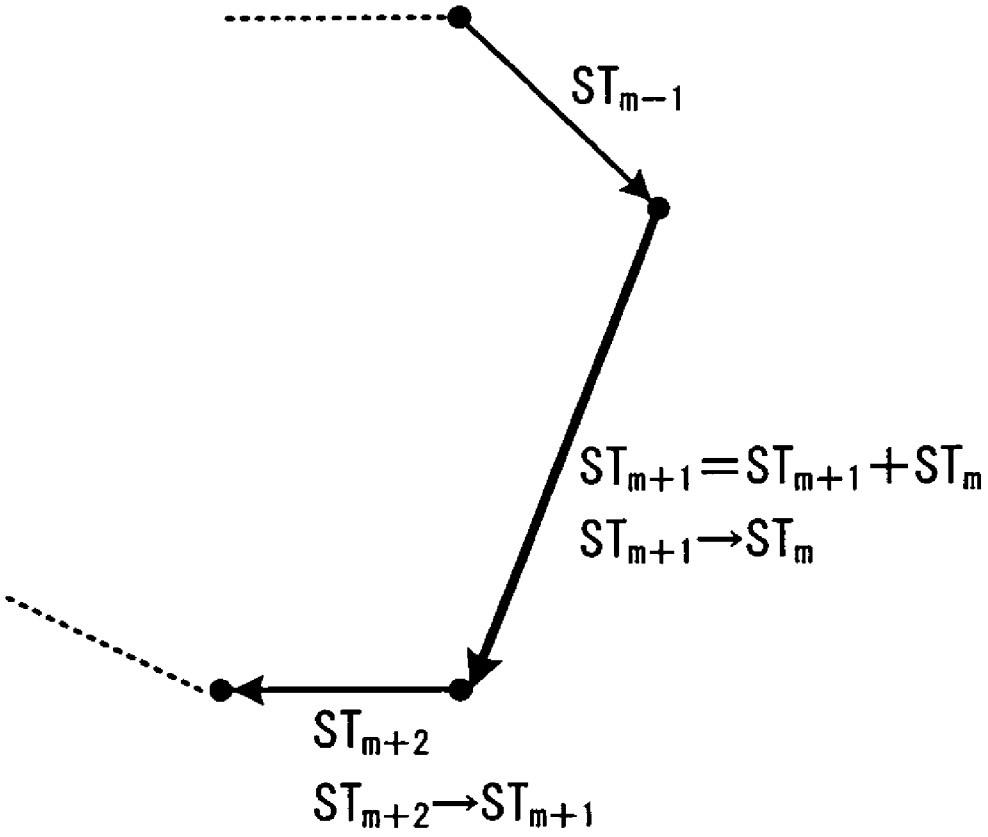
FIG. 20 is a schematic view showing a stitch image showing part of a stitch passage in which a needle drop point is deleted.
Figure 21:
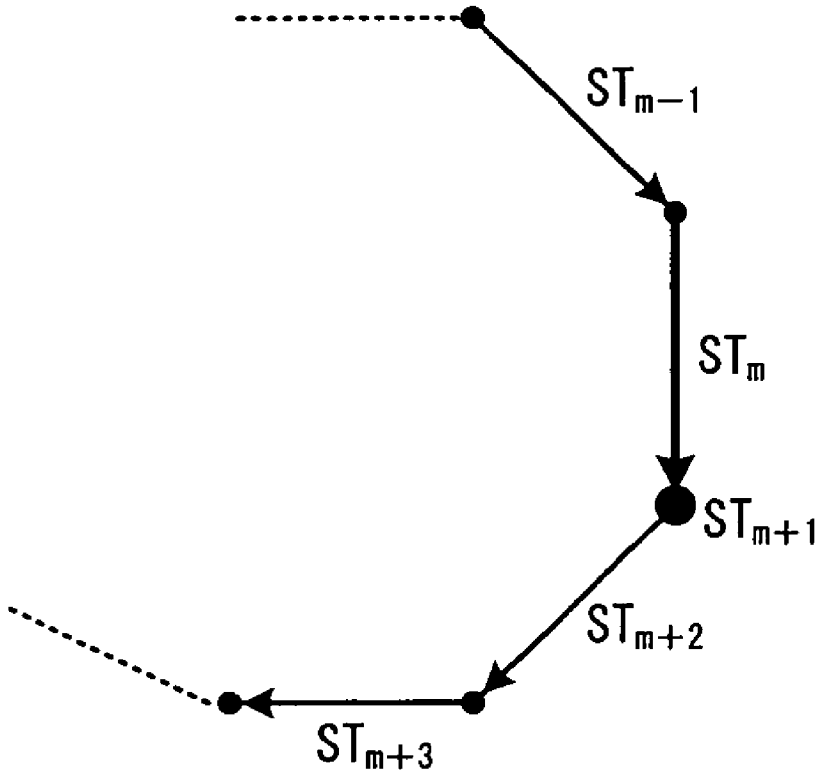
FIG. 21 is a schematic view showing a stitch image showing part of a stitch passage in which a needle drop point is added.
Figure 22:
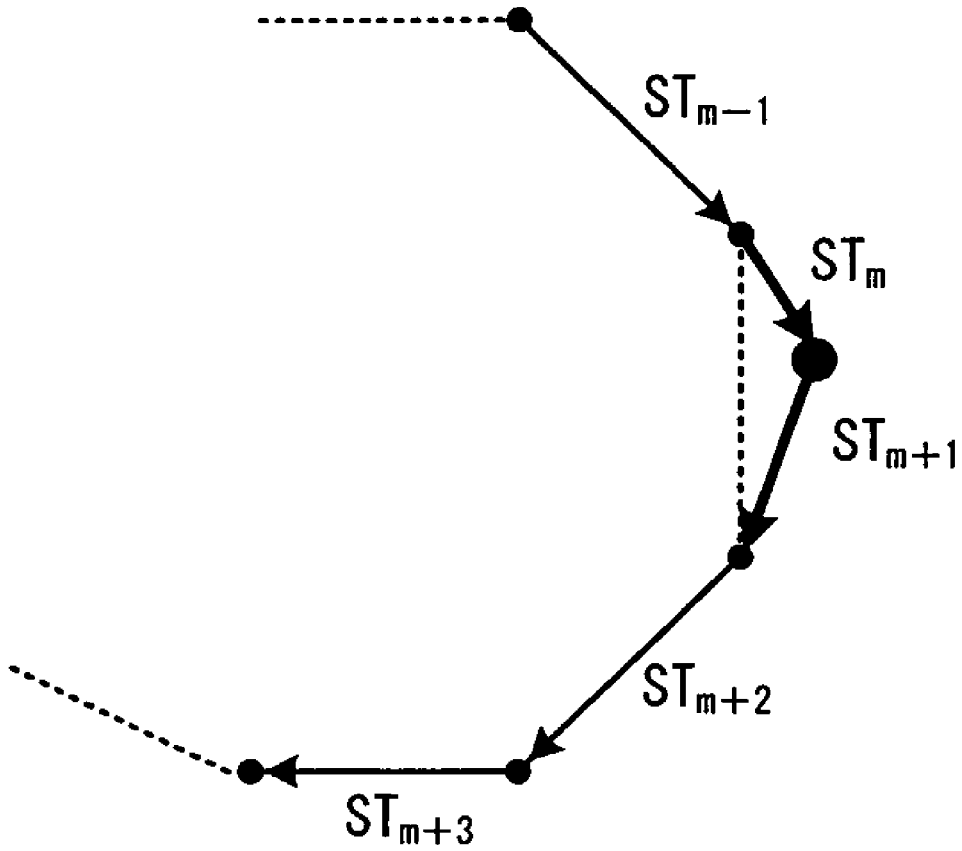
FIG. 22 is a schematic view showing a stitch image showing part of a stitch passage in which an added needle drop point is moved.

Next, a stitch deletion will be described with reference to FIG. 16, FIG. 17, and FIG. 20. When deleting a stitch or changing a stitch, the user first selects a stitch to be deleted. Here, it is assumed that a stitch indicating arrangement of STm shown in FIG. 17 has been selected. Then, the user selects the delete button 105. Then, as shown in FIG. 20, an m-th stitch is deleted, and a line connecting an end point of an m−1-th stitch and an end point of an m+1-th stitch is defined as an m-th stitch. Then, an m+2 stitch is defined as an m+1 stitch. An m+3 stitch and subsequent stitch are rounded up in stitch numbers on one by one basis.

A stitch addition will be described with reference to FIG. 16, FIG. 17, FIG. 21, and FIG. 22. First, the user selects a stitch of a position at which a stitch is to be added. Here, it is assumed that a stitch indicated by the arrangement of STm shown in FIG. 17 has been selected. Then, the user selects the add button 104. Then, a stitch of a length "0" is created as an m+1-th stitch at an end point of the selected stitch (refer to FIG. 21). Namely, an end point of an m-th stitch serves as a start point of the m+1-th stitch, an end point of the m+1-th stitch, and a start point of an m+2 stitch. Then, if the m-th stitch is "changed," a stitch with a length is obtained. Namely, it is sufficient that the user selects STm, selects a change button 103, and then, specifies a move destination of an end point of a stitch (refer to FIG. 22).

Next, an operation of the sewing machine 1 according to the third example will be described with reference to the flowcharts of FIGS. 23 to 24. The sewing routine performed in the main routine may be similar to that of the first example (refer to FIG. 8). A description is given by way of reference, and is omitted. In the main routine, the present example may be different from the first example in terms of S303, S308, and S309.

Figure 23:
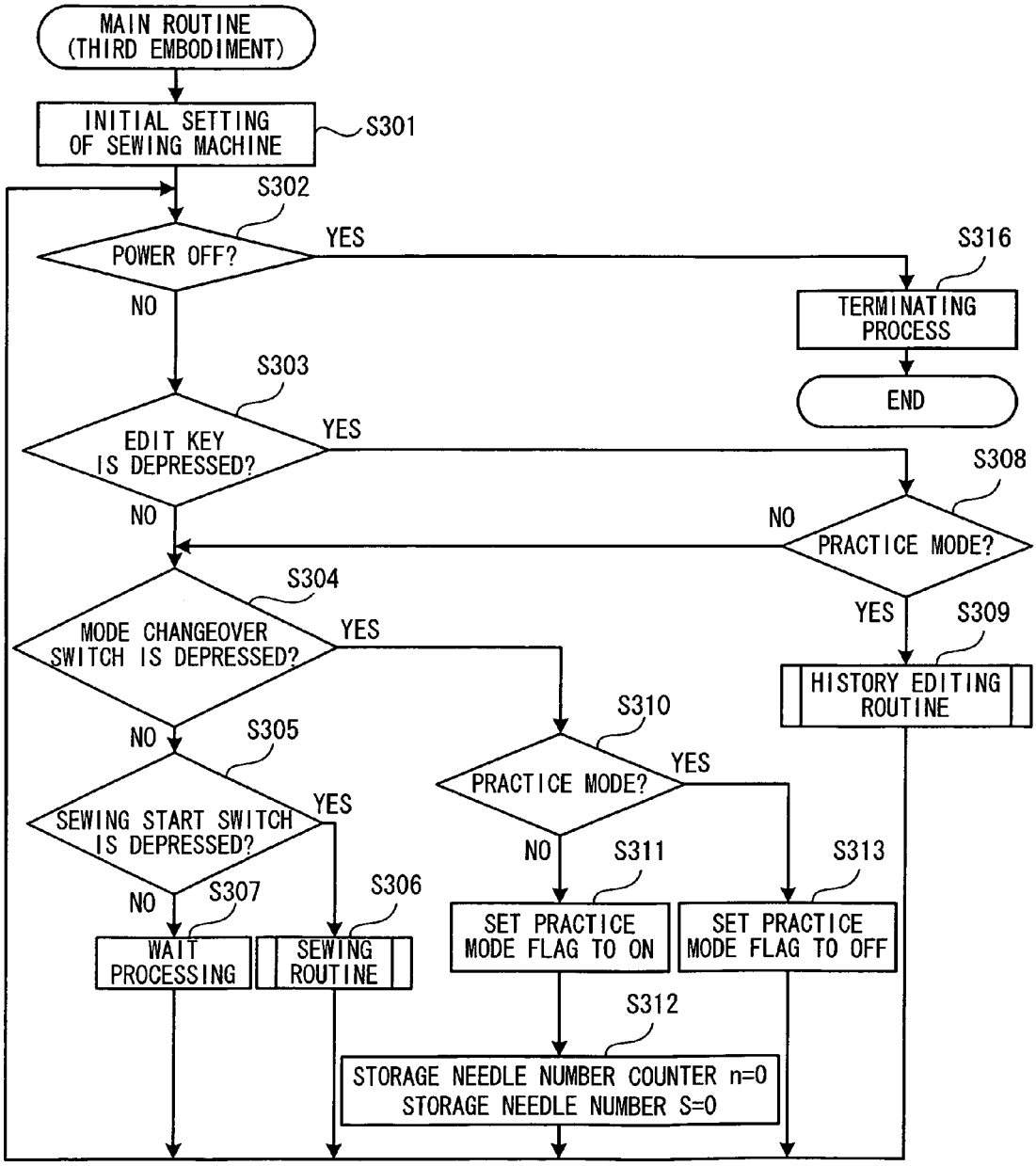
FIG. 23 is a flowchart of a main routine according to a third example.
Figure 24:
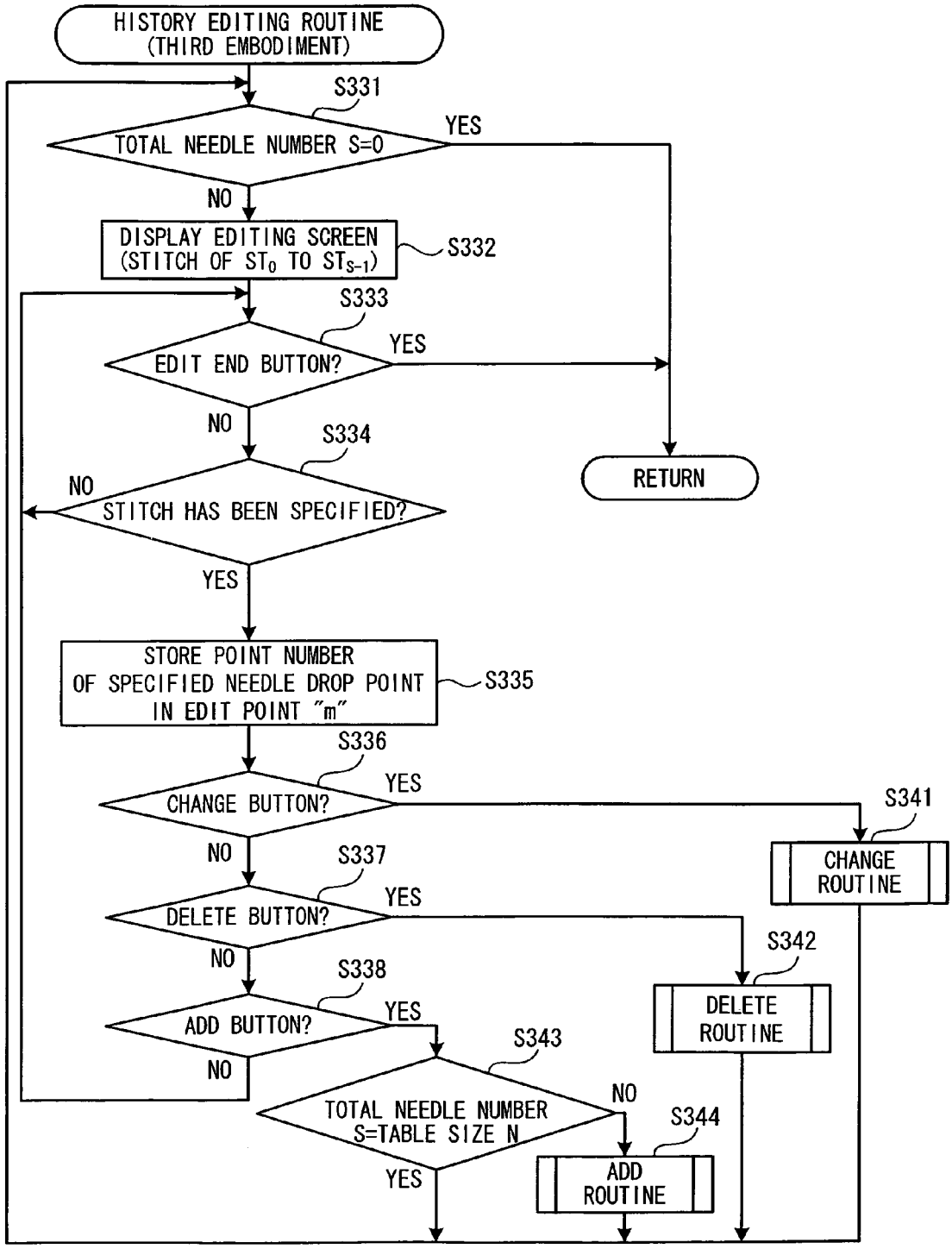
FIG. 24 is a history editing routine performed in a main routine according to the third example.

As shown in FIG. 23, in the main routine, as in the first example, first, initial setting of the sewing machine is performed in step 301 (S301). If in step 302 (S302), an instruction for turning power OFF is not performed (S302: NO), an edit button is selected, and then, a determination is made as to whether an instruction for editing a stitch has been performed in step 303 (S303). If an editing instruction has not been performed (S303: NO), operation of the mode changeover switch 59 is performed, and then, a determination is made as to whether an instruction for switching a practice mode and a normal mode has been performed in step 304 (S304). If the mode changeover switch 59 has been operated (S304: YES), in step 310 (S310), when the "practice mode" is set (S310: YES), the practice mode flag is set to OFF, and the "normal mode" is set in step 313 (S313). When the "normal mode" is set (S310: NO), the practice mode flag is set to ON, the "practice mode" is set in step 311 (S311), and then, the storage needle number counter "n" and a total needle number S are set to an initial value "0" in step 312 (S312). Then, the processing may return to S302.

In addition, when the mode changeover switch 59 has not been operated (S304: NO), a determination is made as to whether the sewing start switch 21 has been operated in step 305 (S305). If operation of the sewing start switch 21 has not been made (S305: NO), one waits for a predetermined time in step 307 (S307), and the processing may return to S302. In addition, when the sewing start switch 21 is operated, and then, an instruction for starting sewing is performed (S305: YES), the sewing routine is executed in step 306 (S306) (refer to FIG. 8). When the sewing routine has terminated, the processing may return to S302. When the power switch 58 is operated, and then, an instruction for turning power OFF is performed at S302 (S302: Yes), a terminating process is performed in step 316 (S316), the main routine is terminated, and then, the sewing machine 1 is powered OFF.

In addition, when an editing button has been selected at S303 (S303: YES), first, a determination is made as to whether the practice mode is set in step 308 (S308). If the practice mode is not set (S308: NO), history of a stitch to be edited is not stored in the stitch history table ST, and thus, the processing proceeds to S304 without executing anything. In addition, if the practice mode is set (S308: YES), a history editing routine is executed in step 309 (S309) (refer to FIG. 24). Then, the processing may return to S302.

Now, the history editing routine will be described with reference to the flowchart of FIGS. 24 to 27. Here, a process is performed in response to an instruction for editing a stitch stored in the stitch history table ST. First, a determination is made as to whether a total needle number S is set to "0" in step 331 (S331). When the total needle number S is set to "0" (S331: YES), the coordinate information on a stitch is not stored in the stitch history table ST, and thus, a stitch to be edited does not exist. Therefore, the history editing routine is terminated, and the processing may return to the main routine.

If the total needle number S is not set to "0" (S331: NO), a stitch to be edited exists, and thus, the editing screen 100 is displayed in step 332 (S332). Stitches of ST0 to STS−1, namely, all of the stitches stored in the stitch history table ST are displayed in an editing area of the editing screen 100. Then, a determination is made as to whether the editing end button 106 has been selected in step 333 (S333). In the touch panel 26, if a touch is detected at a position corresponding to the editing end button 106, it is assumed that the editing end button 106 has been selected (S333: YES), and then, the processing may return to the main routine.

In addition, if the editing end button 106 has not been selected (S333: NO), a determination is made as to whether a stitch displayed in the stitch display area 101 has been selected in step 334 (S334). In the touch panel 26, if a touch has been detected at a position corresponding to the stitch image 102 displayed in the stitch display area 101, it is assumed that a stitch has been selected (S334: YES), and then, a stitch number selected to be edited (hereinafter, referred to as an "edit stitch") is stored in the editing stitch number storage area 641 in step 335 (S335). Here, a line of an edit stitch displayed in the stitch display area 101 is displayed thickly, and then, a process is performed for largely displaying a point indicating a start point of the edit stitch.

Then, a determination is made as to whether a change button 103 has been selected in step 336 (S336). When the change button 103 is selected (S336: YES), a change routine is executed in step 341 (S341) (refer to FIG. 25). Then, the processing may return to S331. In addition, if the change button 103 is not selected (S336: NO), and then, in step 337 (S337), the delete button 105 has been selected (S337: YES), the delete routine is executed in step 342 (S342) (refer to FIG. 26). Then, the processing may return to S331. In addition, if the delete button 105 is not operated (S337: NO), and then, in step 338 (S338), the add button 104 is selected (S338: YES), a determination is made as to whether a total needle number S is equal to a table size in step 343 (S343). If the total needle number S is equal to a table size N (S343: YES), a stitch cannot be stored any more, and thus, the processing may return to S331 as it is. If the total needle number S is not equal to the table size (S343: NO), a stitch can be added, and thus, an add routine is executed in step 344 (S344) (refer to FIG. 27). Then, the processing may return to S331.

In S331, a determination is made as to whether the total needle number S is set to "0" (S331). When the total needle number S is set to "0" (S331: YES), it is assumed that all of the stitches have been deleted. Thus, the history editing routine is terminated, and the processing may return to the main routine. If the total needle number S is not set to "0" (S331: NO), the editing screen 100 is displayed (S332). Here, the stitch image 102 of the stitch history table ST is displayed in the stitch display area 101 after being changed (S341), after being edited (S342), after being added (S343), or after being edited. Then, if the edit end button 106 is selected (S333: YES), the history editing routine is terminated, and the processing may return to the main routine. In addition, when none of the change button 103, delete button 105, and add button 104 has been selected (S336: NO, S337: NO, S338: NO), the processing may return to S333.

As described above, the processing operations of S331 to S338, S341, S342, and S343 are repeatedly performed until the edit end button 106 has been selected (S333: YES), and a stitch stored in the stitch history table ST is edited.

Figure 25:
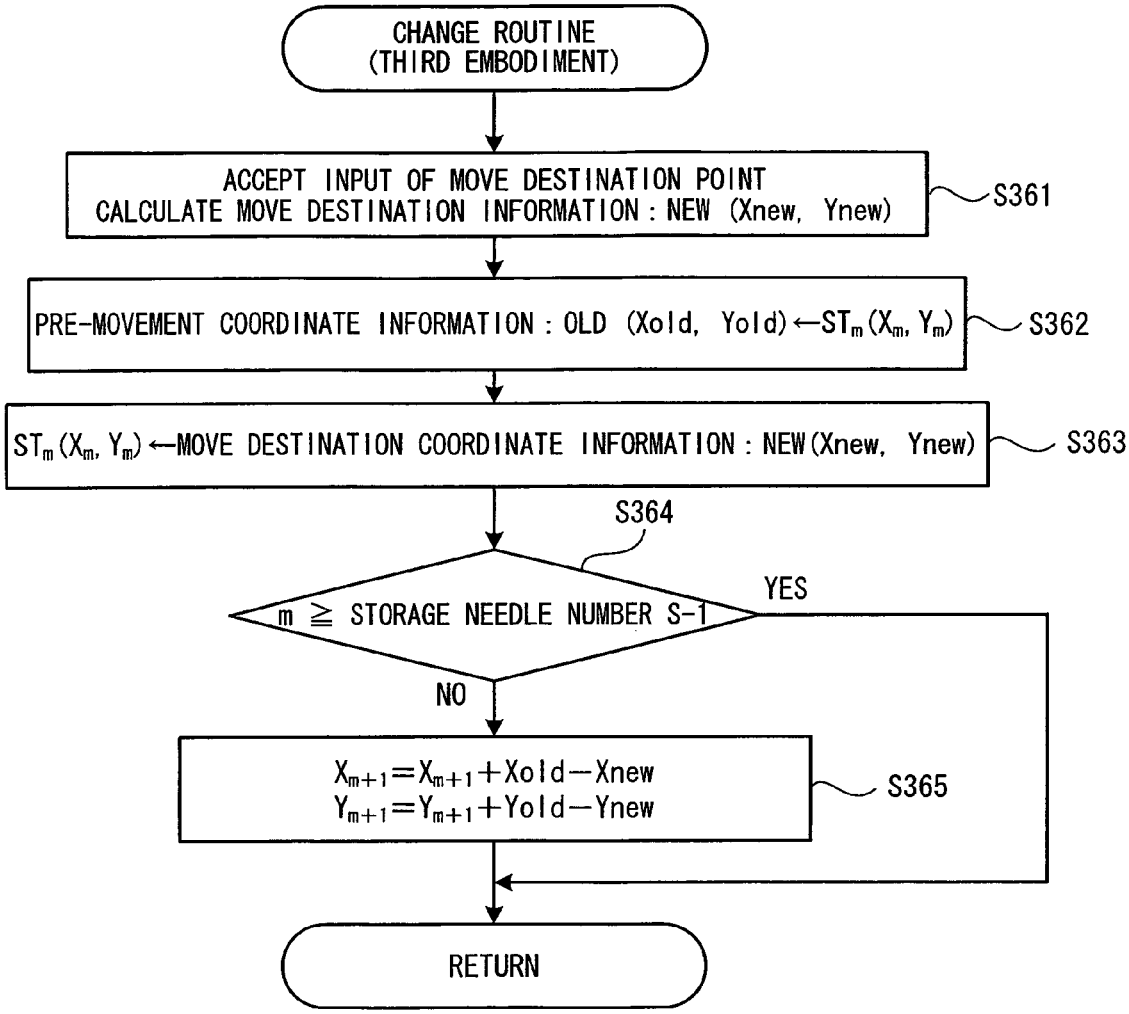
FIG. 25 is a flowchart of a change routine performed in a history editing routine.

Now, a change routine will be described in detail with reference to FIG. 25. In the change routine, first, input of a position serving as a move destination of an end point of a stitch is accepted from the touch panel 26, a change rate Xnew of the X coordinate and a change rate Ynew of the Y coordinate from a start point to an end point of a stitch are calculated, and then, NEW (Xnew, Ynew) is stored in the post-movement coordinate information storage area 643 in step 361 (S361) (refer to FIG. 18). Then, coordinate information STm (Xm, Ym) of an m-th stitch serving as an editing stitch is stored as OLD (Xold, Yold) in the pre-movement coordinate information storage area 642 (S362) (refer to FIG. 18). Then, NEW (Xnew, Ynew) is stored in STm (Xm, Ym) in step 363 (S363) (refer to FIG. 19). Then, a determination is made as to whether "m" is equal to or greater than a total needle number S−1 in step 364 (S364). When "m" is equal to or greater than the total needle number S−1 (S364: YES), an editing stitch serves as a last stitch. Thus, a start point of a next stitch changes, and there is no need for changing coordinate information STm+1. Therefore, the change routine is terminated, and then, the processing may return to the history editing routine.

If "m" is not equal to or not greater than the total needle number S−1 (S364: NO), a start point of a next stitch changes, and thus, there is a need for changing STm+1 coordinate information. New STm+1 (Xm+1, Ym+1) is calculated in step 365 (S365) (refer to FIG. 19). Specifically, Xold is added to Xm+1, and then, Xnew is subtracted, whereby new STm+1 is calculated. Further, Yold is added to Ym+1, and Ynew is subtracted, whereby new STm+1 is calculated. Then, the change routine is terminated, and the processing may return to the history editing routine.

As described above, in the change routine, input of a move destination of an end point of the edit stitch is accepted, coordinate information STm is changed, an end point of the edit stitch is moved, and a start point of a next stitch is moved. Then, coordinate information STm+1 is calculated from a new start point so that an end point of a next stitch is set at its original position.

Figure 26:
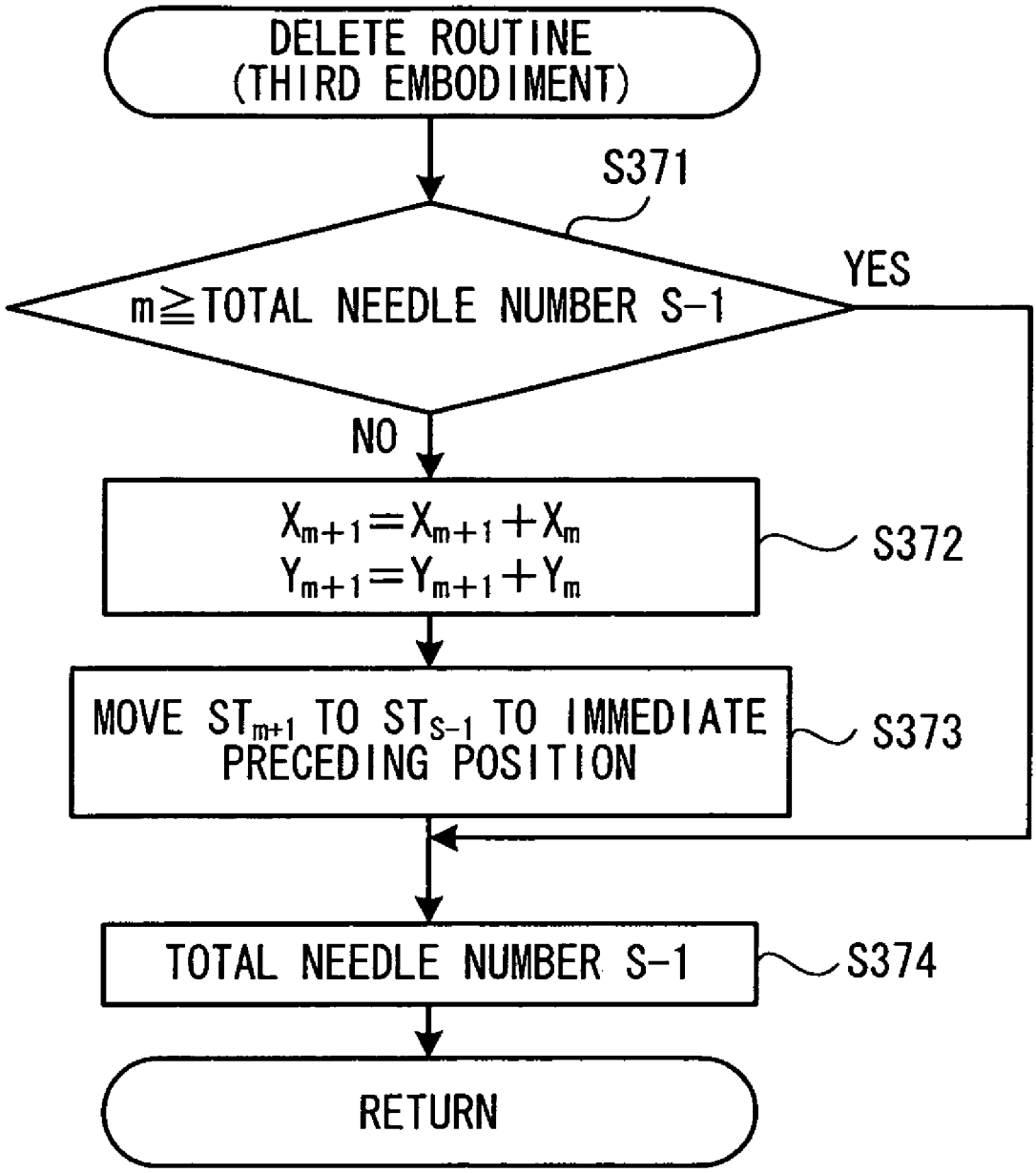
FIG. 26 is a flowchart of a deletion routine performed in a history editing routine.

Next, a delete routine will be described in detail with reference to FIG. 26. In the delete routine, first, a determination is made as to whether "m" is equal to or greater than a total needle number S−1 in step 371 (S371). When "m" is equal to or greater than the total needle number S−1 (S371: YES), a last stitch is selected as the edit stitch, and thus, "1" is subtracted from the total needle number S in step 374 (S374). In this manner, an m-th stitch is processed assuming that the stitch does not exist. Then, the delete routine is terminated, and then, the processing may return to the history editing routine.

In addition, when "m" is not equal to or not greater than the total needle number S−1 (S371: NO), an m-th stitch is deleted, and thus, a start point of an m+1 stitch serves as the end of an m−1-th stitch. Therefore, new STm+1 (Xm+1, Ym+1) is calculated in step 372 (S372) (refer to FIG. 20). Specifically, Xm is added to Xm+1, and Ym is added to Ym+1. Then, arrangement from STm+1 to STS−1 is moved to an immediately preceding arrangement, and then, is shifted up for one in step 373 (S373). Namely, STm+1 coordinate information is stored in STm, STm+2 coordinate information is stored in STm+1, and STS−1 coordinate information is stored in STS−2. Then, "1" is subtracted from a total needle number S(S374). Then, the delete routine is terminated, and the processing may return to the history editing routine. As described above, in the delete routine, an m-th edit stitch is deleted, and a line segment connecting an m−1-th end point and an m+1-th start point is defined as a new stitch.

Figure 27:
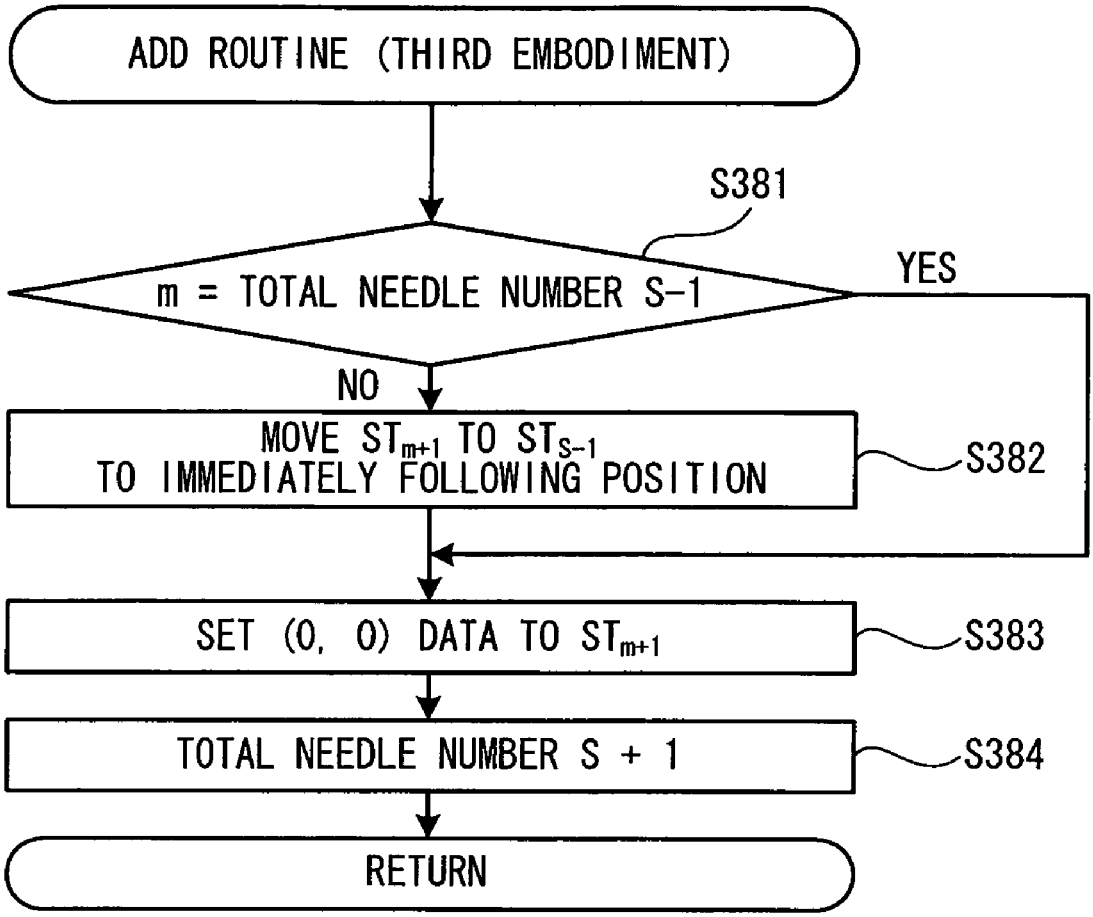
FIG. 27 is a flowchart of an addition routine performed in a history editing routine.

Next, the add routine will be described in detail with reference to FIG. 27. In the add routine, first, a determination is made as to whether "m" is equal to a total needle number S−1 in step 381 (S381). When "m" is not equal to the total needle number S−1 (S381: NO), a stitch is added to a next stitch of an m-th stitch, and thus, arrangement from STm+1 to STS−1 is moved to an immediately following arrangement, and then, is shifted down by one in step 382 (S382). Namely, STm+1 coordinate information is stored in STm+2, Stm+2 coordinate information is stored in STm+3, and STS−1 coordinate information is stored in STS. Then, with respect to the added stitch, STm+1 is defined to be (0, 0) as a stitch of a length "0" in step 383 (S383). Then, one stitch increases, and thus, "1" is added to the total needle number S in step 384 (S384), the add routine is terminated, and the processing may return to the history editing routine.

On the other hand, when "m" is equal to the total needle number S−1 (S371: YES), a last stitch is selected as the edit stitch, and thus, a stitch is added to the last. Therefore, STm+1 is defined to be (0, 0) (S383), "1" is added to the total needle number S (S384), the add routine is terminated, and then, the processing may return to the history editing routine. As described above, in the add routine, one stitch of a length "0" is added to a next stitch of the edit stitch.

In the third example described above as well, as in the first example, a practice mode is set, sewing is performed using a cloth for practice sewing, and, when sewing has been successfully performed, reproduction of sewing can be performed with respect to a cloth for regular sewing. In this manner, preferred sewing can be reproduced for the cloth for regular sewing. Further, in the third example, a stitch stored in the stitch history table ST can be changed, so that, even if stitch formed by the user is not satisfactory, the stitch can be modified, and thus, a beautiful stitch can be formed in regular sewing. In this manner, practice sewing may not be performed until a preferred sewing result has been obtained, and thus, burden of the user is reduced.

In addition, while the foregoing third example has described basic editing contents "change", "deletion", and "addition", a variety of edit menus may be created while these basic edits are combined with each other, of course. For example, a stitch length (pitches) may be made uniform. An average of lengths of a selected stitch is calculated, and "change" may be made so that a length of the selected stitch becomes an average value. In addition, a user inputs a desired trajectory (line), and may "change" it so as to be close to that line. For example, a selected stitch or group of stitches may be rotated. In this example, a coordinate of an end point of the selected stitch may be calculated and moved. In addition, in "addition," instead of adding a stitch without a length, a predetermined point on the edit stitch (for example, a mid point) is defined as an end point of the edit stitch or a start point of an added stitch, so that an original end point of the edit stitch may be defined as an end point of the added stitch.

Next, a fourth example will be described with reference to FIGS. 28 to 30. A sewing machine according to the fourth example may be provided with a function of applying fluctuation to a stitch stored in the stitch history table ST in addition to the function of the sewing machine according to the third example. A physical configuration of the sewing machine 1 according to the fourth example may be identical to that of the first example, and an electrical configuration thereof may be substantially identical to that of the sewing machine 1 according to the first example. Thus, a description is given by way of reference and is omitted. Here, a description will be given with respect to only a configuration of storage areas provided in the RAM 63 that may be different from that of the first example.

Figure 28:
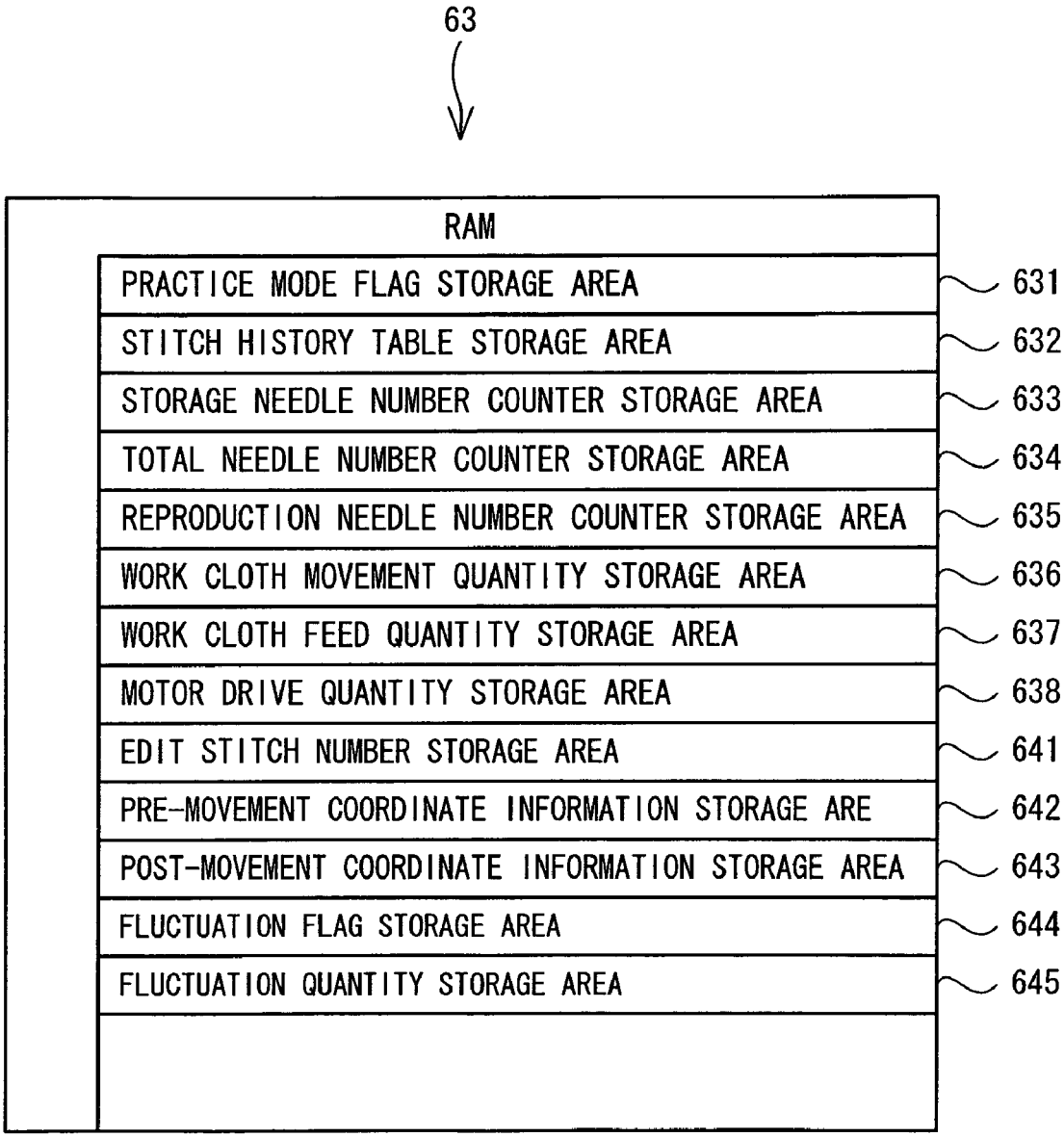
FIG. 28 is a schematic view showing a configuration of a RAM.

As shown in FIG. 28, in the RAM 63, there is provided: the practice mode flag storage area 631, the stitch history table storage area 632, the storage needle number counter storage area 633, the total needle number storage area 634, the reproduction needle number counter storage area 635, the work cloth movement quantity storage area 636, the work cloth feed quantity storage area 637, a motor movement quantity storage area 638, the edit stitch number storage area 641, the pre-movement coordinate information storage area 642, the post-movement coordinate information storage area 643, a fluctuation flag storage area 644, and a fluctuation quantity storage area 645 or the like. A variety of storage areas, which are not shown, are also provided in the RAM 63.

A value indicative of whether an automatic fluctuation mode is set is stored in the fluctuation flag storage area 644. Specifically, when "1" is stored, a fluctuation flag is set to "ON", indicating that the automatic fluctuation mode is set. When "0" is stored, the fluctuation flag is set to "OFF", indicating that the automatic fluctuation mode is not set. The automatic fluctuation mode flag is switched by selecting (depressing) an automatic fluctuation mode button provided on the menu screen (not shown). Then, a stitch fluctuation quantity is stored in the fluctuation quantity storage area 645. A description is given by way of reference and omitted with respect to storage areas 631 to 638 similar to those of the first example and storage areas 641 to 643 similar to those of the third example.

Next, an operation of a sewing machine 1 according to the fourth example will be described with reference to the flowcharts of FIG. 29 and FIG. 30. The main routine of the fourth example may be different from that of the third example (refer to FIG. 23) in terms of processing operations of step 403 (S403) and steps 411 to 413 (S411 to S413) shown in FIG. 29. The sewing routine in step 407 (S407) may be similar to that of the first example (refer to FIG. 8), whereas the history reproduction sewing control routine performed in the sewing routine thereof may be different from that of the first example. Therefore, the fourth example describes the main routine and the history reproduction sewing control routine.

Figure 29:
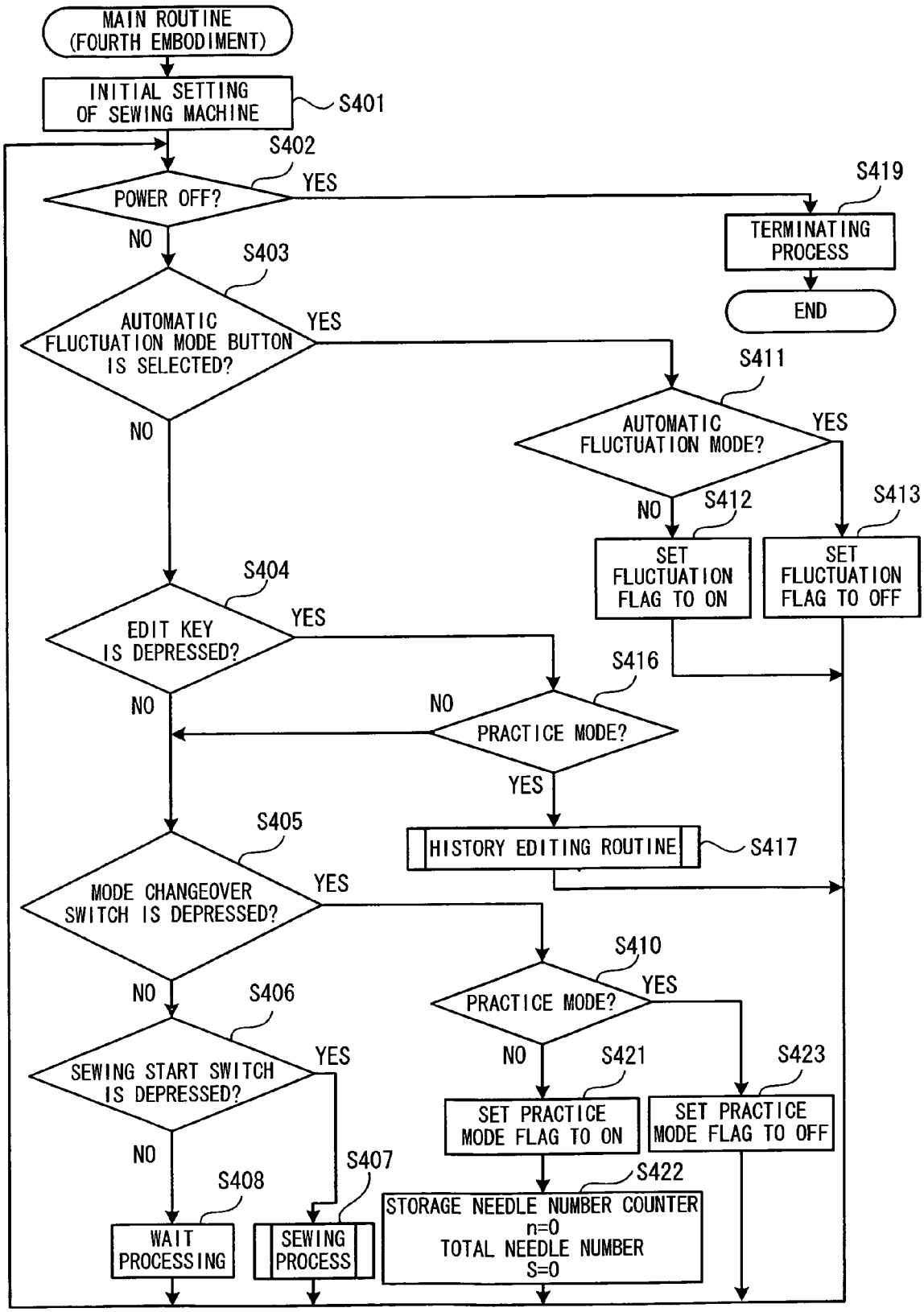
FIG. 29 is a flowchart of a main routine according to a fourth example.
Figure 30:
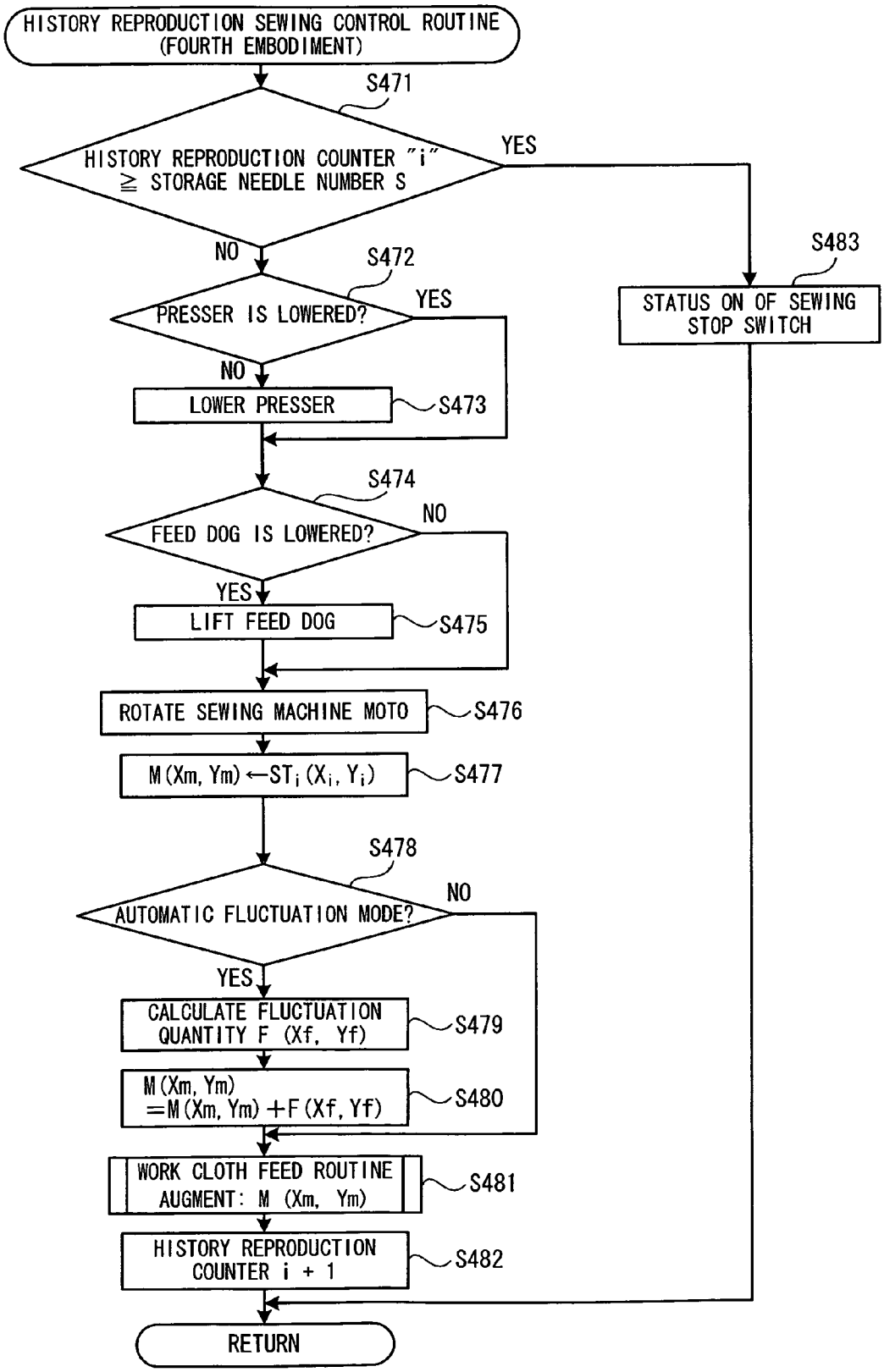
FIG. 30 is a flowchart of a history reproduction sewing control routine performed in a sewing routine.

As shown in FIG. 29, in the main routine, first, initial setting of the sewing machine is performed as in the third example in step 401 (S401). If in step 402 (S402) an instruction for turning power OFF is not performed (S402: NO), a determination is made as to whether an automatic fluctuation mode button has been selected (S403). If the automatic fluctuation mode button has been selected (S403: YES), a determination is made as to whether an automatic fluctuation mode is currently set (S411). If the fluctuation flag stored in the fluctuation flag storage area 644 is set to ON, and then, the automatic fluctuation mode is set (S411: YES), the fluctuation flag is set to OFF in step 413 (S413). In addition, if the fluctuation flag is set to OFF (S411: NO), the fluctuation flag is set to ON in step 412 (S412). Then, the processing may return to S402.

In addition, if the automatic fluctuation mode button has not been selected (S403: NO), and then, a determination is made as to whether an edit button is selected and an instruction for editing a stitch has been performed in step 404 (S404). If the editing instruction has not been performed (S404: NO), and then, a determination is made as to whether operation of the mode changeover switch 59 is performed and an instruction for switching a practice mode and a normal mode has been performed in step 405 (S405). If the mode changeover switch 59 has been operated (S405: YES), when a "practice mode" is set (S410: YES), a "normal mode" is set (S423). In step 410 (S410), in when the "normal mode" is set (S410: NO), the "practice mode" is set in step 421 (S421), and the storage needle number counter "n" and the total needle number S are set to an initial value "0" in step 422 (S422). Then, the processing may return to S402.

In addition, in step 405 (S405), when the mode changeover switch 59 has not been operated (S405: NO), a determination is made as to whether the sewing start switch 21 has been operated in step 406 (S406). If operation of the sewing start switch 21 has not been made (S406: NO), one waits for a predetermined time in step 408 (S408), and the processing may return to S402. In addition, when the sewing start switch 21 is operated, and then, an instruction for starting sewing is performed (S406: YES), the sewing routine is executed in step 407 (S407) (refer to FIG. 8). Then, when the sewing routine terminates, the processing may return to S402. At S402, when the power switch 58 is operated, and then, an instruction for turning power OFF is performed (S402: YES), a terminating process is performed in step 425 (S425), the main routine is terminated, and the sewing machine 1 is powered OFF.

In addition, at S403, when the edit button has been selected (S404: YES), if the practice mode is not set in step 416 (S416) (S416: NO), a history of a stitch to be edited is not stored in the stitch history table ST, and thus, the processing proceeds to S405 without doing anything. In addition, while the practice mode is in progress (S416: YES), the history edit routine is executed in step 417 (S417) (refer to FIG. 24). Then, the processing may return to S402. As described above, in the main routine, OFF/ON of the automatic fluctuation mode is switched by selecting the automatic fluctuation mode button.

Next, the history reproduction sewing control routine of the fourth example will be described with reference to FIG. 30. In the history reproduction sewing control routine, as in the history reproduction sewing control routine of the first example (refer to FIG. 10), first, a determination is made as to whether a value of a reproduction needle number counter "i" is equal to or greater than a total needle number S in step 471 (S471). If the value of the reproduction needle number counter "i" is not equal to or not greater than the total needle number S (S471: NO), a stitch to be reproduced still exists. Thus, in preparation for sewing, in step 472 (S472), when the presser foot 39 is lifted (S472: YES), the presser foot elevation pulse motor 143 is driven, and then, the presser foot 39 is lowered in step 473 (S473). In step 474 (S474), when the feed dog 180 is not lowered (S474: NO), the feed dog 180 is lowered in step 475 (S475), and the sewing machine motor 91 is rotated in step 476 (S476).

Then, a value of a stitch history table STi is read out, and the work cloth feed quantity M (Xm, Ym) is stored in the work cloth feed quantity storage area 637 in step 477 (S477). Then, a determination is made as to whether the automatic fluctuation mode is set depending on whether the fluctuation flag is set to ON in step 478 (S478). If the fluctuation flag is set to OFF, and then, the automatic fluctuation mode is not set (S478: NO), a fluctuation is not provided to a stitch. Thus, the processing proceeds to step 481 (S481) as it is, the feed quantity M (Xm, Ym) is provided as an augment, and then, the work cloth feed routine is executed (S481) (refer to FIG. 11). On the other hand, if the automatic fluctuation mode is set (S478: YES), a fluctuation quantity F (Xf, Yf) is calculated in step 479 (S479). With respect to the fluctuation quantity F, a random number in a predetermined range is generated with the use of a known random number generating program. The random number generating program may be a program that acquires a random number while a predetermined numeric value is given or a program caused by a physical random number generating device for acquiring a random number based on a noise signal or the like (for example, Japanese Patent Application No. HEI 11-85472) may be used. The range of generating the random number may be determined based on a stitch length (pitches), for example, and may be "−0.1×pitches to 0.1×pitches) or the like. Then, the calculated fluctuation quantity is added to the work cloth feed quantity M, and fluctuation is provided (S480). Specifically, "Xm=Xm+Xf", "Ym=Ym+Yf" is established. Then, the processing proceeds to S481, the feed quantity M (Xm, Ym) is provided as an augment, and then, the work cloth feed routine is executed (S481, refer to FIG. 11).

In the work cloth feed routine of S481, the feed dog 180 is moved based on a value of a stitch history table STi, whereby the work cloth is moved, and one stitch is formed. Then, "1" is added to the reproduction needle number counter "i", the history reproduction sewing control routine is terminated, and the processing may return to the sewing routine (refer to FIG. 8).

As described above, in the fourth example as well, as in the first example, the practice mode is set, and sewing is performed with the use of a practice cloth. When sewing has been successfully performed, reproduction of sewing can be performed with respect to a cloth for regular sewing. In this manner, sewing preferred to a cloth for regular sewing can be reproduced. Further, in the fourth example, when setting of an automatic fluctuation mode is provided and the automatic fluctuation mode is set, a fluctuation quantity F obtained as a random number is added to the work cloth feed quantity M, whereby a change is given to stitch pitches or inclination. As a result, fluctuation can be provided to a stitch, and then, natural impression is achieved while a sewing result is not mechanical. In particular, in the edited movement data, stitch trajectory is regularly formed, and a texture may not be formed such that sewing is manually performed. However, fluctuation occurs with a regularly formed stitch by adding a fluctuation value, and a texture close to that such that sewing has been manually performed can be obtained. In addition, if a fluctuation quantity is a small amount (for example, a predetermined rate of pitches is within 10% or within 5%, or a predetermined quantity is within 2 mm), the entire atmosphere can be made moderate without imparting a great change to trajectory of the entire stitch.

Next, a fifth example will be described with reference to FIGS. 31 to 33. A sewing machine of the fifth example is provided with an evaluation function of evaluating the achievement of a stitch stored in the stitch history table ST in addition to the functions of the sewing machine according to the first example. A physical configuration of the sewing machine 1 according to the fifth example may be similar to that of the first example, and an electrical configuration thereof may be substantially similar to that of the sewing machine 1 according to the first example. A description is given by way of reference, and is omitted. Here, a description will be given with respect to only a configuration of storage areas provided in the RAM 63 that may be different from that according to the first example.

Figure 31:
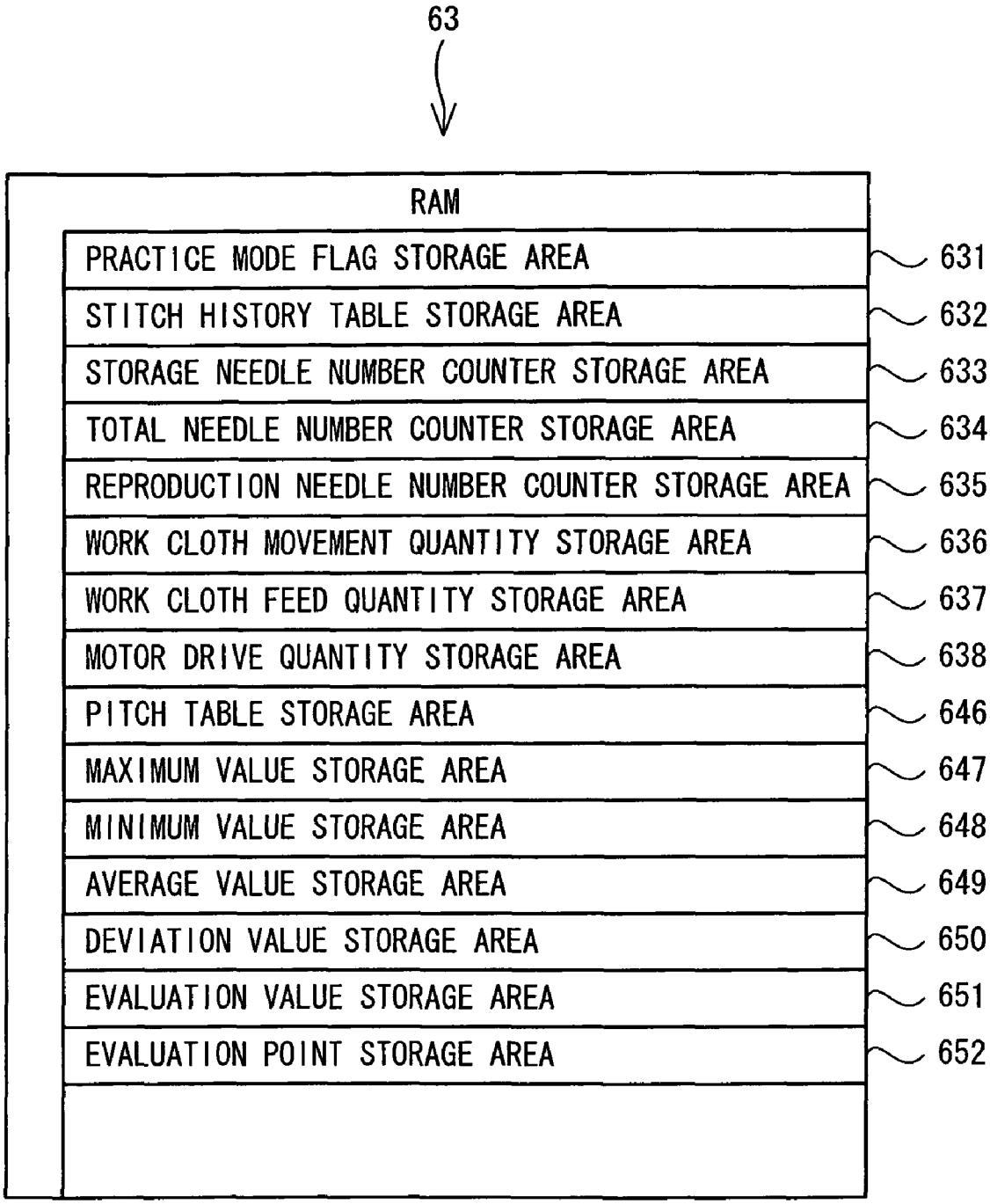
FIG. 31 is a schematic view of a configuration of a RAM.

As shown in FIG. 31, in the RAM 63, there is provided: the practice mode flag storage area 631, the stitch history table storage area 632, the storage needle number counter storage area 633, the total needle number storage area 634, the reproduction needle number counter storage area 635, the work cloth movement quantity storage area 636, the work cloth feed quantity storage area 637, the motor drive quantity storage area 638, a pitch table storage area 646, a maximum value storage area 647, a minimum value storage area 648, an average value storage area 649: a deviation value storage area 650, an evaluation value storage area 651, and an evaluation point storage area 652 or the like. A variety of storage areas, which are not shown, are also provided in the RAM 63.

A pitch table L serving as N one-dimensional arrangements is stored in the pitch table storage area 646, and a length (pitches) of a stitch stored in the stitch history table ST is stored in correspondence with the stitch history table ST. A maximum value of pitches stored in the pitch table L is stored in the maximum value storage area 647. A minimum value of pitches stored in the pitch table L is stored in the minimum value storage area 648. An average value of pitches stored in the pitch table L is stored in the average value storage area 649. A deviation (standard deviation) of pitches stored in the pitch table L is stored in the deviation value storage area 650. An evaluation value of a stitch stored in the stitch history table ST is stored in the evaluation value storage area 651. An evaluation point of a stitch stored in the stitch history table ST is stored in the evaluation point storage area 652. A description is given by way of reference and is omitted with reference to storage areas 631 to 638 similar to those of the first example.

Next, an operation of a sewing machine 1 according to a fifth example will be described with reference to the flowcharts of FIG. 32 and FIG. 33. The main routine of the fifth example may be partly different from that of the first example (refer to FIG. 7). These examples are different from each other in terms of steps 503 (S503), step 511 (S511), and step 512 (S512). Then, the fifth example describes only the main routine and a stitch evaluation routine performed at S512. A description is given by way of reference and is omitted, with respect to portions at which processing similar to that of the first example is performed.

Figure 32:
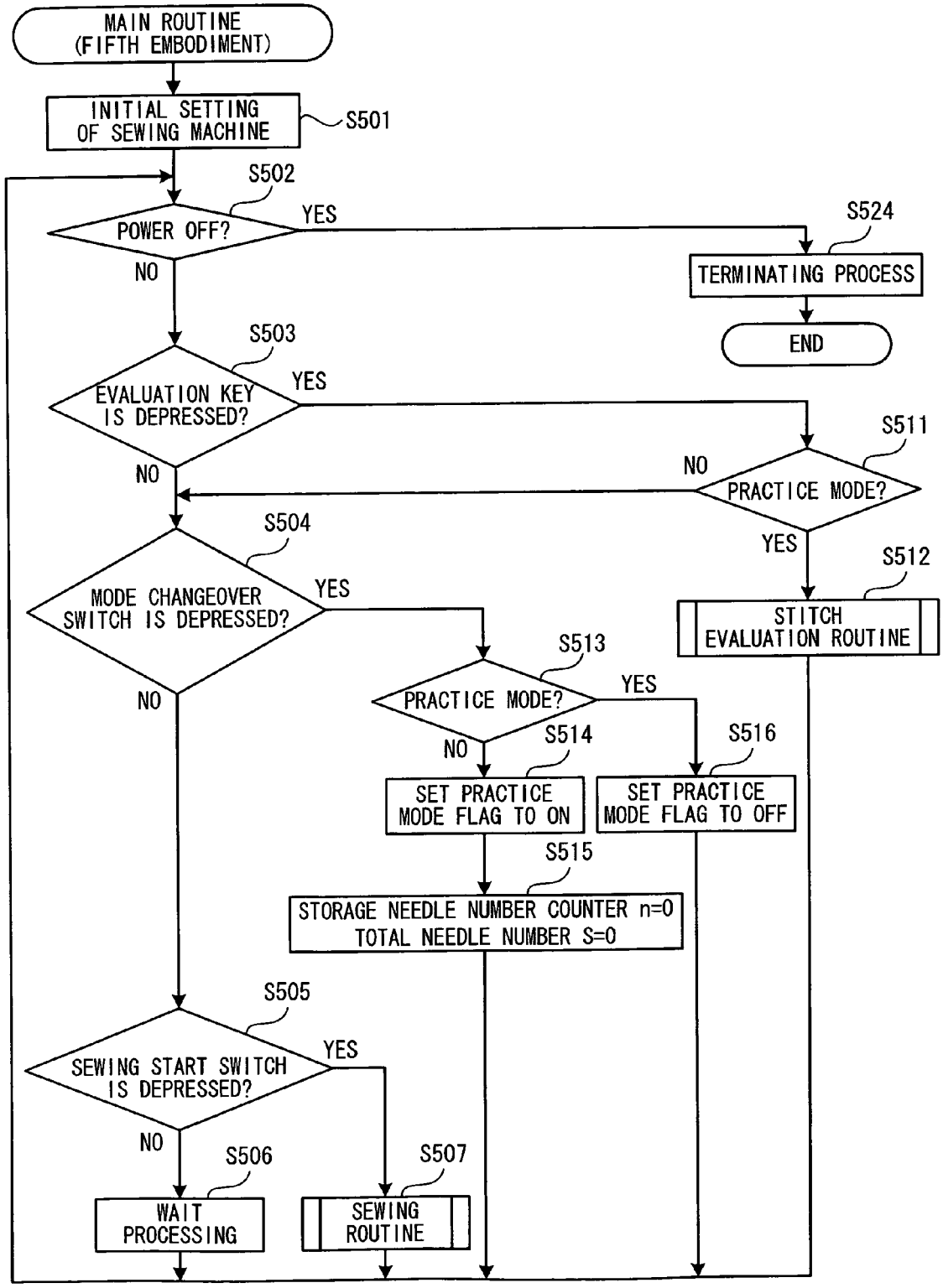
FIG. 32 is a flowchart of a main routine according to a fifth example.
Figure 33:
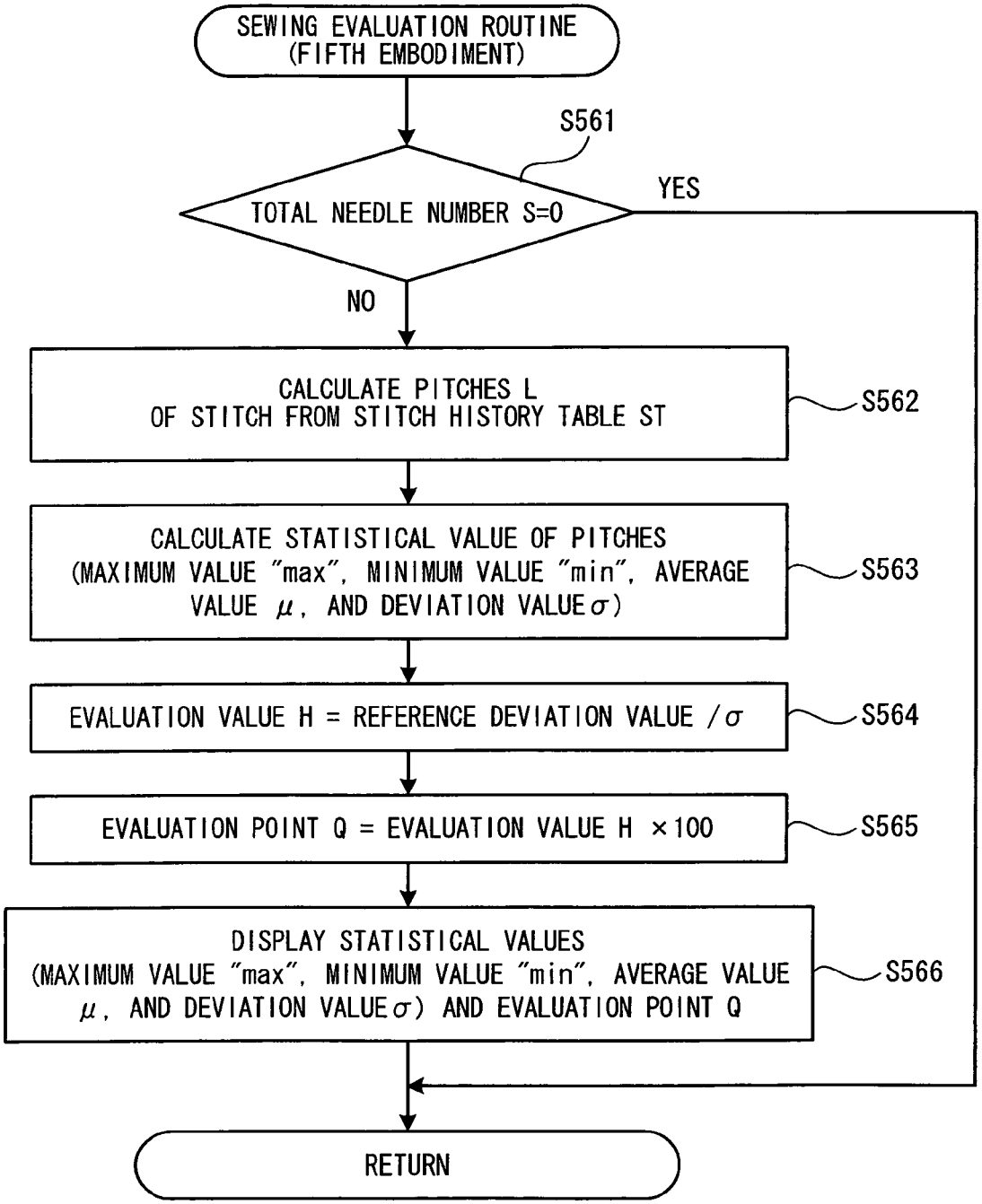
FIG. 33 is a flowchart of a stitch evaluation routine performed in a main routine.

As shown in FIG. 32, in the main routine, first, initial setting of a sewing machine is performed as in the first example in step 501 (S501). If in step 502 (S502), an instruction for turning power OFF is not performed (S502: NO), a determination is made as to whether an evaluation button has been selected (S503). The evaluation button is provided in the menu screen (not shown). If the evaluation button has been selected (S503: YES), a determination is made as to whether a practice mode is currently set (S511). If the practice mode is set (S511: YES), the stitch evaluation routine is executed (S512, refer to FIG. 33). The stitch evaluation routine will be described later. Then, the processing may return to S502.

In addition, if the evaluation button is not selected (S503: NO), and then, a determination is made as to whether operation of the mode changeover switch 59 is performed and an instruction for switching a practice mode and a normal mode has been performed in step 504 (S504). If the mode changeover switch 59 has been operated (S504: YES), in step 513 (S513), in when the "practice mode" is set (S513: YES), the practice mode flag is set to OFF, and the "normal mode" is set in step 516 (S516). When the "normal mode" is set (S513: NO), the normal mode flag is set to OFF, and the "practice mode" is set in step 514 (S514), and then, the storage needle number counter "n" and a total needle number S are set to an initial value "0" in step 515 (S515). Then, the processing may return to S502.

In addition, when the mode changeover switch 59 has not been operated (S504: NO), a determination is made as to whether the sewing start switch 21 has been operated in step 505 (S505). If operation of the sewing start switch 21 has not been made (S505: NO), one waits for a predetermined time in step 506 (S506), and then, the processing may return to S502. In addition, when the sewing start switch 21 is operated, and then, an instruction for starting sewing is performed (S505: YES), the sewing routine is executed in step 507 (S507) (refer to FIG. 8). Then, when the sewing routine terminates, the processing may return to S502. At S502, when the power switch 58 is operated, and then, an instruction for turning power OFF is performed (S502: YES), a terminating process is performed in step 524 (S524), the main routine is terminated, and then, the sewing machine 1 is powered OFF.

Now, the stitch evaluation routine will be described with reference to the flowchart of FIG. 33. First, a determination is made as to whether a total needle number S is set to "0" in step 561 (S561). If the total needle number S is set to "0" (S561: YES), it denotes that a stitch to be evaluated is not stored in the stitch history table ST. Thus, the stitch evaluation routine is terminated, and then, the processing may return to the main routine. An error message such as a message "a stitch to be edited is not recorded" may be displayed on the liquid crystal display 15.

In addition, when the total needle number S is not set to "0" (S561: NO), and then, a stitch to be evaluated is stored in the stitch history table ST, pitches of stitches are calculated based on coordinate information on the stitch history table ST, and then, the calculated pitches are stored in the pitch table L in step 562 (S562). Pitches of an n-th stitch can be obtained by a positive root of "$Xn^2+Yn^2$". Then, stitch pitches of a stitch history table STn are stored in a pitch table Ln. Then, various statistical values of pitches are calculated in step 563 (S563). Specifically, a maximum value of pitches stored in the pitch table L is detected and is stored in the maximum value storage area 647 as a maximum value "max", and a minimum value is detected and is stored in the minimum value storage area 648 as a minimum value "min". Further, an average value is calculated and is stored in the average value storage area 649 as an average value μ, and a deviation value is calculated and is stored in the deviation value storage area 650 as a deviation value σ.

Then, a value obtained by dividing a reference deviation value by the deviation value a is calculated as an evaluation value H, and then, the calculated value is stored in the evaluation value storage area 651 in step 564 (S564). Then, a value obtained by multiplying 100 for the evaluation value H is calculated as an evaluation point Q in step 565 (S565). Next, a statistical value and the evaluation point Q are displayed on the liquid crystal display 15 in step 566 (S566). Then, the stitch evaluation routine is terminated, and then, the processing may return to the main routine.

As described above, in the fifth example as well, as in the first example, when a practice mode is set, sewing is performed with the use of a cloth that is intended for practice sewing, and then, when sewing has been successfully performed, reproduction of sewing can be performed with respect to a cloth that is intended for regular sewing. In this manner, sewing that is preferred for a cloth that is intended for regular sewing can be reproduced. Further, in the fifth example, a length of a stitch stored in the stitch history table ST can be evaluated by selecting an evaluation button. As in free motion sewing, when sewing is performed such that uniform pitches are assumed to be beautiful, this evaluation can be provided as a reference. A determination can be made such that, when the evaluation is low, practice is performed again without reproducing a stitch history for the work cloth for regular sewing, and if evaluation is high, reproduction of sewing is performed for the work cloth intended for regular sewing. In addition, an evaluation value can be obtained with respect to recorded sewing, so that objective guideline can be provided as to the determination of whether recorded sewing is sewn in a reproduced manner.

While, in the fifth example, "stitch pitches" are used as "line segment information", and a deviation value of pitches are used when the evaluation point Q is calculated, another numeric value may be used when the evaluation point Q is calculated, of course. For example, in comparison with a predetermined length (for example, desired pitches such as 3 mm) using an average value of a length, a point may be determined based on a difference or ratio therebetween. In addition, by counting the number of stitches falling into a predetermined range, a point may be determined based on the counted number of stitches. The predetermined length may be stored in advance in the ROM 62 or the like, may be described in a program, may be selected by a user from the values stored in advance or described, or alternatively, may be inputted by the user.

In addition, an evaluation point may be calculated with the use of "angle formed by the two adjacent stitches" as "line segment information", instead of "stitch pitches". As such, an angle θ formed by an n-th stitch and an n+1-th stitch is calculated based on STn and STn+1. These two stitches each have a start point and an end point, and thus, are assumed to be a vector. While an end point of the n-th stitch is a start point of the n+1-th stitch, assuming that the same start point of the two stitches is origin (0, 0), STn (Xn, Yn) can be handled as a coordinate of an end point of the n-th stitch and $ST_{n+1}$ ($X_{n+1}$, $Y_{n+1}$) can be handled as a coordinate of an end point of the n+1-th stitch. Therefore, an angle θ' formed by two vectors when a start point is defined to be an origin is 180-θ. Then, assuming that a length (pitches) of the n-th stitch is Ln, and a length of the n+1 stitch is Ln+1, an internal product of the two stitches is obtained by Ln×Ln+1×cos θ'=Xn×Xn+1+Yn×Yn+1. Accordingly, θ' can be obtained, and thus, an angle θ formed by the two stitches can also be obtained.

An evaluation point may be calculated with the use of the calculated angle θ. An average value of the angle θ may be used or a deviation value may be obtained. In addition, in comparison with a predetermined angle (90 degrees, for example), a point may be determined based on a difference or a ratio therebetween. A point may also be determined based on the counted number by counting the number corresponding to the predetermined range (for example, 90 degrees to 180 degrees). The predetermined angle or range may be stored in advance in the ROM 62 or the like, may be described in a program, may be selected by a user from a value stored in advance or described, or alternatively, may be inputted by the user. In addition, an evaluation point may be determined with the use of a length, an angle, and statistical values thereof.

Further, a curve to be obtained as a sewing result is inputted in advance, an approximate curve of a stitch stored in the stitch history table ST is calculated, and the approximate curve is compared with a curve inputted in advance, whereby an evaluation point may be determined.

Next, a sixth example will be described with reference to FIGS. 34 to 47. In a sewing machine of the sixth example, a stitch history circulation table SLT with a circulation type configuration may be used unlike a configuration of the stitch history table of the first to fifth examples. In addition, in the sixth example, the practice mode and the normal mode may not be provided, and sewing recording may always be performed in the stitch history circulation table SLT. This sewing machine is provided with an inversion sewing function as in the sewing machine of the second example.

A physical configuration and an electrical configuration of the sewing machine 1 according to the sixth example are substantially identical to those of the sewing machine according to the first example. A description is given by way of reference and is omitted. Here, a description will be given only with respect to difference from the first example. These examples are different from each other in terms of provision of the reproduction sewing start switch 24 and a needle bar release mechanism 85, and configuration of storage areas of the RAM 63.

In the sewing machine 1 of the sixth example, there is provided the reproduction sewing start switch 24 (refer to FIG. 1) for instructing reproduction sewing of a stitch stored in the stitch history circulation table SLT. The reproduction sewing start switch 24 is connected to the input interface 65 (refer to FIG. 4), and an input signal is transmitted to a CPU 61 when the switch 24 has been depressed. When the reproduction sewing start switch 24 is depressed, reproduction sewing of a stitch stored in the stitch history circulation table SLT (refer to FIG. 41) is started.

Further, the sewing machine 1 of the sixth example is provided with the needle bar release mechanism 85 for releasing the sewing needle 7 from the needle bar 6, and then, disconnecting transmission of the power from the sewing machine motor 91.

Figure 34:
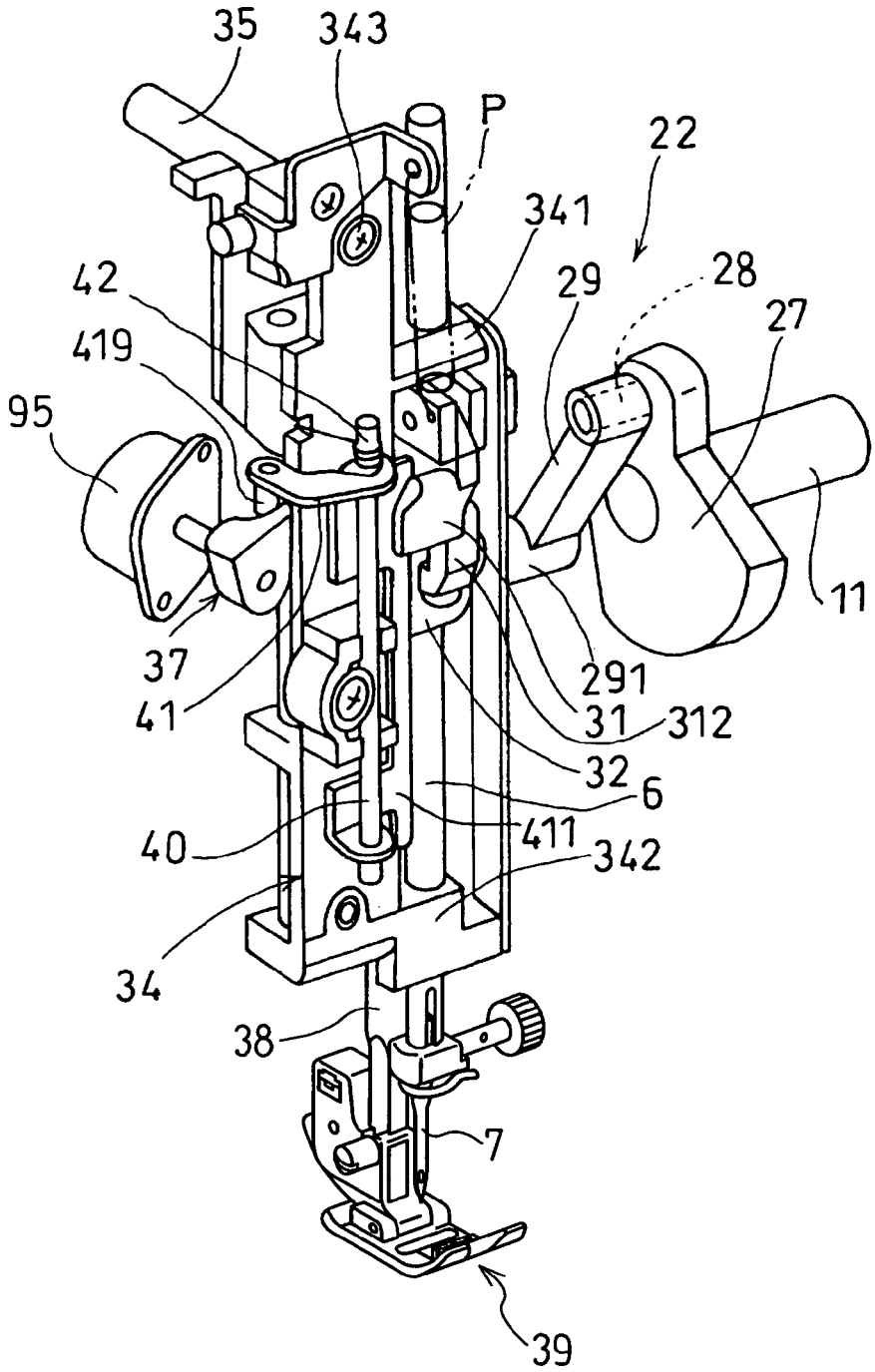
FIG. 34 is a perspective view showing a schematic configuration of a needle bar vertical movement mechanism and a needle bar release mechanism in the sewing machine of FIG. 1.
Figure 35:
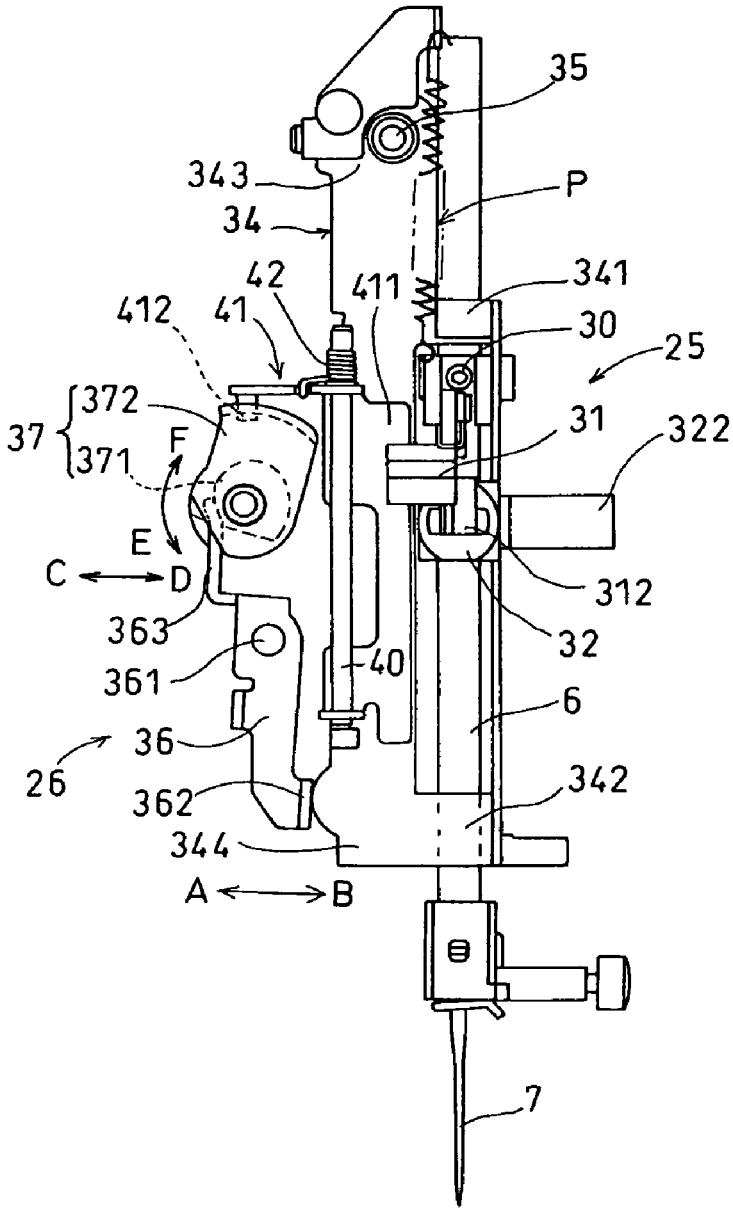
FIG. 35 is a front view of essential portions of a needle bar release mechanism.
Figure 36:
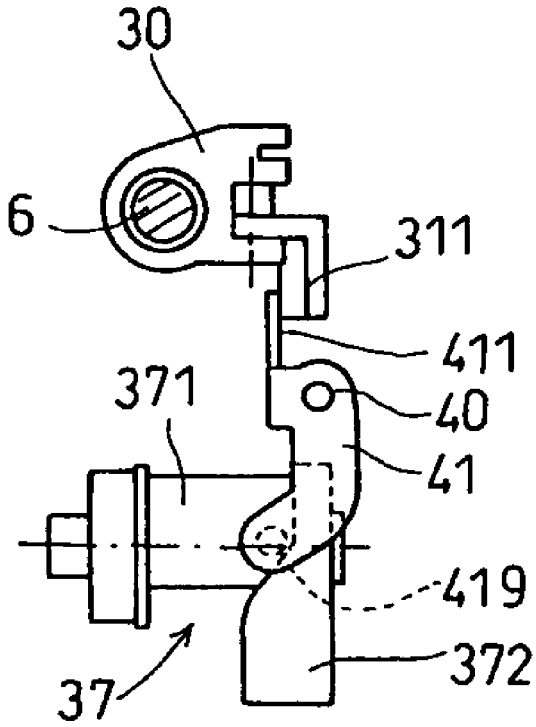
FIG. 36 is an illustrative view of a needle bar release operation of a needle bar release mechanism.
Figure 37:
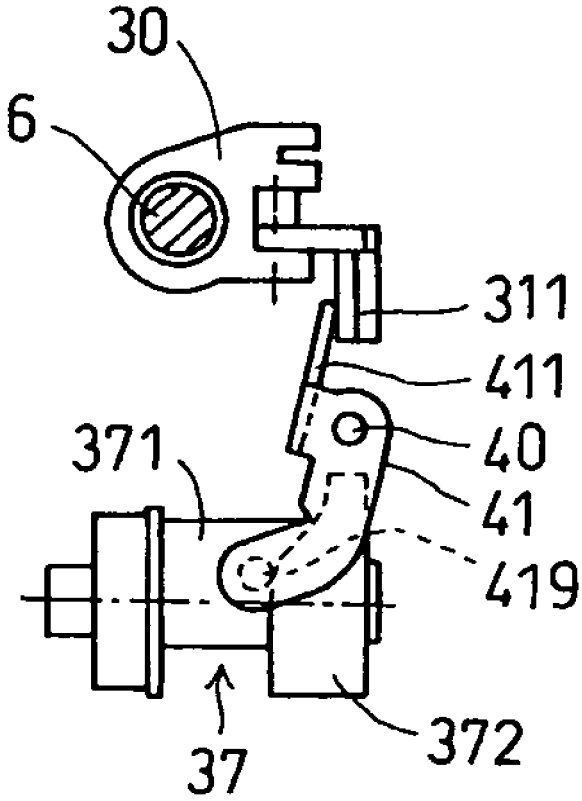
FIG. 37 is an illustrative view of a needle bar release operation of a needle bar release mechanism.

Next, the needle bat vertical movement mechanism 82 will be described with reference to FIGS. 34 to 39. As shown in FIG. 34 and FIG. 35, the needle bar 6 is supported at vertical support portions 341, 342 of a needle bar base 34, so as to vertically move smoothly. A needle bar claw base 30 is fixed at the top and bottom intermediate part of the needle bar 6, and a proximal end (upper end) of a needle bar claw body 31 is turnably pivoted via a pin 309 with respect to the needle bar claw base 30 (refer to FIG. 38 and FIG. 39). On the other hand, a needle bar embracement 32 is provided to be vertically movable with respect to the needle bar 6 at a lower part of the needle bar claw base 30.

Figure 38:
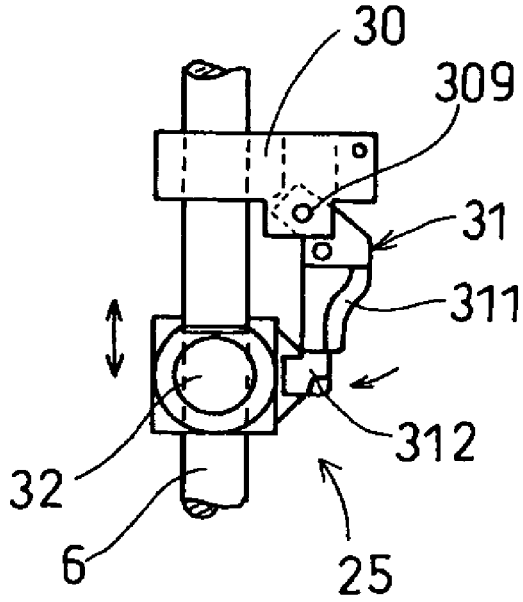
FIG. 38 is an illustrative view of a needle bar release operation of a needle bar release mechanism.
Figure 39:
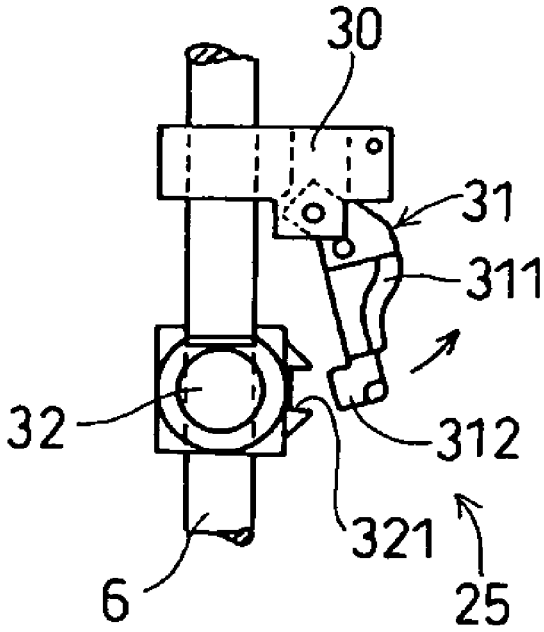
FIG. 39 is an illustrative view of a needle bar release operation of a needle bar release mechanism.

A needle bar crank rod 29 is linked via a crank pin 28 protruded horizontally at a thread take-up crank 27 provided at an end of the main shaft. At a boss portion 291 of the needle bar crank rod 29, a shaft 322 protruding from the needle bar embracement 32 is linked so that the shaft is engagingly and turnably inserted. Then, an engagement claw portion 312 at an end (lower end) of the needle bar claw body 31 is removably engaged with an engagingly lock portion 321 formed at the needle bar embracement 32 in a recessed manner. In addition, a torsion spring, which is not shown, is provided at a proximal end of the needle bar claw body 31, and a resilient force acts so as to hold an engagement state between the engagement claw portion 312 and the engagingly lock portion 321. Therefore, as shown in FIG. 38, in a state in which the engagement claw portion 312 is engagingly locked with the engagingly lock portion 321, the main shaft rotates due to the drive of the sewing machine motor 91. The rotation is transmitted as vertical movement at the needle bar embracement 32 via the thread take-up crank 27 and the needle bar crank rod 29. The vertical movement is transmitted so as to vertically move the needle bar 6 via the needle bar claw body 31 and the needle bar claw base 30. A thread take-up lever (not shown) to be linked with the thread take-up crank 27 vertically swings together with rotation of the main shaft.

Next, a needle swing mechanism 86 will be described below. The needle bar base 34 is turnably suspended via a support shaft 35 fixed to a frame (not shown) of the sewing machine 1 at a portion of an upper end 343 thereof. In addition, the needle bar base 34 biases a lower end 344 thereof in the direction indicated by the arrow A of FIG. 35 by means of a spring, which is not shown. As shown in FIG. 35, a needle swing lever 36 (not shown in FIG. 34) is turnably pivoted at a support shaft 361 fixed to the frame of the sewing machine 1, and a lower end 362 of the needle swing lever 36 abuts against a side face of the lower end 344 of the needle bar base 34.

In addition, as shown in FIG. 34, the needle swing pulse motor 95 is fixed to the frame of the sewing machine 1, and is fixed to a rotary shaft of the needle bar pulse motor 95 so that a cam body 37 rotates integrally. As shown in FIG. 35, a needle swing cam portion 371 of the cam body 37 abuts against an abutment portion 363 at the upper end side of the needle swing lever 36. When the needle swing cam portion 371 is actuated, the needle swing cam portion 371 turns in the direction indicated by the arrow E of FIG. 35, the needle swing cam portion 371 is pressed, and then, the abutment portion 363 of the needle swing lever 36 turns in the direction indicated by the arrow C. Therefore, the needle bar base 34 is pressed in the direction indicated by the arrow B at the lower end 344 thereof, against the spring biasing force, which is not shown. In contrast, if the needle swing cam portion 371 turns in the direction indicated by the arrow F of FIG. 35, the needle bar based 34 moves in the direction indicated by the arrow A at the lower end 344 thereof.

Next, a configuration of the needle bar release mechanism 85 will be described below. A support shaft 40 is supported on the needle bar base 34 in a planar shape together with the needle bar 6, and a release lever 41 is turnably supported on the support shaft 40. An overhang portion 411 formed at one end of the release lever 41 is capable of abutting against an overhang portion 311 of the needle bar claw body 31 (refer to FIG. 36). In addition, a pin shaped cam follower 419 protruded downwardly at the other end of the release lever 41 is capable of abutting a needle bar release cam portion 372 among from the cam body 37.

A coil portion of a twisted coil spring 42 is supported on the support shaft 40, and an engagingly lock end extending from the coil portion is engagingly locked with the overhang portion 411 of the release lever 41. The release lever 41 is biased to an orientation abutting the cam follower 419 against a needle bar release cam portion 372. Therefore, if the cam body 37 is turned by means of the needle swing pulse motor 95, the needle bar release cam portion 372 abuts against the cam follower 419. Then, the release lever 41 turns clockwise against the biasing force of the twisted coil spring 42 (refer to FIG. 36 and FIG. 37). Thus, the overhang portion 411 is caused to push the overhang portion 311 of the needle bar claw body 31, so that the needle bar claw body 31 turns in the direction in which the engagement claw portion 312 is spaced from the engagingly lock portion 321 of the needle bar embracement 32 (refer to FIG. 38 and FIG. 39). In this way, a drive link state (engagement state) between the needle bar claw base 30 and the needle bar embracement 32 is released. The overhang portion 411 of the release lever 41 is formed over the vertical movement area when the needle bar claw body 31 moves vertically while it is engaged with the needle bar embracement 32, thus making it possible to perform the operation of releasing a needle bar regardless of the vertical position of the needle bar 6.

Then, a tensile spring P is interposed between the needle bar claw base 30 and an upper end of the needle bar base 34, and the needle bar 6 is always biased upwardly. This tensile spring P moves the needle bar 6 up to an upward upper dead center (needle top position) when driving link between the needle bar claw base 30 and the needle bar embracement 32 has been released. Namely, when a needle bar release state is established, the needle bar 6 waits at the top position.

When the needle swing pulse motor 95 is driven and the cam follower 419 is released from the needle bar release cam portion 372, the overhang portion 411 of the release lever 41 is turned in the direction spaced from the overhang portion 311 of the needle bar claw body 31 by means of the biasing force of the twisted coil spring 42. Thus, the needle bar claw body 31 is engagingly locked with the engagingly lock portion 321 of the needle bar embracement 32 by means of the twisted spring, which is not shown. By means of this engagingly locking, both of them are driven and linked with each other. This driving and linking are performed at the upper death point position (needle top position) of the needle bar 6.

As described above, the needle release mechanism 85 and the needle swing mechanism 86 are configured so as to be actuated by driving the needle swing pulse motor 95, and an operation of releasing the needle bar 6 and an operation of swinging a needle can be controlled by causing a CPU 61 described later to execute a program.

Figure 40:
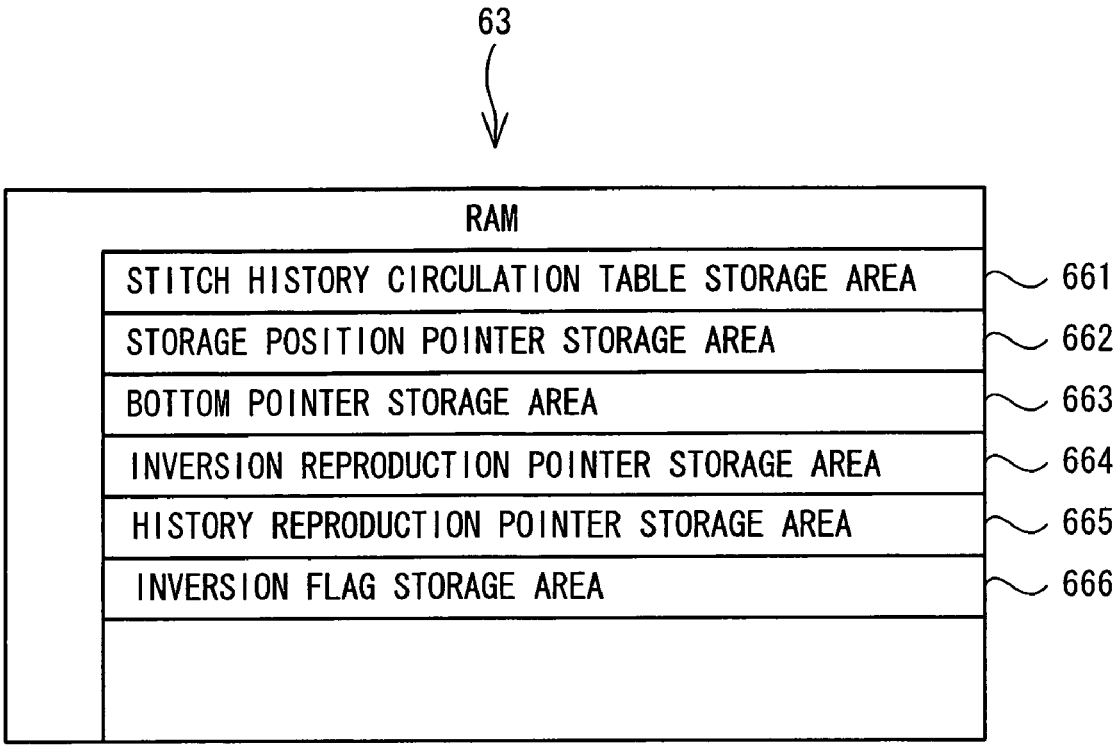
FIG. 40 is a schematic view showing a configuration of a storage area of a RAM.
Figure 41:
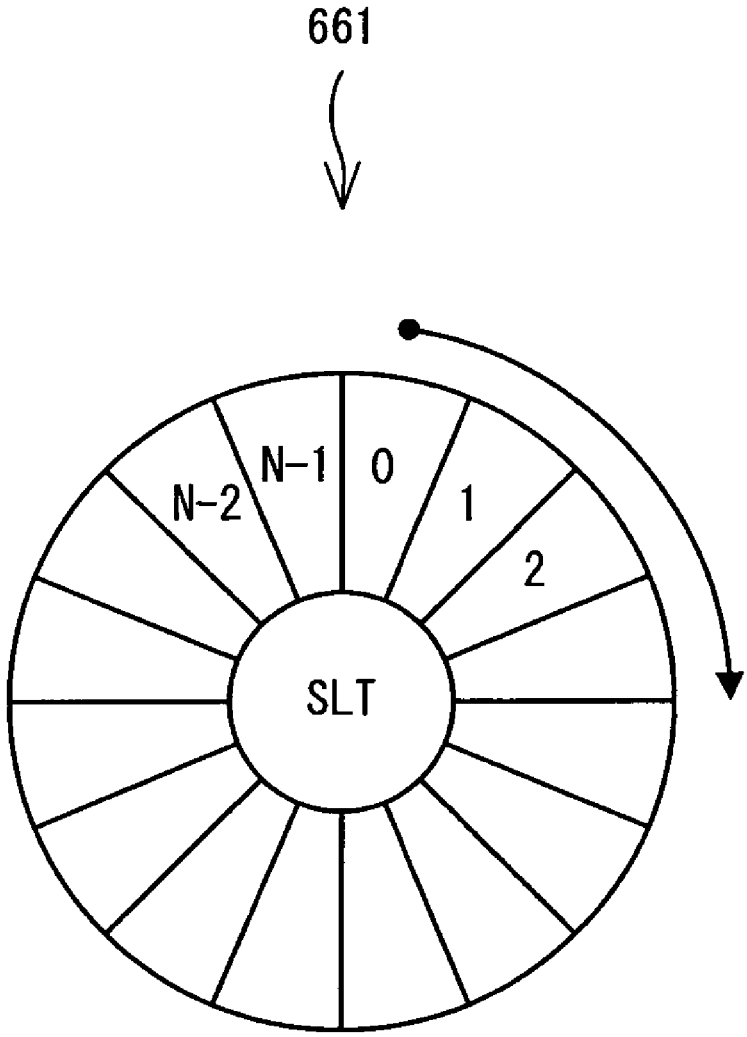
FIG. 41 is a schematic view showing a configuration of a stitch history circulation table storage area.

Next, storage areas provided in the RAM 63 will be described with reference to FIG. 40 and FIG. 41. As shown in FIG. 40, in the RAM 63, there is provided a stitch history circulation table storage area 661, a storage position pointer storage area 662, a bottom pointer storage area 663, an inversion reproduction pointer storage area 664, a history reproduction pointer storage area 665, and an inversion flag storage area 666 or the like. A variety of storage areas, which are not shown, are also provided in the RAM 63.

Then, a stitch history circulation table SLT having recorded therein coordinate information indicating a movement quantity (X-coordinate and Y-coordinate) between a start point and an end point of a stitch formed in a practice mode is stored in the stitch history circulation table 661. The stitch history circulation table SLT may be a circulation type arrangement as shown in FIG. 41. Then, as arrangement elements, an "X-coordinate" and a "Y-coordinate" are stored as in the stitch history table ST used in the first to the fifth examples. In the sixth example, N-arrangements from "0" to "N−1" are provided in the stitch history circulation table SLT. For N, a sufficiently large number (for example, 10000 or more) to store a stitch may be allocated.

In addition, a storage position pointer "np" may be stored in the storage position pointer storage area 662. The storage position pointer "np" is used for specifying arrangement for storing coordinate information in the stitch history circulation table SLT. Then, a bottom pointer "bp" may be stored in the bottom pointer storage area 663. In the bottom pointer "bp", a value indicating arrangement in which the oldest coordinate information may be stored in the stitch history circulation table SLT is stored. Then, an inversion reproduction pointer "rp" may be stored in the inversion reproduction pointer storage area 664. The inversion reproduction pointer "rp" may be used as a pointer indicating a stitch to be inversion sewn. A history reproduction pointer "sp" may be stored in the history reproduction pointer storage area 665. The history reproduction pointer "sp" may be used as a pointer indicating a start position of sewing when reproduction of sewing is performed. An inversion flag indicating whether an instruction for inversion sewing is performed, and is stored in the inversion flag storage area 666. Specifically, this flag indicates that if "1" is stored, an inversion flag is set to "ON," and when "0" is stored, the inversion flag is set to "OFF." This inversion flag may be switched by operating (depressing) the inversion switch 23.

Next, an operation of a sewing machine 1 according to the sixth example will be described with reference to FIGS. 42 to 47.

Figure 42:
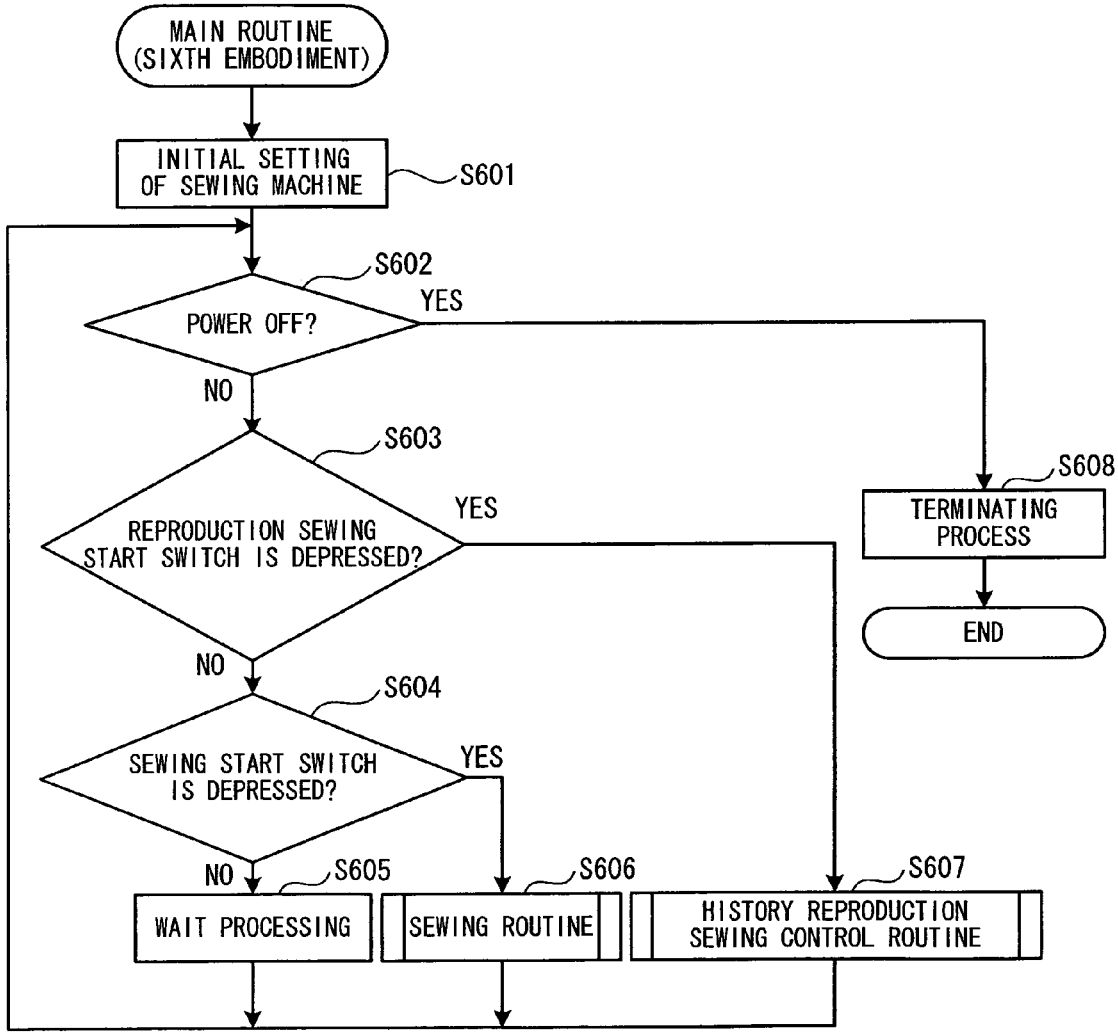
FIG. 42 is a flowchart of a main routine according to a sixth example.

As shown in FIG. 42, in a main routine, first, initial setting of the sewing machine is performed in step 601 (S601). Here, an initial value "0" is stored in the storage position pointer "np." Then, if an instruction for turning power OFF has not been performed in step 602 (S602: NO), a determination is made as to whether the reproduction sewing start switch 24 is depressed in step 603 (S603). If the reproduction sewing start switch 24 is not depressed (S603: NO), a determination is made as to whether the sewing start switch 21 has been depressed in step 604 (S604). If operation of the sewing start switch 21 has not been made (S604: NO), one waits for a predetermined time in step 605 (S605), and then, the processing may return to S602. When the sewing start switch 21 is operated, and then, an instruction for starting sewing is performed (S604: YES), the sewing routine is executed in step 606 (S606) (refer to FIG. 43). Then, when the sewing routine terminates, the processing may return to S602. In the sewing routine, sewing is performed until the sewing stop switch 22 has been depressed. The sewing routine will be described later with reference to FIG. 43 to FIG. 46.

In addition, when the reproduction sewing start switch 24 has been depressed (S603: YES), the history reproduction sewing control routine is executed in step 607 (S607) (refer to FIG. 47). Then, when the history reproduction sewing control routine terminates, the processing may return to S602. In the history reproduction sewing control routine, a stitch stored in a stitch history circulation table SLT is reproduced and sewn. The history reproduction sewing control routine will be described later with reference to FIG. 47.

Figure 43:
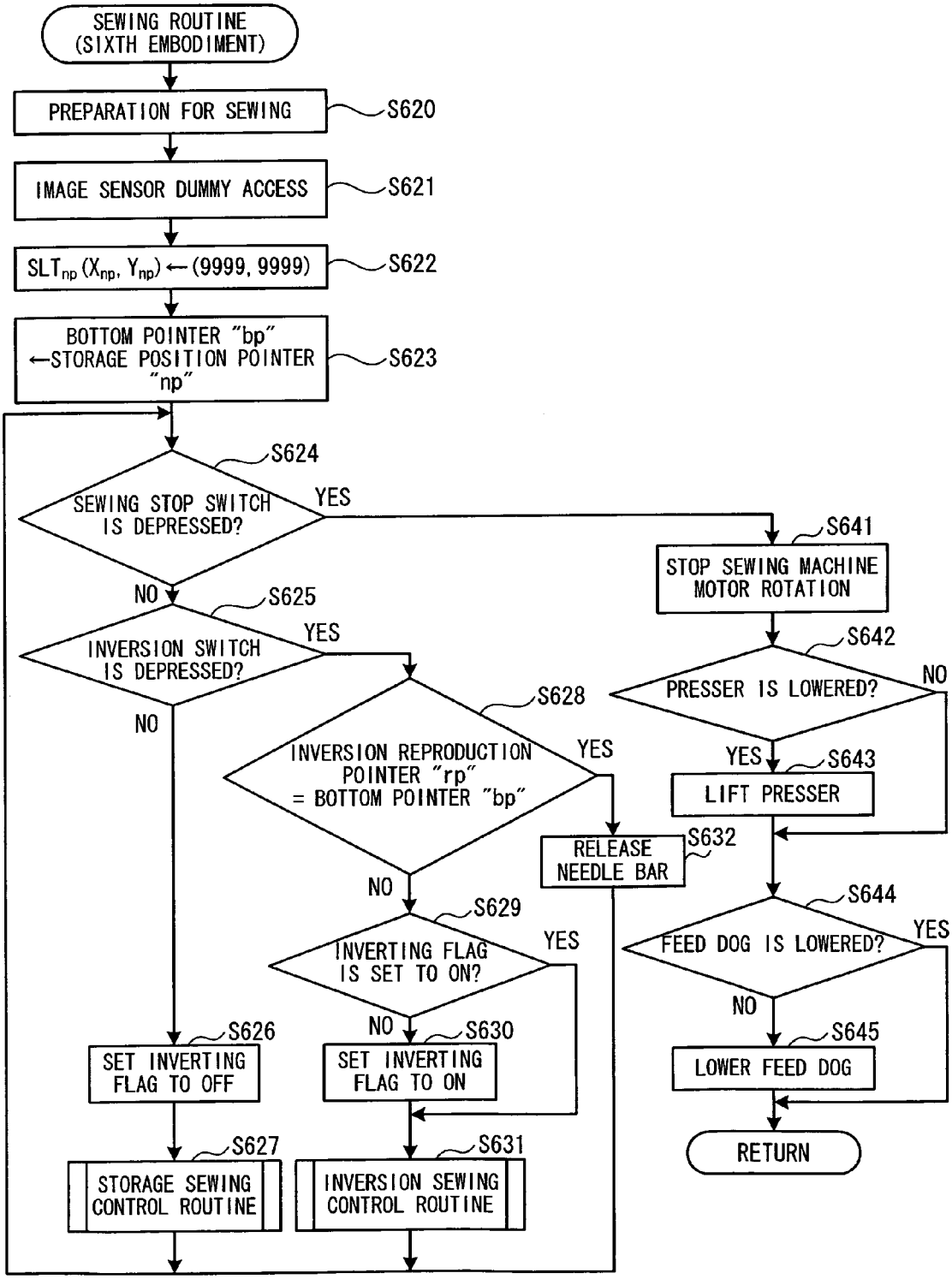
FIG. 43 is a flowchart of a sewing routine performed in a main routine.

Now, the sewing routine will be described with reference to FIGS. 43 to 46. As shown in FIG. 43, first, a sewing preparation process is performed in the sewing routine in step 620 (S620). In this preparation for sewing, various variables are initialized for sewing control of a history reproduction pointer "sp" or the like, a motor or the like is initialized, and then, various sensors or the like such as the image sensor 50 or a needle position sensor is initialized. In the image sensor 50, image acquisition at the CCD camera is performed in order to define a reference position of the work cloth as a current position. Then, a value (9999, 9999) indicating that sewing is started is stored in a stitch history circulation table SLTnp in step 621 (S621). Namely, Xnp=9999, Ynp=9999 is established. Then, a value of the storage position pointer "np" is stored in a bottom pointer "bp" indicating a current sewing start position in step 622 (S622). Then, "1" is added to the storage position pointer "np," and a storage position is increased by one in step 623 (S623).

Then, a determination is made as to whether the sewing stop switch 22 has been depressed in step 624 (S624). If the sewing stop switch 22 has not been operated (S624: NO), a determination is made as to whether the inversion switch 23 has been depressed in step 625 (S625). If the inversion switch 23 has not been depressed (S625: NO), an inverting flag is turned OFF in step 626 (S626), and then, the storage sewing control routine is executed in step 627 (S627) (refer to FIG. 43). In the storage sewing control routine, sewing in a forward direction (in a normal sewing direction) is performed, and stitch coordinate information is stored in a stitch history circulation table SLTnp. The storage sewing control routine will be described later with reference to FIG. 43. After the storage sewing control routine has terminated, the processing may return to S624.

In addition, when the inversion switch 23 is depressed (S625: YES), a determination is made as to whether an inversion reproduction pointer "rp" and a bottom pointer "bp" are equal to each other in order to determine whether a stitch to be inverted and sewn exists in step 628 (S628). The bottom pointer "bp" indicates arrangement in which the oldest data is stored in a stitch history circulation table SLTnp. Therefore, when a stitch to be inverted and sewn exists, the inversion reproduction pointer "rp" is obtained as a value different from the bottom pointer "bp". Therefore, when the inversion reproduction pointer "rp" and the bottom pointer "bp" are not equal to each other (S628: NO), a determination is made as to whether the inverting flag is set to ON in step 629 (S629). If the inverting flag is not set to ON (S629: NO), the inverting flag is set to ON in step 630 (S630). On the other hand, if the inverting flag has been already set to ON (S629: YES), processing relative to the inverting flag is not performed. Then, an inverting sewing control routine is executed in step 631 (S631) (refer to FIG. 45 and FIG. 46). In the inversion sewing control routine, inversion sewing is performed while tracing a stitch stored in a stitch history circulation table SLT. The inversion sewing control routine will be described later with reference to FIG. 45 and FIG. 46. After this inversion sewing control routine has terminated, the processing may return to S624.

In this manner, if processing operations of S624 to S627 and S624 to S631 are repeatedly performed, the sewing is performed, and the sewing stop switch 22 is depressed (S624: YES), the rotation of the sewing machine motor 91 is stopped in step 641 (S641). In step 642 (S642), in when the presser foot 39 is lowered (S642: YES), the presser foot elevation pulse motor 143 is driven, and then, the presser foot 39 is lifted in step 643 (S643). In step 644 (S644), in when the feed dog 180 is not lowered (S644: NO), the feed dog 180 is lowered in order to move the feed dog 180 in step 645 (S645). Then, the processing may return to the main routine.

In addition, when the processing operations of S624 to S627 and S624 to S631 are repeatedly performed, sewing is performed, and then, the inversion reproduction pointer "rp" and the bottom pointer "bp" are equal to each other (S628: YES), a stitch to be inverted and sewn does not exist. Thus, the cam body 37 is turned by means of the needle swing pulse motor 95, and then, the needle bar 6 is released from driving of the sewing machine motor 91 by means of the needle bar release mechanism 85 in step 632 (S632). Then, the processing may return to S624. Namely, if a stitch to be inverted and sewn does not exist (S628: YES), even if the sewing machine motor 91 is driven, no sewing is performed due to releasing the needle bar 6. Then, if a user depresses the sewing stop switch 22 (S624: YES), a process for stopping a series of sewing operations is performed (S641 to S645).

Figure 44:
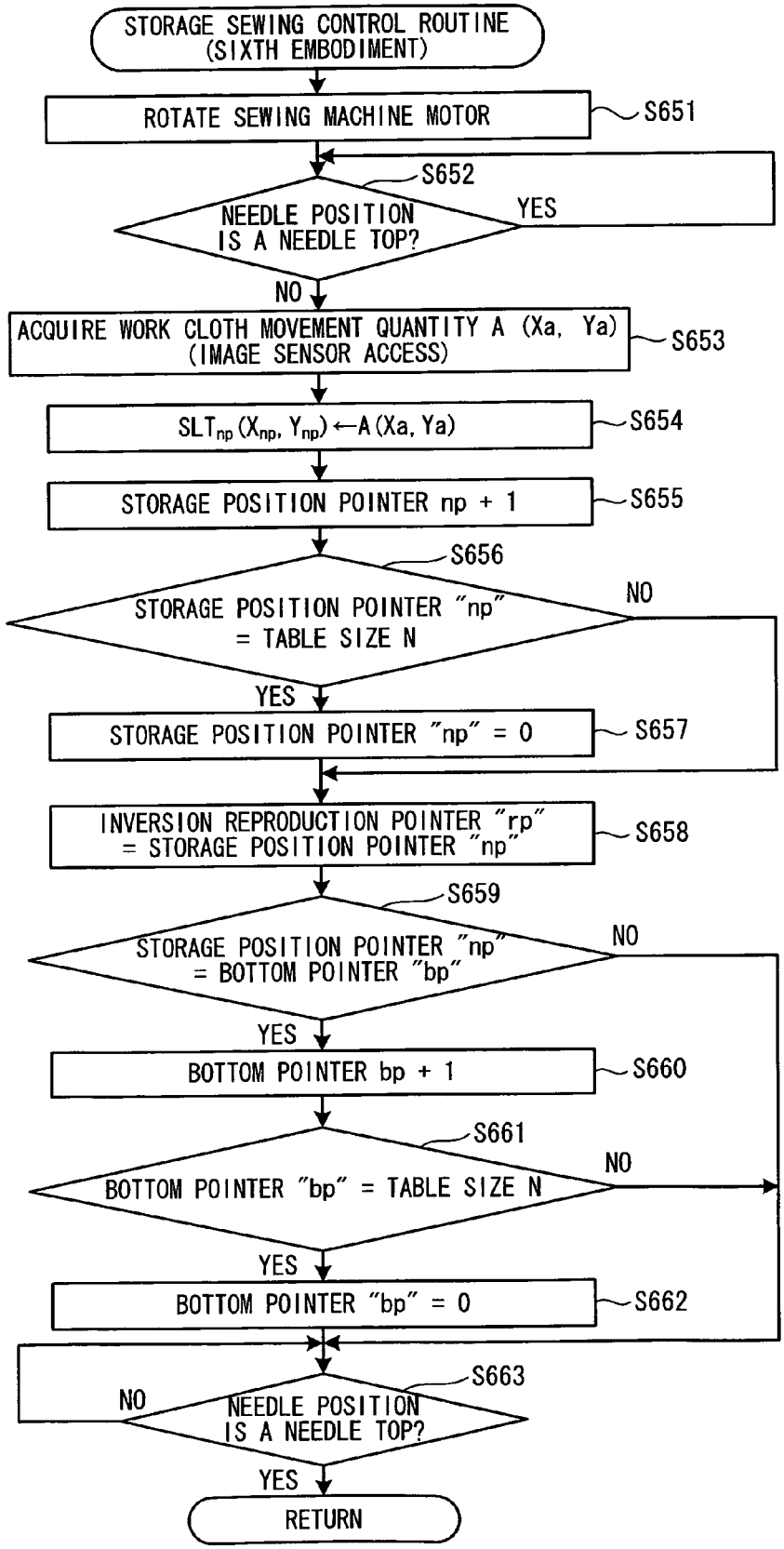
FIG. 44 is a flowchart of a storage sewing control routine performed in a sewing routine.

Next, the storage sewing control routine will be described with reference to FIG. 44. As shown in FIG. 44, first, the sewing machine motor 91 is rotated in step 651 (S651). Then, a determination is made as to whether the sewing needle 7 is at the top position based on an output result of the needle top sensor 56 in step 652 (S652), and the position of the sewing needle 7 is repeatedly determined while the sewing needle 7 is the top position (S652: YES, S652), and if the position is not the top position (S652: NO), the processing proceeds to step 653 (S653).

Next, an access is provided to the image sensor 50, the work cloth movement quantity A (Xa, Ya) is acquired (S653), and the acquired work cloth movement quantity A (Xa, Ya) is stored as coordinate information on an np-th stitch in a stitch history circulation table SLTnp (Xnp, Ynp) in step 654 (S654). Then, "1" is added to the storage position pointer "np" in step 655 (S655). Then, a determination is made as to whether the storage position pointer "np" is equal to a table size N in step 656 (S656). When the pointer is equal (S656: YES), it is denoted that stitch history circulation table SLT has made one round, and thus, "0" indicating first arrangement is stored in the storage position pointer "np" in step 657 (S657). When the pointer is not equal (S656: NO), a value of the storage position pointer "np" is kept unchanged.

Then, the value of the storage position pointer "np" is stored in the inversion reproduction pointer "rp" in step 658 (S658), and then, a determination is made as to whether the storage position pointer "np" is equal to the bottom pointer "bp" in step 659 (S659). After the stitch history circulation table SLT has made one round, if the storage position pointer "np" is increased by one (S655 to S657), the storage position pointer "np" and the bottom pointer "bp" becomes equal to each other. Therefore, when the storage position pointer "np" is equal to the bottom pointer "bp" (S659: YES), there is a need for increasing the bottom pointer "bp" by one. Then, if "1" is added to the bottom pointer "bp" in step 660 (S660), and then, in step 661 (S661) the bottom pointer "bp" is equal to the table size N (S661: YES), "0" is stored in the bottom pointer "bp" in step 662 (S662). Then, the processing proceeds to step 663 (S663). In addition, when the stitch history circulation table SLT has not made one round, and the storage position pointer "np" and the bottom pointer "bp" are not equal to each other (S659: NO), the processing proceeds to S663 as it is.

Then, at S663, a determination is made as to whether the sewing needle 7 is the top position based on an output value from the needle top sensor 56 (S663). Then, a needle position is repeatedly determined until the sewing needle 7 has been set at the top position (S663: NO, S663). Then, if the sewing needle 7 has been set at the top position (S663: YES), the processing may return to the sewing routine. As described above, in the storage sewing control routine, the sewing needle 7 is pierced on the work cloth, stitch coordinate information is stored in the stitch history circulation table SLT when a stitch has been formed, and then, values of various pointers are updated. Because the stitch history circulation table SLT may be used as a circulation table, when the stitch history circulation table SLT becomes full, the coordinate information on old arrangement is truncated, and overwritten, whereby a stitch is continuously stored.

Figure 45:
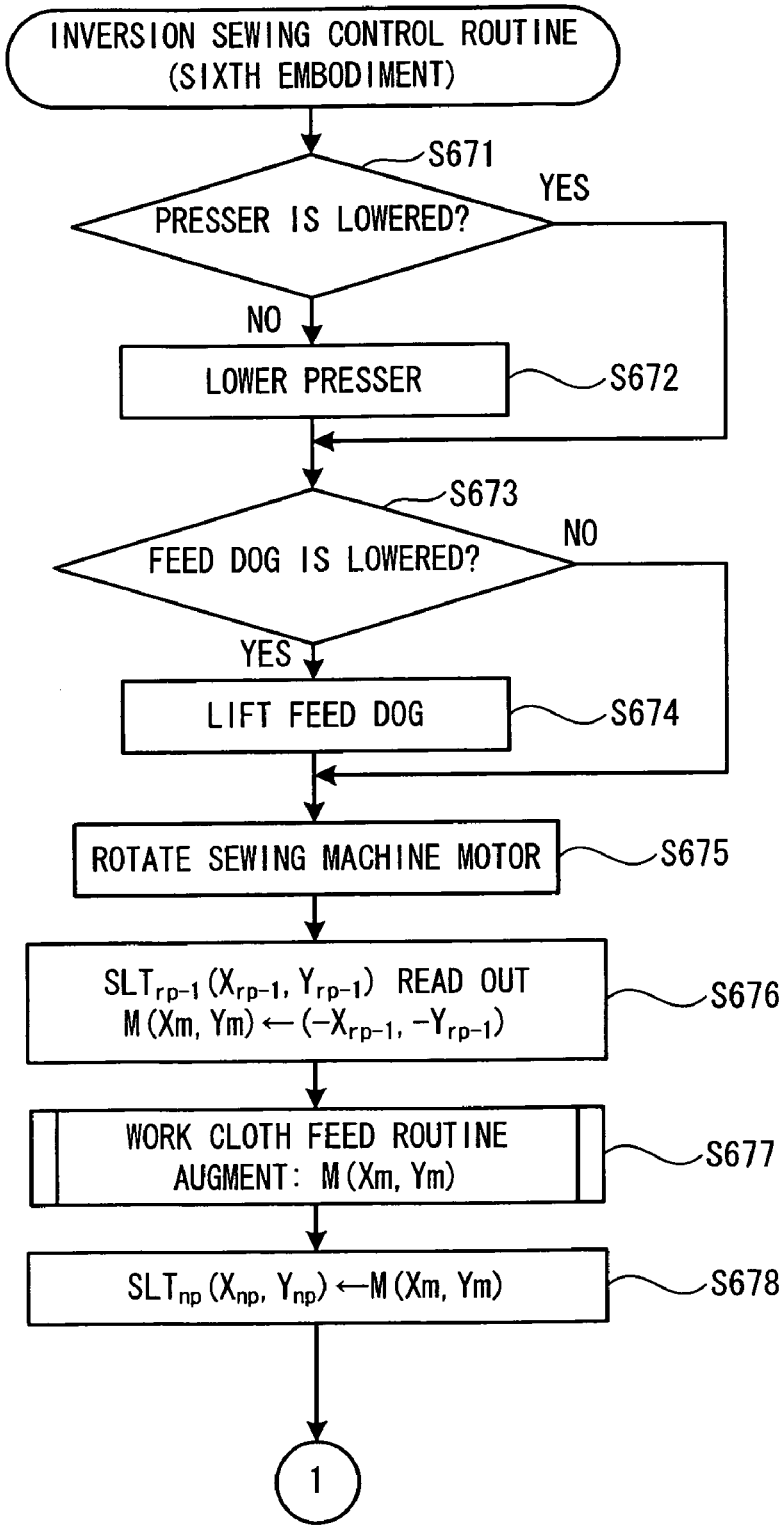
FIG. 45 is a flowchart of an inversion sewing control routine performed in a sewing routine.

Next, an inversion sewing control routine will be described with reference to FIG. 45 and FIG. 46. First, in step 671 (S671), when the presser foot 39 is not lowered (S671: NO), the presser foot elevation pulse motor 143 is driven, and then, the presser foot 39 is lowered in step 672 (S672). In step 673 (S673), when the feed dog 180 is lowered (S673: YES), the feed dog 180 is lifted in order to move the feed dog 180 in step 674 (S674). Then, the sewing machine motor 91 is rotated in step 675 (S675). Then, a stitch history circulation table SLTrp−1 (Xrp−1, Yrp−1) is read out, an inverted number that is a number obtained by changing signs of Xrp−1 and Yrp−1 is defined as the work cloth feed quantity M (Xm, Ym), and then, the defined quantity is stored in the work cloth movement quantity storage area 636 in step 676 (S676). Namely, Xm=−Xrp−1, Ym=−Yrp−1 is established. Then, while the work cloth feed quantity M is defined as an augment, the work cloth feed routine is executed in step 677 (S677) (refer to FIG. 11). Then, if the work cloth feed routine is executed, and then, a stitch for inversion sewing is formed (S677), information on that stitch is stored in the stitch history circulation table SLT in step 678 (S678). Specifically, M (Xm, Ym) is stored in SLTnp (Xnp, Ynp).

Figure 46:
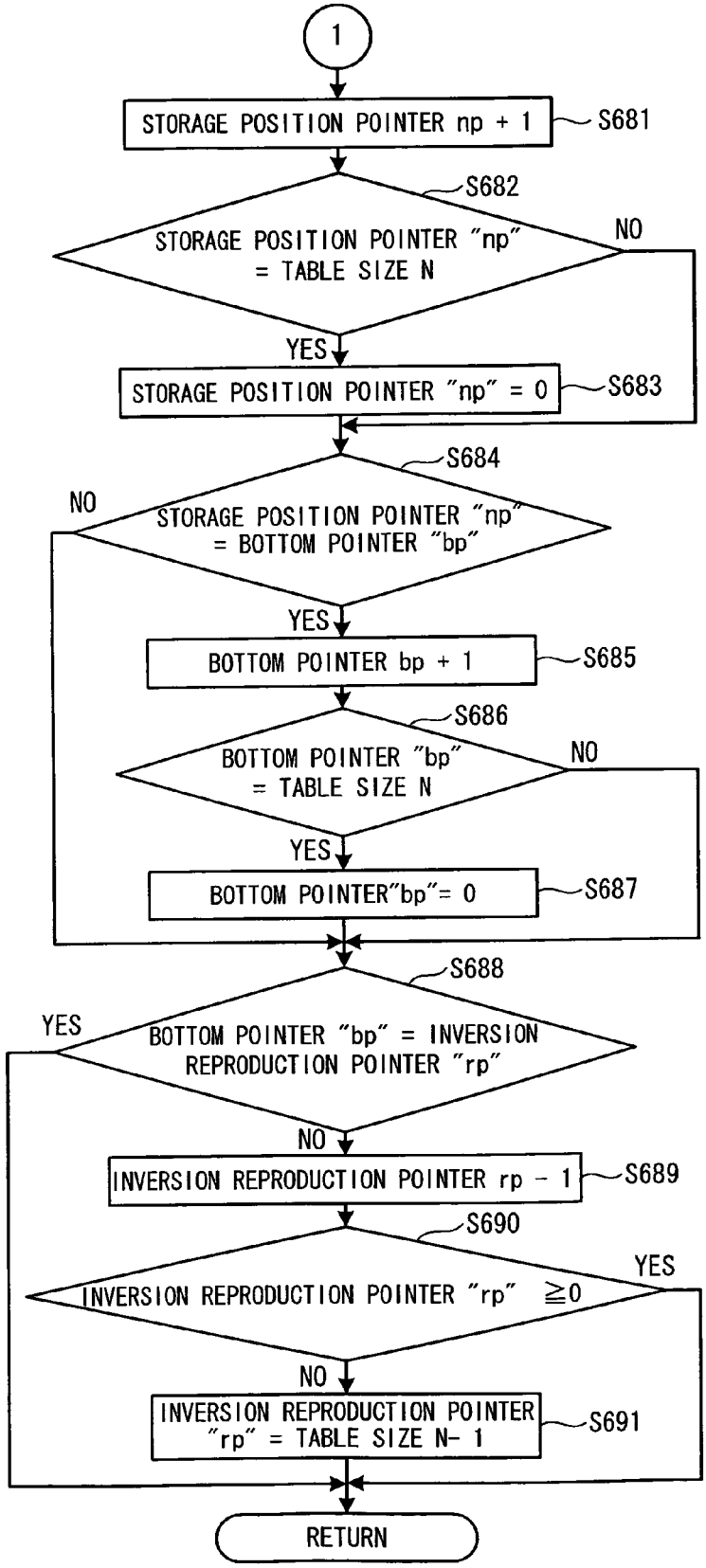
FIG. 46 is a flowchart of FIG. 45.

Then, as shown in FIG. 46, a process for updating various pointers is performed. First, "1" is added to the storage position pointer "np" in step 681 (S681). Then, in step 682 (S682), when the storage position pointer "np" is equal to the table size N (S682: YES), it is denoted that the stitch history circulation table SLT has made one round, and thus, "0" indicating first arrangement is stored in the storage position pointer "np" in step 683 (S683). When the pointer is not equal (S682: NO), the value of the storage position pointer "np" is kept unchanged.

Then, a determination is made as to whether the storage position pointer "np" is equal to the bottom pointer "bp" in step 684 (S684). After the stitch history circulation table SLT has made one round, if the storage position pointer "np" is increased by one (S681 to S683), the storage position pointer "np" and the bottom pointer "bp" become equal to each other. When the storage position pointer "np" is equal to the bottom pointer "bp" (S684: YES), there is a need for increasing the bottom pointer "bp" by one as well. Therefore, when "1" is added to the bottom pointer "bp" in step 685 (S685), and then, in step 686 (S686) the bottom pointer "bp" is equal to the table size N (S686: YES), "0" is stored in the bottom pointer "bp" in step 687 (S687). Then, the processing proceeds to step 688 (S688). When the bottom pointer "bp" is not equal to the table size N (S686: NO), the value of the bottom pointer "bp" is kept unchanged, and processing proceeds to S688. In addition, when the stitch history circulation table SLT has not made one round, and then, the storage position pointer "np" and the bottom pointer "bp" are not equal to each other (S684: NO), the processing proceeds to S688 as it is.

Then, at S688, a determination is made as to whether the bottom pointer "bp" is equal to the inversion reproduction pointer "rp" (S688). If the bottom pointer "bp" and the inversion reproduction pointer "rp" are equal to each other (S688: YES), a stitch to be inverted does not exist any more, and thus, an inversion sewing control routine terminates as it is, and then, the processing may return to the sewing routine. In addition, if the bottom pointer "bp" and the inversion reproduction pointer "rp" are not equal to each other (S688: NO), a stitch to be inverted still exists, and thus, "1" is decreased from the inversion reproduction pointer "rp" in step 689 (S689). If in step 690 (S690), the inversion reproduction pointer "rp" is equal to or greater than "0" (S690: YES), the inversion sewing control routine terminates, and the processing may return to the sewing routine. In addition, if the inversion reproduction pointer "rp" is not equal to or not greater than "0" (S690: NO), it is denoted that the stitch history circulation table SLT has circulated, and thus, "table size N−1" is stored in the inversion reproduction pointer "rp" in step 691 (S691). Then, the processing may return to the sewing routine. As described above, in the inversion sewing control routine, inversion sewing is performed tracing a stitch that is stored in the stitch history circulation table SLT.

Figure 47:
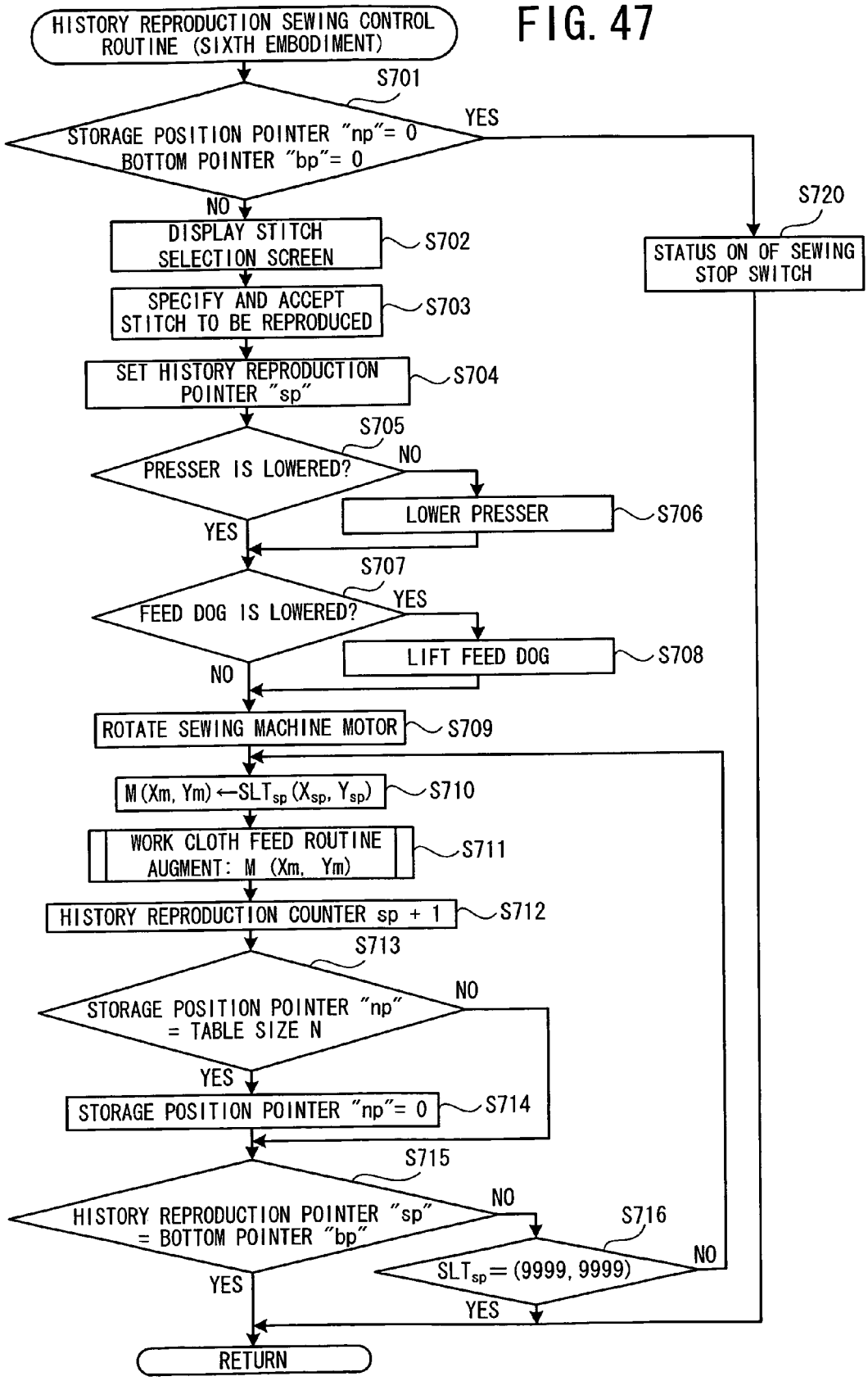
FIG. 47 is a flowchart of a history reproduction sewing control routine performed in a main routine.

Next, the history reproduction sewing control routine will be described with reference to FIG. 47. As shown in FIG. 47, first, a determination is made as to whether the storage position pointer "np" and the bottom pointer "bp" are set to "0" in step 701 (S701). If the two pointers are set to "0" (S701: YES), stitch information is not stored in the stitch history circulation table SLT yet, and thus, a status of the sewing stop switch 22 is set to ON, and then, the processing may return to the main routine.

If the two pointers are not set to "0" (S701: NO), a stitch selection screen (not shown) is displayed on the liquid crystal display 15 in step 702 (S702). On this stitch selection screen, there are provided: a stitch trajectory display area for displaying trajectory of a stitch stored in the stitch history circulation table SLT, an OK button, and a CANCEL button. In the stitch history circulation table SLT, when sewing has been started, a stitch start value of (9999, 9999) is stored. Then, a search is sequentially made for a "storage position pointer np+1"-th arrangement to a "storage position pointer np"-th arrangement. If (9999, 9999) data appears, the arrangement before (9999, 9999) appears next from the next arrangement or up to a "storage position pointer np"-th arrangement is obtained as stitch information on a series of sewing operations. Therefore, if three arrangements of (9999, 9999) exist, three sewing operations are recorded. Therefore, the stitch trajectories of three sewing operations are enumerated in a stitch trajectory display area. In displaying a stitch trajectory display area, instead of enumerating all trajectories, a "changeover button" is provided, and then, only one trajectory is displayed, whereby a stitch displayed may be switched by selecting the changeover button.

From among the displayed stitch operations (stitch trajectories), an input of which of the sewing operations that are to be reproduced is accepted in step 703 (S703). This input is made by means of the touch panel 26. If a position corresponding to a stitch trajectory display area of a liquid crystal display is touched, a stitch that is displayed there is selected. Then, if a position corresponding to the OK button is touched, a trajectory being selected is assumed as having been specified as a stitch that is to be reproduced. If a position corresponding to the CANCEL button is touched, the history reproduction sewing control routine is terminated, and then, the processing may return to the main routine. Then, an arrangement number in which first stitch of a selected sewing operation has been stored is stored in a history reproduction pointer "sp" in step 704 (S704). This value is obtained by adding "1" to an arrangement number of arrangement in which (9999, 9999) has been stored.

Then, in step 705 (S705), when the presser foot 39 is not lowered (S705: NO), the presser foot elevation pulse motor 143 is driven, and then, the presser foot 39 is lowered in step 706 (S706). In step 707 (S707), when the feed dog 180 is lowered (S707: YES), the feed dog 180 is lifted in order to move the feed dog 180 in step 708 (S708). Then, the sewing machine motor 91 is rotated in step 709 (S709). Then, a stitch history circulation table SLTsp (Xsp, Ysp) is read out, the work cloth feed quantity M (Xm, Ym) is obtained, and then, is stored in the work cloth movement quantity storage area 636 in step 710 (S710). Then, while the work cloth feed quantity M is defined as an augment, the work cloth feed routine is executed in step 711 (S711) (refer to FIG. 11).

Then, if the work cloth feed routine is executed, and then, a stitch for reproduction sewing is formed (S711), "1" is added to a history reproduction pointer "sp" in step 712 (S712). Then, in step 713 (S713), when the history reproduction pointer "sp" is equal to a table size N (S713: YES), "0" indicating first arrangement is stored in the history reproduction pointer "sp" in step 714 (S714). When the pointer is not equal (S713: NO), the value of the storage position pointer "np" is kept unchanged. Then, a determination is made as to whether the history reproduction pointer "sp" is equal to the bottom pointer "bp" in step 715 (S715). If the two pointers are equal to each other (S715: YES), a stitch to be reproduced does not exist any more, and thus, the processing may return to the sewing routine. When a stitch is stored in the stitch history circulation table SLT, a table circulates one round or more. When final sewing has been selected, YES is determined based on this determination.

In addition, if the two pointers are not equal to each other (S715: NO), in step 716 (S716), if an arrangement element SLTsp to be processed next is (9999, 9999) (S716: YES), this sewing is terminated, a stitch of next sewing is stored in next arrangement, and thus, the processing may return to the sewing routine. In addition, if SLTsp is not (9999, 9999) (S716: NO), the processing may return to S710 in order to form a next stitch.

Then, processing operations of S710 to S716 are repeatedly performed, and then, reproduction of sewing is performed. Then, if this sewing has terminated (S715: YES, S715: NO, S716: YES), the processing may return to the sewing routine. As described above, in the history reproduction sewing control routine, a stitch of a user's desired sewing can be reproduced from among the stitches stored in the stitch history circulation table SLT.

In the sixth example, a stitch history circulation table SLT may be a circular table, so that, even if a table is full, recording can be continuously made. Therefore, at a time other than when reproduction of sewing is performed, sewing can always be stored in the stitch history circulation table SLT. Then, in the stitch history circulation table SLT, a sufficiently large number of arrangements are allocated, so that a plurality of sewing operations can be stored. Therefore, a cloth that is intended for practice sewing is continuously sewn, the sewing results are compared with each other, and then, the most preferable sewing result is selected, whereby a cloth that is intended for regular sewing can be sewn.

As has been described above, in a sewing machine according to this disclosure, a movement direction and a movement quantity of the work cloth can be recorded, so that sewing can be recorded in free motion sewing in which a user performs sewing while moving the work cloth as well. Therefore, in free motion sewing as well, a trajectory similar to the sewn trajectory can be sewn. Accordingly, when practice sewing is performed with the use of the work cloth that is intended for practice sewing, and then, the desirable result is obtained, sewing similar to practice sewing can be performed for the work cloth for regular sewing, and thus, unsuccessful sewing is never performed for the work cloth that is intended for regular sewing. In this manner, there is no need for doing a work of unlacing a thread laced by unsuccessful sewing, a needle hole is never dripped on the work cloth that is intended for regular sewing due to unsuccessful sewing, and the work cloth that is intended for regular sewing is never damaged.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine for a user to perform sewing while moving a work cloth, the sewing machine comprising:

a detecting device that detects an image of the work cloth;

a movement calculating device that calculates, by two-dimensional coordinate data, a movement direction and a movement quantity of the work cloth between previous detection and current detection of the image of the work cloth by the detecting device when the image of the work cloth is detected by the detecting device, based on a range of a same position of the image and a position of the work cloth in the image, obtained by comparing the image detected at previous detection and the image detected at current detection;

a movement data storage device that stores movement data serving as two-dimensional coordinate data indicative of the movement direction and the movement quantity calculated by the movement calculating device;

a movement data creating device that detects the work cloth by the detecting device on a one by one needle basis of sewing stitches relative to the work cloth, calculates the movement data by the movement calculating device, and stores the movement data calculated by the movement calculating device in the movement data storage device;

a cloth feed mechanism that moves the work cloth; and a reproduction sewing control device that performs the sewing stitches while moving the work cloth by driving the cloth feed mechanism based on the movement data stored in the movement data storage device.

2. The sewing machine according to claim 1, further comprising:

a switching device that switches a normal mode for performing normal sewing and a practice mode for a user practicing the sewing, the sewing in practice mode being different from the normal sewing.

3. The sewing machine according to claim 2, wherein the movement data creating device stores the movement data in the movement data storage device when sewing is performed in the practice mode.

4. The sewing machine according to claim 2, wherein the reproduction sewing control device performs the sewing stitches while moving the work cloth by driving the cloth feed mechanism based on the movement data stored in the movement data storage device when the practice mode is set and the movement data is stored.

5. The sewing machine according to claim 1, further comprising:

a line segment information calculating device that calculates line segment information, the line segment information being information being related to a length of a line segment equivalent to a stitch performed by sewing, based on the movement data stored in the movement data storage device;

an evaluation value determining device that determines an evaluation value relative to sewing at the time of storing the movement data in the movement data storage device, based on the line segment information calculated by the line segment information calculating device; and an evaluation value notifying device that notifies the evaluation value determined by the evaluation value determining device.

6. The sewing machine according to claim 1, further comprising:

a movement data editing device that edits an end point of a line segment calculated by the line segment calculating device, as the end point being a needle drop position of a stitch relative to the movement data stored in the movement data storage device.

7. The sewing machine according to claim 1, further comprising:

a fluctuation adding device that adds a predetermined fluctuation value to the movement data stored in the movement data storage device.

8. The sewing machine according to claim 2, further comprising:

a line segment information calculating device that calculates line segment information, the line segment information being information related to a length of a line segment equivalent to a stitch by sewing, based on the movement data stored in the movement data storage device;

an evaluation value determining device that determines an evaluation value relative to sewing at the time of storing the movement data in the movement data storage device, based on the line segment information calculated by the line segment information calculating device; and an evaluation value notifying device that notifies the evaluation value determined by the evaluation value determining device.

9. The sewing machine according to claim 2, further comprising:

a movement data editing device that edits an end point of a line segment calculated by the line segment calculating device, the end point being a needle drop position of a stitch relative to the movement data stored in the movement data storage device.

10. The sewing machine according to claim 2, further comprising:

a fluctuation adding device that adds a predetermined fluctuation value to the movement data stored in the movement data storage device.

11. The sewing machine according to claim 2, further comprising:

a direction inversion device that inverts a sewing direction; and an inversion sewing device that performs sewing while moving the work cloth by driving the work feed mechanism so as to stitch a top of a stitch that is sewn immediately before, based on the movement data stored in the movement data storage device when a stitching direction is inverted by the direction inversion device, a current mode is switched to the practice mode by the switching device, and the movement data is stored in the movement data storage device, wherein the movement data creating device stores the movement data in the movement data storage device when sewing is performed by the inversion sewing device.

12. A non-transistory computer-readable recording medium storing a sewing machine control program of a computer-executable sewing machine for a user to perform sewing while moving a work cloth, the program comprising:

a detecting instruction for detecting an image of the work cloth;

a movement calculating instruction for calculating, by two-dimensional coordinate data, a movement direction and a movement quantity of the work cloth between previous detection and current detection of the image of the work cloth by the detecting instruction when the image of the work cloth is detected by the detecting instruction, based on a range of a same position of the image and a position of the work cloth in the image, obtained by comparing the image detected at previous detection and the image detected at current detection, a movement data storing instruction for storing movement data serving as two-dimensional coordinate data indicative of the movement direction and the movement quantity calculated by the movement calculating instruction;

a movement data creating instruction for detecting the work cloth by the detecting instruction on a one by one needle basis of sewing stitches relative to the work cloth, calculating and storing the movement data by the movement calculating instruction; and a reproduction sewing controlling instruction for performing the sewing stitches while moving the work cloth, based on the movement data stored by the movement data storing instruction.

13. The recording medium according to claim 12, further comprising:

a switching instruction for switching a normal mode for performing normal sewing and a practice mode for performing practicing the sewing, the sewing in practice mode being different from the normal sewing.

14. The recording medium according to claim 13, wherein the movement data creating instruction stores the movement data by the movement data storing instruction when sewing is performed in the practice mode.

15. The recording medium according to claim 13, wherein the reproduction sewing controlling instruction performs sewing stitches while moving the work cloth based on the movement data stored by the movement data storing instruction when the practice mode is set and the movement data for the movement data storing instruction is stored.

16. The recording medium according to claim 12, further comprising:

a line segment information calculating instruction for calculating line segment information, the line segment information being related to a length of a line segment equivalent to a stitch by sewing, based on the movement data stored in the movement data storing instruction;

an evaluation value determining instruction for determining an evaluation value relative to sewing at the time of storing the movement data by the movement data storing instruction, based on the line segment information calculated by the line segment information calculating instruction; and an evaluation value notifying instruction for notifying the evaluation value determined by the evaluation value determining instruction.

17. The recording medium according to claim 12, further comprising:

a movement data editing instruction for editing an end point of a line segment calculated by the line segment calculating instruction, the end point being a needle drop position of a stitch relative to the movement data stored by the movement data storing instruction.

18. The recording medium according to claim 12, further comprising:

a fluctuation adding instruction for adding a predetermined fluctuation value to the movement data stored by the movement data storing instruction.

19. The recording medium according to claim 13, further comprising:

a line segment information calculating instruction for calculating line segment information, the line segment information being related to a length of a line segment equivalent to a stitch by sewing, based on the movement data stored in the movement data storing instruction;

an evaluation value determining instruction for determining an evaluation value relative to sewing at the time of storing the movement data by the movement data storing instruction, based on the line segment information calculated by the line segment information calculating instruction; and an evaluation value notifying instruction for notifying the evaluation value determined by the evaluation value determining instruction.

20. The recording medium according to claim 13, further comprising:

a movement data editing instruction for editing an end point of a line segment calculated by the line segment calculating instruction, the end point being a needle drop position of a stitch relative to the movement data stored by the movement data storing instruction.

21. The recording medium according to claim 13, further comprising:

a fluctuation adding instruction for adding a predetermined fluctuation value to the movement data stored by the movement data storing instruction.

22. The recording medium according to claim 13, further comprising:

a direction inversion instruction for inverting a sewing direction; and an inversion sewing instruction for performing sewing while moving the work cloth so as to stitch a top of a stitch sewn immediately before, based on the movement data stored by the movement data storing instruction when a stitching direction is inverted by the direction inversion instruction, a current mode is switched to the practice mode by the switching instruction, and the movement data is stored by the movement data storing instruction, wherein the movement data creating instruction stores the movement data by the movement data storing instruction even when sewing is performed by the inversion sewing instruction.

* * * * *